US010287758B2

(12) United States Patent
Capp et al.

(10) Patent No.: US 10,287,758 B2
(45) **Date of Patent: *May 14, 2019**

(54) ADJUSTABLE HEIGHT SHOWER APPARATUS

(71) Applicant: FOCUSED REALITY LLC, Winston-Salem, NC (US)

(72) Inventors: Christopher Michael Capp, Winston-Salem, NC (US); Jeremy Losaw, Charlotte, NC (US); Patrick Bailey, Charlotte, NC (US); Raeshon McNeil, Charlotte, NC (US)

(73) Assignee: FOCUSED REALITY, INC., Cranston, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/444,286

(22) Filed: Feb. 27, 2017

(65) Prior Publication Data

US 2017/0167122 A1 Jun. 15, 2017

Related U.S. Application Data

(63) Continuation-in-part of application No. 14/748,855, filed on Jun. 24, 2015, now Pat. No. 9,578,994, and a continuation-in-part of application No. PCT/US2016/039095, filed on Jun. 23, 2016, which is a continuation-in-part of application No. 14/748,855, filed on Jun. 24, 2015, now Pat. No. 9,578,994.

(60) Provisional application No. 62/183,379, filed on Jun. 23, 2015.

(51) Int. Cl.

| | |
|---|---|
| ***A47K 3/022*** | (2006.01) |
| ***E03C 1/04*** | (2006.01) |
| ***A47K 3/28*** | (2006.01) |
| ***B05B 1/18*** | (2006.01) |

(52) U.S. Cl.

CPC ..... *E03C 1/0408* (2013.01); *A47K 3/283* (2013.01); *A47K 3/287* (2013.01); *B05B 1/185* (2013.01)

(58) Field of Classification Search

USPC ..... 4/601

See application file for complete search history.

(56) References Cited

U.S. PATENT DOCUMENTS

| | | | | |
|---|---|---|---|---|
| 3,971,074 A * | 7/1976 | Yxfeldt | A47K 3/287 | 4/570 |
| 5,148,556 A * | 9/1992 | Bottoms, Jr. | A47K 3/281 | 239/273 |
| 2007/0209108 A1* | 9/2007 | Shorr | E03C 1/06 | 4/601 |

* cited by examiner

*Primary Examiner* — Lauren Crane

(74) *Attorney, Agent, or Firm* — Chad D. Tillman; Jeremy C. Doerre; Tillman Wright, PLLC

(57) ABSTRACT

An adjustable height shower apparatus comprises a rigid framework of fluid conduits to which a plurality of sprayers is attached in an arrangement of sprayers, the fluid conduits defining fluid passageways from a fluid inlet port to the arrangement of sprayers, whereby pressurized water is able to flow from the fluid inlet port to the arrangement of sprayers; and a mounting assembly comprising a mounting component configured for attachment at a fixed position on a wall in a shower stall or bathtub installation, the framework and arrangement of sprayers attached thereto being adjustable and lockable at different desired heights on the mounting component. The arrangement of sprayers may comprise a plurality of sprayers arranged in a circumferential manner along an oval portion of the framework.

20 Claims, 46 Drawing Sheets

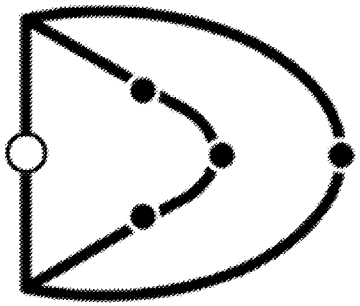
FIG. 24
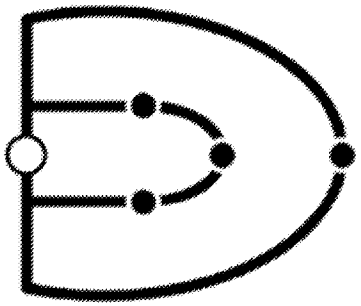
FIG. 25
FIG. 26
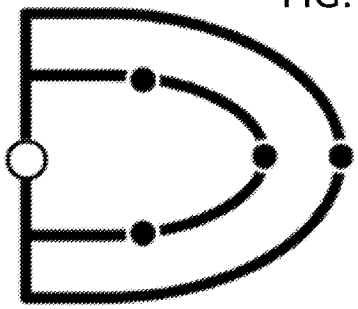
FIG. 27
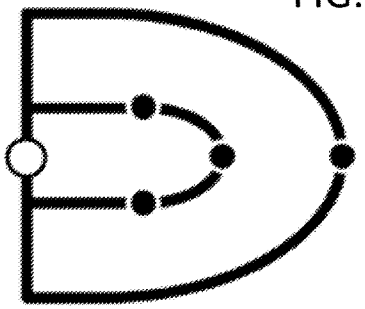
FIG. 28
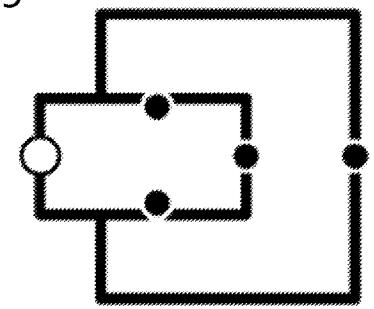
FIG. 29
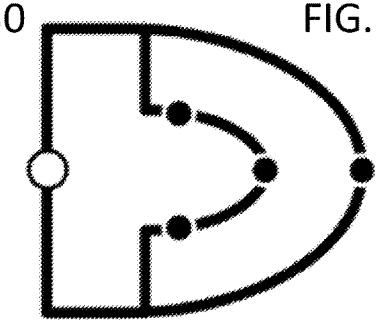
FIG. 30
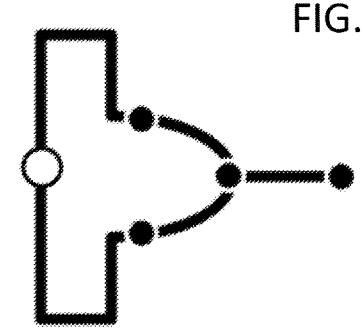
FIG. 31
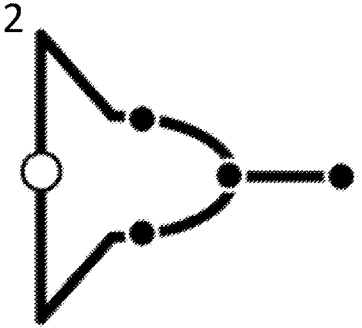
FIG. 32

ADJUSTABLE HEIGHT SHOWER APPARATUS

CROSS-REFERENCE TO RELATED APPLICATIONS

The present application is a continuation-in-part of patent application of, and claims priority under 35 U.S.C. § 120 to, U.S. nonprovisional patent application Ser. No. 14/748,855, now U.S. Pat. No. 9,578,994, each of which '855 application and '994 patent is incorporated by reference herein, and which '855 application is a U.S. nonprovisional patent application of, and claims priority under 35 U.S.C. § 119(e) to, U.S. provisional patent application 62/183,379, which provisional patent application is incorporated by reference herein; and the present application is a continuation-in-part of patent application of, and claims priority under 35 U.S.C. § 120 to, international patent application PCT/US2016/039095, which published as WO/2016210178, incorporated herein by reference, and which international patent application (1) is continuation-in-part of patent application of, and claims priority under 35 U.S.C. § 120 to, U.S. nonprovisional patent application Ser. No. 14/748,855, now U.S. Pat. No. 9,578,994, which '855 application is a U.S. nonprovisional patent application of, and claims priority under 35 U.S.C. § 119(e) to, U.S. provisional patent application 62/183,379; and (2) is a U.S. nonprovisional patent application of, and claims priority under 35 U.S.C. § 119(e) to, U.S. provisional patent application 62/183,379, which provisional patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to shower apparatus and, in particular, shower apparatus having multiple sprayers, wherein the height of the sprayers preferably is adjustable.

Not everyone uses a shower just for cleaning, and many use showers for relaxing. Common showers are singular in approach to delivering water to the body, which approach exposes the rear of the head, neck and back when a user faces away a shower. When a user turns to cover these areas with water from the shower, the user exposes his or her arms, chest and stomach. This creates "cold zones" on the body, and the user has no option to achieve complete coverage.

Use of shower apparatus having multiple sprayers is believed to result in significant improvement in water coverage of the body, thereby enhancing the relaxation experienced when taking a shower. Shower apparatus having multiple sprayers are disclosed, for example, in the following U.S. patent properties: 2006/0236451; U.S. Pat. Nos. 7,987,533; 7,448,096; 6,829,790; 6,745,414; 6,550,6080; 6,415,461; 6,079,060; 5,909,969; 5,799,346; 5,692,252; 5,564,139; 5,148,556; 5,060,322; 4,927,083; 4,872,225; 4,809,369; 4,554,690; 3,984,879; 3,971,074; 3,913,839; 944,611; 924,602; 819,582; 475,754; 439,793; and 432,712. United States patent publication 2016/0059243 discloses yet additional shower apparatus.

Even in view of such shower apparatus, however, it is believed that a need exists for improvement, including improvements in ease of installation and ability to accommodate users of different heights. It is believed that one or more such improvements are achieved by at least one preferred embodiment of the present invention.

SUMMARY OF THE INVENTION

The present invention generally relates to apparatus and methods pertaining to adjustable height suspended shower apparatus with multiple sprayers. Moreover, the present invention includes many aspects and features.

In an aspect, an adjustable height shower apparatus comprises a rigid framework of fluid conduits to which a plurality of sprayers is attached in an arrangement of sprayers, the fluid conduits defining fluid passageways from a fluid inlet port to the arrangement of sprayers, whereby pressurized water is able to flow from the fluid inlet port to the arrangement of sprayers; and a mounting assembly comprising a mounting component configured for attachment at a fixed position on a wall in a shower stall or bathtub installation, the framework and arrangement of sprayers attached thereto being adjustable and lockable at different desired heights on the mounting component. The arrangement of sprayers may comprise a plurality of sprayers arranged in a circumferential manner along an oval portion of the framework.

In another aspect, an adjustable height shower apparatus comprises a rigid framework of fluid conduits in which a plurality of sprayers are arranged around an oval portion of the framework. The fluid conduits define fluid passageways from a fluid inlet port to the arrangement of sprayers whereby pressurized water is able to flow from the fluid inlet port to the arrangement of sprayers. The apparatus further includes a mounting assembly comprising a mounting component configured for attachment at a fixed position on a wall in a shower stall or bathtub installation. The framework is adjustable and lockable at different desired heights on the mounting component for adjusting the height of the arrangement of sprayers to permit a person to stand under the arrangement of sprayers of the oval portion of the framework. Preferably, an additional sprayer is located at an elevation below the mounting component and arranged to spray a front of a person standing under the oval portion of the framework.

In another aspect, an adjustable height shower apparatus comprises a rigid framework of fluid conduits to which a plurality of sprayers is attached in an arrangement of sprayers, the fluid conduits defining fluid passageways from a fluid inlet port to the arrangement of sprayers, whereby pressurized water is able to flow from the fluid inlet port to the arrangement of sprayers; and a mounting assembly comprising a mounting component configured for attachment at a fixed position on a wall in a shower stall or bathtub installation, the framework and arrangement of sprayers attached thereto being adjustable and lockable at different desired heights on the mounting component. The arrangement of sprayers comprises a front sprayer located at an elevation below the mounting component and configured to spray water onto a front of a person's body, an intermediate sprayer located at an elevation above the mounting component and configured to spray water onto a person's head, and a back sprayer located at an elevation above the mounting component and configured to spray water onto a person's back.

In a feature, the front sprayer represents the lowest sprayer of the arrangement.

In a feature, the framework acts as a cantilever in support of the intermediate sprayer and the back sprayer.

In a feature, the apparatus further comprises a component positionable on the mounting component at different vertical distances to a floor in the shower stall or bathtub installation, whereby the framework and the arrangement of sprayers are adjustable and lockable at different desired heights by moving and locking the component on the mounting component. The component that is positionable on the mounting component may comprise a portion of the framework that is slidable on the mounting component and, in particular, a vertically extending portion of the framework that is slidable within a channel defined by the mounting component; or, the framework may be attached to the component that is positionable on the mounting component, which component is separate from the framework.

In a feature, the apparatus further comprises a flow control valve by which flow within the framework to multiple sprayers is turned on and off.

In yet additional features, the front sprayer is configured to act as a drain for the framework when water is turned off to the shower apparatus; the arrangement of sprayers further comprises one or more additional front sprayers, each located at a vertical elevation below the mounting component and configured to spray water onto a person's front; the arrangement of sprayers further comprises one or more additional intermediate sprayers, each located at an elevation above the mounting component and configured to spray water onto a person's head; the arrangement of sprayers further comprises one or more additional back sprayers, each located at a vertical elevation above the mounting component and configured to spray water onto a person's back; and the mounting assembly represents a single point of mounting of the adjustable height shower apparatus in the shower stall or bathtub installation.

In another feature, the apparatus further comprises an adhesive for attaching the mounting component to a wall in the shower stall or bathtub installation.

In another aspect, a bathtub arrangement or shower stall comprises: (a) a rigid framework of fluid conduits to which a plurality of sprayers is attached in an arrangement of sprayers, the fluid conduits defining fluid passageways from a fluid inlet port to the arrangement of sprayers, whereby pressurized water is able to flow from the fluid inlet port to the arrangement of sprayers; and (b) a mounting assembly comprising a mounting component attached at a fixed position on a wall in a shower stall or bathtub installation, the framework and arrangement of sprayers attached thereto being adjustable and lockable at different desired heights on the mounting component; wherein, when the framework and arrangement of sprayers are locked at a desired height on the mounting component, at least one of the arrangement of sprayers comprises a front sprayer located at an elevation below the mounting component and configured to spray water onto a front of a person's body, at least one of the arrangement of sprayers comprises an intermediate sprayer located at an elevation above the mounting component and configured to spray water onto a person's head, and at least one of the arrangement of sprayers comprises a back sprayer located at an elevation above the mounting component and configured to spray water onto a person's back;

In features, the back sprayer is located at an elevation below the intermediate sprayer; the front sprayer of the arrangement of sprayers is configured to act as a drain for the framework when water is turned off to the framework; the arrangement of sprayers further comprises one or more additional intermediate sprayers each located at a vertical elevation above the mounting component and configured to spray water onto a person's head; the arrangement of sprayers further comprises one or more additional back sprayers each located at a vertical elevation above the mounting component and configured to spray water onto a person's back; and the mounting assembly represents a single point of mounting of the framework to the wall.

In another feature, the bathtub arrangement or shower stall further comprises a flow control valve by which flow within the framework to multiple sprayers is turned on and off.

In another aspect, a method of installing a shower apparatus in an existing bathtub arrangement or shower stall comprises the steps of: mounting, onto a wall from which a shower head extends, a rigid framework of fluid conduits using a mounting assembly such that the framework is adjustable in height relative to a floor, the framework comprising an arrangement of sprayers, the fluid conduits defining fluid passageways from a fluid inlet port to each sprayer of the arrangement of sprayers whereby pressurized water is able to flow from the fluid inlet port to each sprayer of the arrangement of sprayers; connecting the framework to plumbing in the wall for the flow of water thereto; and adjusting the height of the framework such that the arrangement of sprayers comprises a front sprayer that is located at a vertical elevation below the component and that is configured to spray water onto a front of a person's body, an intermediate sprayer that is located at a vertical elevation above the mounting assembly and that is configured to spray water onto a person's head, and a back sprayer that is located at a vertical elevation above the mounting assembly and that is configured to spray water onto a person's back.

In features, the front sprayer represents a lowermost sprayer of the arrangement of sprayers; the framework acts as a cantilever in supporting the intermediate sprayer and the back sprayer; the front sprayer of the arrangement of sprayers is configured to act as a drain for the framework when water is turned off to the framework; and the method further includes turning flow within the framework to multiple sprayers on and off using a flow control valve.

In another aspect, an adjustable height suspended shower apparatus having an arrangement of a plurality of sprayers comprises: (a) a ceiling mounting assembly for attachment thereof to a ceiling surface; (b) a plurality of tensioning lines; and (c) an assembly suspended from a ceiling by the ceiling mounting assembly and the plurality of tension lines, the suspended assembly comprising sprayers and a framework of fluid conduits to which the sprayers are attached in an arrangement of sprayers, the fluid conduits defining fluid passageways from a fluid inlet port to each sprayer of the arrangement of sprayers whereby pressurized water flows from the fluid inlet port to and is sprayed from each sprayer of the arrangement of sprayers; (d) wherein each of the tension lines extends from the ceiling mounting assembly to an attachment location of the framework by which tension lines the suspended assembly is held at a suspended height; and (e) wherein the ceiling mounting assembly comprises a spool in engagement with the tension lines such that winding of the spool in a first rotational direction results retraction of the tensioning lines into the ceiling mounting assembly and raising of the suspended assembly, and unwinding of the spool in a second, opposite rotational direction results in extension of the tensioning lines out of the ceiling mounting assembly and lowering of the suspended assembly.

In a feature, the ceiling mounting assembly comprises a spring that biases rotation of the spool in the first rotational direction.

In another feature, the ceiling mounting assembly comprises an opening exposing an end of the spool, through which opening access to the exposed end of the spool is provided for winding and unwinding of the spool by a person standing under the ceiling mounting assembly.

In another aspect, an adjustable height suspended shower apparatus having an arrangement of a plurality of sprayers comprises: (a) a ceiling mounting assembly for attachment thereof to a ceiling surface; (b) a plurality of tensioning lines; and (c) an assembly suspended from a ceiling by the ceiling mounting assembly and the plurality of tension lines, the suspended assembly comprising sprayers and a framework of fluid conduits to which the sprayers are attached in an arrangement of sprayers, the fluid conduits defining fluid passageways from a fluid inlet port to each sprayer of the arrangement of sprayers whereby pressurized water flows from the fluid inlet port to and is sprayed from each sprayer of the arrangement of sprayers; (d) wherein each of the tension lines extends from the ceiling mounting assembly to an attachment location of the framework by which tension lines the suspended assembly is held at a suspended height; (e) wherein the ceiling mounting assembly comprises a spool in engagement with the tension lines such that winding of the spool in a first rotational direction results retraction of the tensioning lines into the ceiling mounting assembly and raising of the suspended assembly, and unwinding of the spool in a second, opposite rotational direction results in extension of the tensioning lines out of the ceiling mounting assembly and lowering of the suspended assembly; (f) wherein the ceiling mounting assembly comprises a spring that biases rotation of the spool in the first rotational direction; and (g) wherein the ceiling mounting assembly comprises an opening exposing an end of the spool, through which opening access to the exposed end of the spool is provided for winding and unwinding of the spool by a person standing under the ceiling mounting assembly.

In a feature of this aspect, the suspended assembly further comprises a spindle that is removably attached to the framework, and wherein the exposed end of the spool defines a geometric recess that is configured to correspond to and mate in abutment with a geometric protuberance located on a top of the spindle, whereby removal of the spindle from the framework and insertion of the top of the spindle through the opening exposing the end of the spool results in mating of the geometric protuberance with in the geometric recess, and wherein rotation of the spindle results in rotation of the spool. The suspended assembly further preferably comprises a spindle mounting clamp by which the spindle is removably attached to the framework; and the spindle mounting clamp comprises a C-shaped portion for frictional fit onto tubing of the framework, and comprises a cylindrical portion for receipt therethrough of the spindle, with a head of the spindle abutting and resting on an upper rim of the cylindrical portion of the spindle mounting clamp.

In another feature of this aspect, the exposed end of the spool further comprises a protuberance that is received within a mating recess of a base of the ceiling mounting assembly in abutment therewith such that the spool is locked from rotation, and the spool must be elevated such that the protuberance of the spool is lifted out of the mating recess of the ceiling mounting assembly before rotation of the spool is enabled. The protuberance of the spool preferably is gear-shaped; and the protuberance of the spool is spring biased into reception within the mating recess in abutment therewith. The suspended assembly further preferably includes a spindle that is removably attached to the framework, and the exposed end of the spool defines a geometric recess that is configured to correspond to and mate in abutment with a geometric protuberance located on a top of the spindle, whereby removal of the spindle from the framework and insertion of the top of the spindle through the opening exposing the end of the spool results in mating of the geometric protuberance with in the geometric recess, and wherein lifting of the spool with the spindle and subsequent rotation of the spindle results in rotation of the spool. The suspended assembly further may include a spindle mounting clamp by which the spindle is removably attached to the framework.

In another feature, the ceiling mounting assembly comprises an adhesive tape for adherence of the ceiling mounting assembly to the surface of the ceiling.

In another feature, the ceiling mounting assembly comprises mechanical fasteners such as screws, bolts, nails, or combination thereof, for attaching the ceiling mounting assembly to the ceiling.

In another feature, the suspended assembly further comprises a hose extending from a shower faucet to the fluid inlet for flow of pressurized water to the fluid inlet.

In another feature, the suspended assembly further comprises a flow control valve by which flow within the framework to multiple sprayers is turned on and off.

In another feature, each shower sprayer comprises a flow control valve for turning flow through the sprayer on and off, and a swivel joint for directing spray from the sprayer.

In another feature, the suspended assembly further comprises tension line mounting clamps defining the attachment locations of the framework at which the tension lines are attached. Each tension line mounting clamp preferably comprises a loop portion for attachment of a respective one of the tensioning lines.

In another feature, the inlet port is threaded for attachment of a hose for connection to plumbing for a shower head or to a diverter of a shower head.

In another feature, the arrangement of sprayers comprises a front sprayer located so as to spray water onto a front of a person's body; two side sprayers each located to spray water onto an opposite side of a person's head and adjacent shoulder; and a back sprayer located to spray water onto a person's back. Preferably, the two side sprayers and the back sprayer are located at an elevation above a person's head, and the front sprayer represents the lowermost sprayer and is configured to act as a drain for the framework of conduits when the water is turned off to the shower apparatus. Furthermore, an additional sprayer may be included for directing water toward the back of the head and back of the neck area.

In another feature, the ceiling mounting assembly comprises a cover; and a mounting plate.

The cover preferably comprises equally spaced tension line openings configured for tension lines to extend therethrough.

The cover preferably includes locking flanges, and the mounting plate includes locking slots, whereby when the cover is placed over the mounting plate and rotated, the flanges are received in the slots such that the cover is retained to the mounting plate when the mounting plate is secured to a ceiling. The mounting plate preferably comprises tension line guides in the form of mounted rollers such that, when the cover is locked in place on the mounting plate, each mounted roller is located proximate a tension line opening such that a respective tension line extending therethrough is redirected radially toward a center axis of the ceiling mounting assembly.

In another feature, the apparatus further comprises a consolidation ring located below the ceiling mounting assembly and above the framework, through which consolidation ring the tensioning lines are guided.

In another aspect, an adjustable height suspended shower apparatus having an arrangement of a plurality of sprayers comprises: (a) a ceiling mounting assembly for attachment thereof to a ceiling; (b) a plurality of tensioning lines; and (c) an assembly comprising sprayers and a framework of fluid conduits to which the sprayers are attached in an arrangement of sprayers, the fluid conduits defining fluid passageways from a fluid inlet port to each sprayer of the arrangement of sprayers whereby pressurized water flows from the fluid inlet port to and is sprayed from each sprayer of the arrangement of sprayers. The ceiling mounting assembly and tensions lines are configured for suspending the framework from the ceiling, with each of the tension lines extending from the ceiling mounting assembly to an attachment location of the framework by which tension lines the framework and attached sprayers are held at a suspended height. The ceiling mounting assembly comprises a spool in engagement with the tension lines such that winding of the spool in a first rotational direction results retraction of the tensioning lines into the ceiling mounting assembly and raising of the suspended assembly, and unwinding of the spool in a second, opposite rotational direction results in extension of the tensioning lines out of the ceiling mounting assembly and lowering of the suspended assembly. The ceiling mounting assembly further comprises a spring that biases rotation of the spool in the first rotational direction.

In another aspect, an adjustable height suspended shower apparatus having an arrangement of a plurality of sprayers comprises: (a) a ceiling mounting assembly for attachment thereof to a ceiling; (b) a plurality of tensioning lines; and (c) an assembly comprising sprayers and a framework of fluid conduits to which the sprayers are attached in an arrangement of sprayers, the fluid conduits defining fluid passageways from a fluid inlet port to each sprayer of the arrangement of sprayers whereby pressurized water flows from the fluid inlet port to and is sprayed from each sprayer of the arrangement of sprayers. The ceiling mounting assembly and tensions lines are configured for suspending the framework from the ceiling, with each of the tension lines extending from the ceiling mounting assembly to an attachment location of the framework by which tension lines the framework and attached sprayers are held at a suspended height. The ceiling mounting assembly comprises a spool in engagement with the tension lines such that winding of the spool in a first rotational direction results retraction of the tensioning lines into the ceiling mounting assembly and raising of the suspended assembly, and unwinding of the spool in a second, opposite rotational direction results in extension of the tensioning lines out of the ceiling mounting assembly and lowering of the suspended assembly. The ceiling mounting assembly further defines an opening exposing an end of the spool, through which opening access to the exposed end of the spool is provided for winding and unwinding of the spool by a person standing under the ceiling mounting assembly.

In another aspect, an adjustable height suspended shower apparatus having an arrangement of a plurality of sprayers comprises: a ceiling mounting assembly for attachment thereof to a ceiling surface; a plurality of tensioning lines; and an assembly suspended from a ceiling by the ceiling mounting assembly and the plurality of tension lines, the suspended assembly comprising sprayers and a framework of fluid conduits to which the sprayers are attached in an arrangement of sprayers, the fluid conduits defining fluid passageways from a fluid inlet port to each sprayer of the arrangement of sprayers whereby pressurized water flows from the fluid inlet port to and is sprayed from each sprayer of the arrangement of sprayers. Each of the tension lines extends from the ceiling mounting assembly to an attachment location of the framework by which tension lines the suspended assembly is held at a suspended height. The ceiling mounting assembly comprises a spool in engagement with the tension lines such that winding of the spool in a first rotational direction results retraction of the tensioning lines into the ceiling mounting assembly and raising of the suspended assembly, and unwinding of the spool in a second, opposite rotational direction results in extension of the tensioning lines out of the ceiling mounting assembly and lowering of the suspended assembly. Additionally, the ceiling mounting assembly defines an opening exposing an end of the spool, through which opening access to the exposed end of the spool is provided for winding and unwinding of the spool by a person standing under the ceiling mounting assembly.

In a feature, the ceiling mounting assembly comprises a spring that biases rotation of the spool in the first rotational direction.

In a feature, the suspended assembly further comprises a spindle that is removably attached to the framework, and the exposed end of the spool is configured to engage a top of the spindle such that drive torque is transmitted to the spool upon rotation of the spindle.

In another feature, the exposed end of the spool mates with a base of the ceiling mounting assembly in abutment therewith such that the spool is locked from rotation, and the spool must be elevated such that the spool is lifted out of the abutment with the base of the ceiling mounting assembly before rotation of the spool is enabled. Further in this regard, the exposed end of the spool may comprise a protuberance having a shape that is received within a recess of the base of the ceiling mounting assembly, and the protuberance of the spool may be spring biased into reception within the mating recess of the base of the ceiling mounting assembly in abutment therewith.

In another feature, the suspended assembly further comprises a hose configured to attach to the fluid inlet and extend and attach to a shower faucet for flow of pressurized water to the fluid inlet.

In another aspect, an adjustable height suspended shower apparatus having an arrangement of a plurality of sprayers comprises: (a) a ceiling mounting assembly for attachment thereof to a ceiling; (b) a plurality of tensioning lines; and (c) an assembly comprising sprayers and a framework of fluid conduits to which the sprayers are attached in an arrangement of sprayers, the fluid conduits defining fluid passageways from a fluid inlet port to each sprayer of the arrangement of sprayers whereby pressurized water flows from the fluid inlet port to and is sprayed from each sprayer of the arrangement of sprayers. The ceiling mounting assembly and tensions lines are configured for suspending the framework from the ceiling, with each of the tension lines extending from the ceiling mounting assembly to an attachment location of the framework by which tension lines the framework and attached sprayers are held at a suspended height. Furthermore, the ceiling mounting assembly comprises a spool in engagement with the tension lines such that winding of the spool in a first rotational direction results retraction of the tensioning lines into the ceiling mounting assembly and raising of the suspended assembly, and unwinding of the spool in a second, opposite rotational direction results in extension of the tensioning lines out of the ceiling mounting assembly and lowering of the suspended assembly. Additionally, the ceiling mounting assembly comprises a spring that biases rotation of the spool in the first rotational direction.

In another aspect, an adjustable height suspended shower apparatus having an arrangement of a plurality of sprayers comprises: a ceiling mounting assembly for attachment thereof to a ceiling surface; a plurality of tensioning lines; and an assembly comprising sprayers and a framework of fluid conduits to which the sprayers are attached in an arrangement of sprayers, the fluid conduits defining fluid passageways from a fluid inlet port to each sprayer of the arrangement of sprayers whereby pressurized water flows from the fluid inlet port to and is sprayed from each sprayer of the arrangement of sprayers. The ceiling mounting assembly and tensions lines are configured for suspending the framework from the ceiling, with each of the tension lines extending from the ceiling mounting assembly to an attachment location of the framework by which tension lines the framework and attached sprayers are held at a suspended height. The ceiling mounting assembly comprises a spool in engagement with the tension lines such that winding of the spool in a first rotational direction results retraction of the tensioning lines into the ceiling mounting assembly and raising of the suspended assembly, and unwinding of the spool in a second, opposite rotational direction results in extension of the tensioning lines out of the ceiling mounting assembly and lowering of the suspended assembly. The ceiling mounting assembly defines an opening exposing an end of the spool, through which opening access to the exposed end of the spool is provided for winding and unwinding of the spool by a person standing under the ceiling mounting assembly.

Other aspects of the invention comprise methods of using apparatus of the foregoing aspects.

Still other aspects comprise kits for up-fitting conventional showers with adjustable height suspended shower apparatus with multiple sprayers. Alternatively, one or more of the foregoing aspects and features can be integrated into a shower as provided by a builder.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein the same elements are referred to with the same reference numerals.

FIG. 24 schematically illustrates an exemplary arrangement of shower sprayers in accordance with a preferred embodiment of the present invention.

FIG. 25 schematically illustrates another exemplary arrangement of shower sprayers in accordance with a preferred embodiment of the present invention.

FIG. 26 schematically illustrates another exemplary arrangement of shower sprayers in accordance with a preferred embodiment of the present invention.

FIG. 27 schematically illustrates another exemplary arrangement of shower sprayers in accordance with a preferred embodiment of the present invention.

FIG. 28 schematically illustrates another exemplary arrangement of shower sprayers in accordance with a preferred embodiment of the present invention.

FIG. 29 schematically illustrates another exemplary arrangement of shower sprayers in accordance with a preferred embodiment of the present invention.

FIG. 30 schematically illustrates another exemplary arrangement of shower sprayers in accordance with a preferred embodiment of the present invention.

FIG. 31 schematically illustrates another exemplary arrangement of shower sprayers in accordance with a preferred embodiment of the present invention.

FIG. 32 schematically illustrates another exemplary arrangement of shower sprayers in accordance with a preferred embodiment of the present invention.

DETAILED DESCRIPTION

Figures 1, 2, 3:
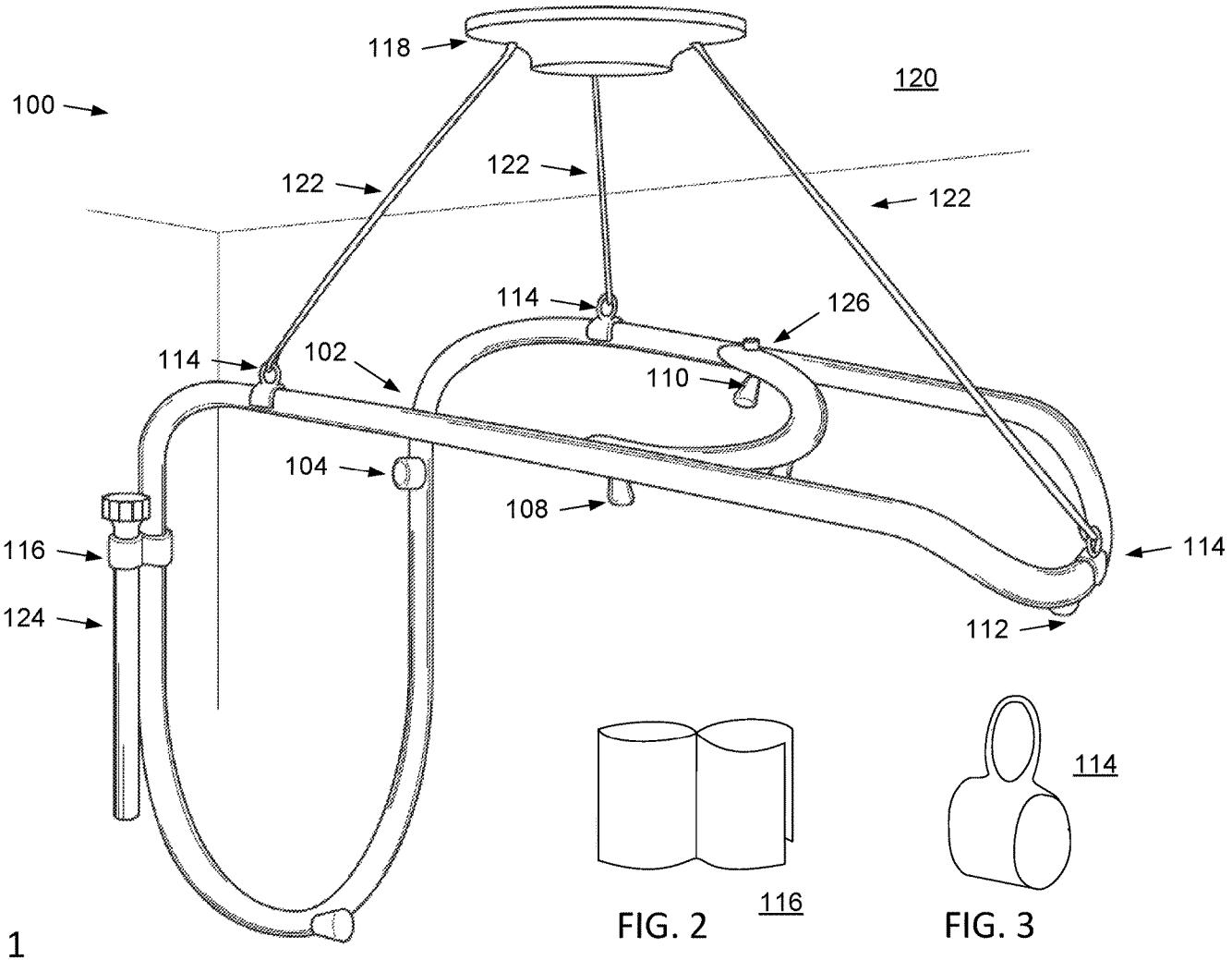
FIG. 1 is an illustration of an adjustable height suspended shower apparatus having multiple shower sprayers in accordance with a preferred embodiment of the present invention.
FIG. 2 is a schematic illustration of the spindle clamp of the shower apparatus of FIG. 1.
FIG. 3 is a schematic illustration of a tension line mounting clamp of the shower apparatus of FIG. 1.

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention, and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein-as understood by the Ordinary Artisan based on the contextual use of such term-differs in any way from any particular dictionary definition of such term, it is intended that the meaning of the term as understood by the Ordinary Artisan should prevail.

Regarding applicability of 35 U.S.C. 112, subsection (f), no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." When used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the invention are next described. The following description of one or more preferred embodiments is merely exemplary in nature and is in no way intended to limit the invention, its implementations, or uses.

Turning now to the drawings, FIG. 1 illustrates an adjustable height suspended shower apparatus 100 in accordance with a preferred embodiment of the present invention. The shower apparatus 100 comprises a framework 102 of conduits that define fluid passageways from a fluid inlet port 104 to each of a plurality of sprayers. The framework 102 preferably is made of a plastic/PVC/CPVC material, but could be manufactured from metals including brass, copper, stainless steel, and the like. The inlet port 104 is threaded for attachment of a hose for connection to plumbing for a shower head or to a diverter of a shower head. The multiple sprayers of the shower apparatus 100 include a front sprayer 106; two side sprayers 108,110; and a back sprayer 112. The front sprayer 106 represents the lowermost sprayer and is configured to act as a drain for the framework 102 of conduits when the water is turned off to the shower apparatus. When water is turned on: the front sprayer 106 is located so as to spray water onto a front of a person's body; each of the two side sprayers 108,110 is located so as to spray water onto an opposite side of a person's head and adjacent shoulder; and the back sprayer 112 is located so as to spray water onto a person's back.

The shower apparatus 100 further comprises three tension line mounting clamps 114; a spindle clamp 116; a ceiling mounting assembly 118 attached to a ceiling 120; tension lines 122 each extending from the ceiling mounting assembly 118 to a respective tension line mounting clamp 114; a spindle 124 releasably attached to the spindle clamp 116; and a control valve 126.

FIG. 2 is a schematic illustration of the spindle clamp 116 of the shower apparatus 100 of FIG. 1; and FIG. 3 is a schematic illustration of the tension line mounting clamps 114 of the shower apparatus 100 of FIG. 1. With respect to the spindle clamp 116 and the tension line mounting clamps 114, each includes a C-shaped portion for frictional fit to tubing of the framework 102 as seen in FIG. 1. Each of the tension line mounting clamps 114 also includes a loop portion for attachment of a respective one of the tensioning lines 122, as seen in FIG. 1. The spindle clamp 116 includes a cylindrical portion for receipt therethrough of the spindle 124, with a flared portion or head of the spindle 124 abutting and resting on an upper rim of the cylindrical portion of the spindle clamp 116, as seen in FIG. 1.

Figure 4:
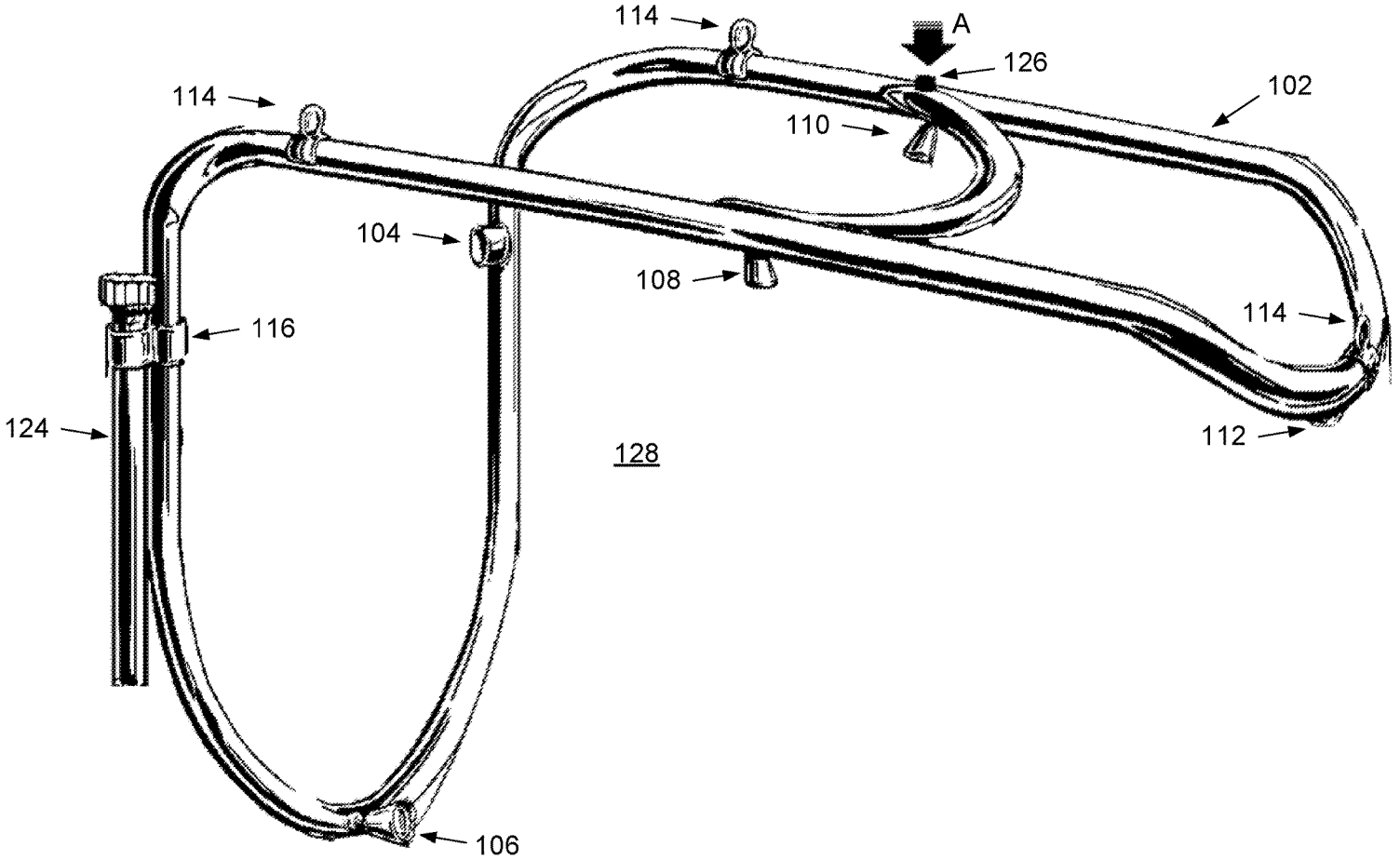
FIG. 4 is an illustration of components of the shower apparatus of FIG. 1.

FIG. 4 is an illustration of the assembly of components of the shower apparatus 100 of FIG. 1 that are suspended from the ceiling by the ceiling mounting assembly 118 and tension lines 122 as shown in FIG. 1. Such suspended assembly 128 of the shower apparatus 100 of FIG. 1 comprises the framework 102 including inlet port 104, sprayers 106,108,110,112, and control valve 126; tension line mounting clamps 114; spindle mounting clamp 116; and the spindle 124. The flow control valve 126, when in an open position, results in water flowing to shower sprayers 108, 110,112. The valve 126 is moved from the open to the closed position by pushing the on valve 126 in the direction of arrow A.

Figure 6:
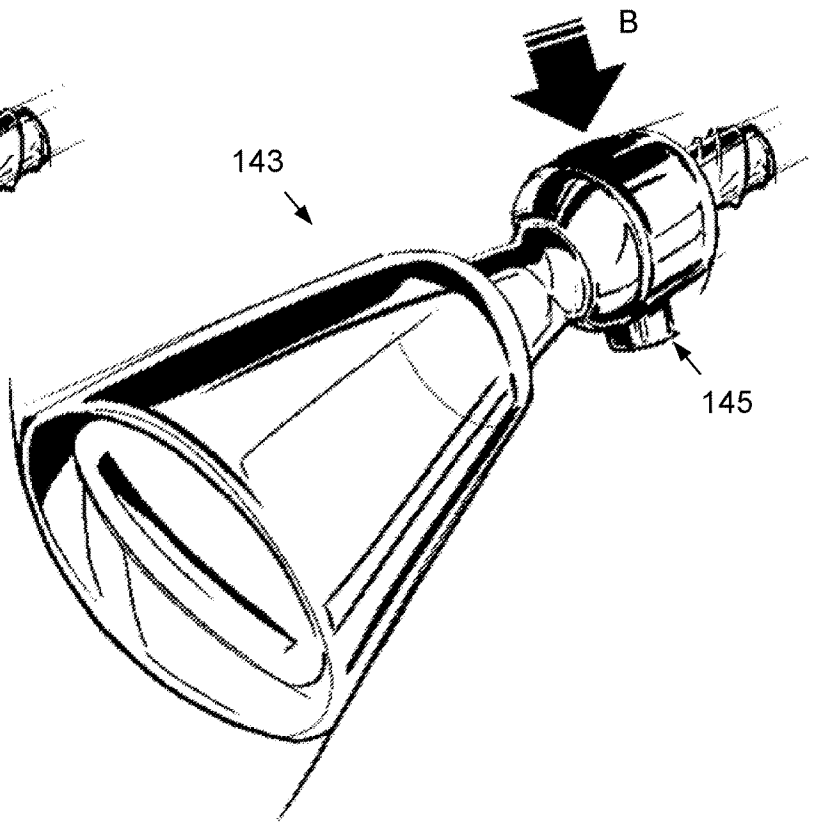
FIG. 6 is an illustration of the shower sprayer of FIG. 5, wherein the valve of the shower sprayer is in a closed position.
Figure 5:
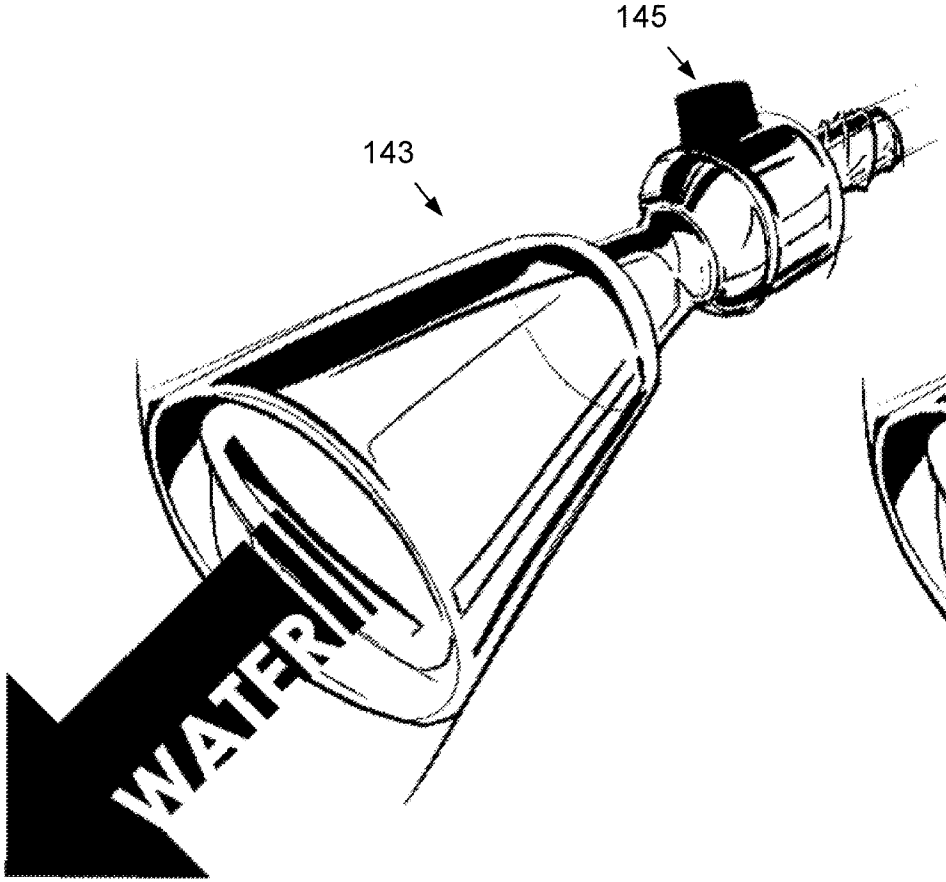
FIG. 5 is an illustration of a shower sprayer in accordance with a preferred embodiment of the present invention, wherein a valve of the shower sprayer is in an open position.

FIG. 5 is an illustration of a shower sprayer 143 in accordance with a preferred embodiment of the present invention. The shower sprayer 143 includes a flow control valve 145, which is shown in an open position in FIG. 5 resulting in water being sprayed from the shower sprayer 143. In contrast, FIG. 6 illustrates the shower sprayer 143 with the control valve 145 in a closed position resulting in no water being sprayed from the shower sprayer 143. As shown, the valve is moved from the open to the closed position by pushing on the valve in the direction of arrow B. FIGS. 5 and 6 further illustrate the swivel joint of the shower head for directing spray and the threaded conduit by which the shower head 143 is attached to a framework of a shower apparatus, all in accordance with preferred embodiments of the invention. Additionally, each sprayer preferably includes a nozzle that is adjustable on an angular basis (like a joystick); adjustable in terms of pressure control (OFF, ON, and ranges in between); adjustable in terms of the pattern of spray (like cone or flat spray patterns); and combinations thereof. The shower sprayer 143 of FIGS. 5 and 6 may be used in any embodiments of the invention, or a shower sprayer without such flow control valve 145 may be used, as seen for example in the shower apparatus 100 of FIG. 1. The sprayer 145 thus may be substituted for any or all of the sprayers 106,108,110,112.

Figure 7:
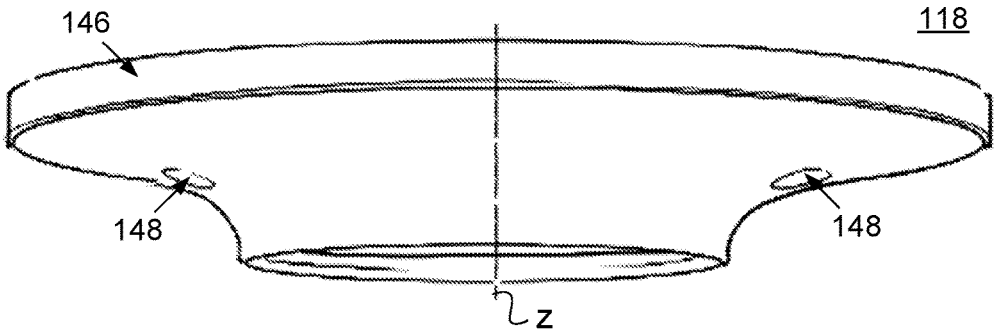
FIG. 7 schematically illustrates a side perspective view of the ceiling mounting plate of the shower apparatus of FIG. 1.
Figure 8:
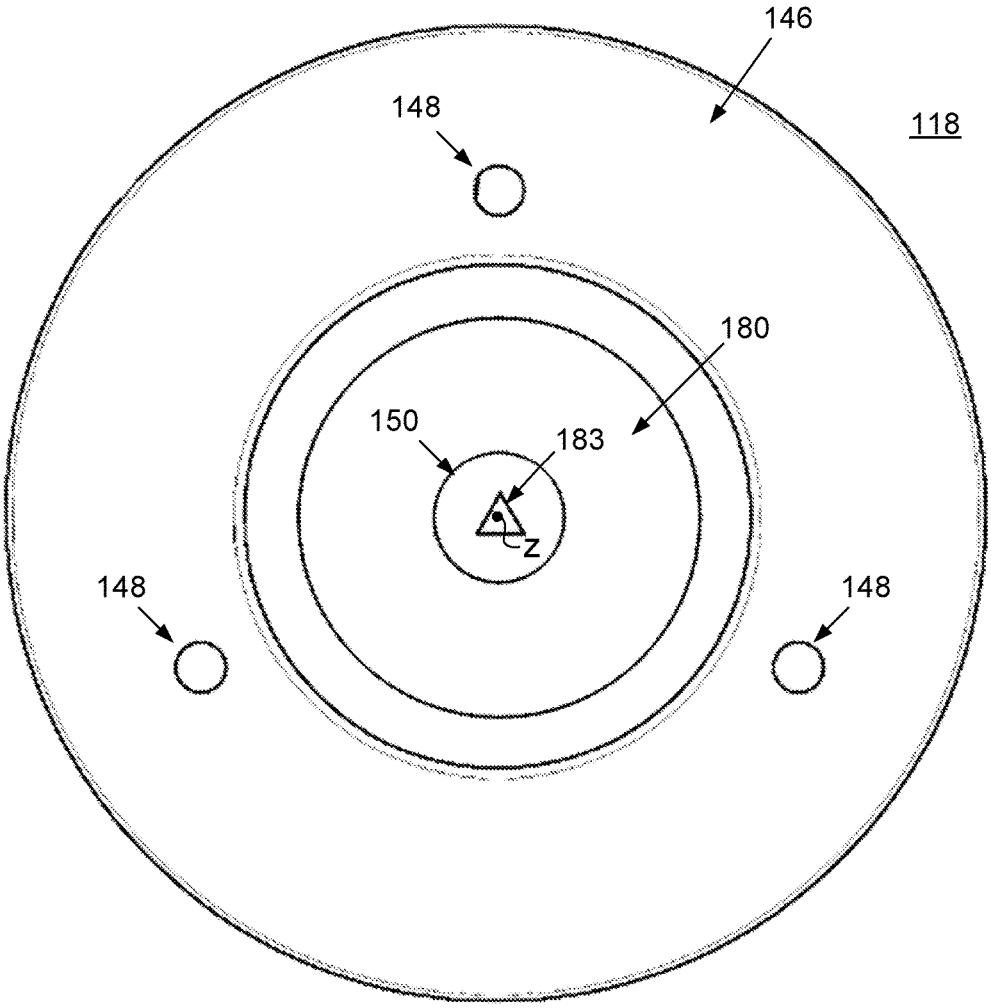
FIG. 8 schematically illustrates a bottom plan view of the ceiling mounting plate of FIG. 7.

FIG. 7 schematically illustrates a side perspective view of the ceiling mounting assembly 118 of the shower apparatus 100 of FIG. 1; and FIG. 8 schematically illustrates a bottom plan view of the ceiling mounting assembly 118. As seen in FIGS. 7 and 8, the ceiling mounting assembly 118 comprises a cover 146 having three equally spaced tension line openings 148 configured for tension lines 122 to extend therethrough. As described in greater detail below, the cover 146 further includes a bottom opening through which an end of the spindle 124 is received. The tension line openings 148 and the recessed opening 150 preferably are centered about axis z, with each tension line opening 148 being a common radial distance from the axis z.

Figure 9:
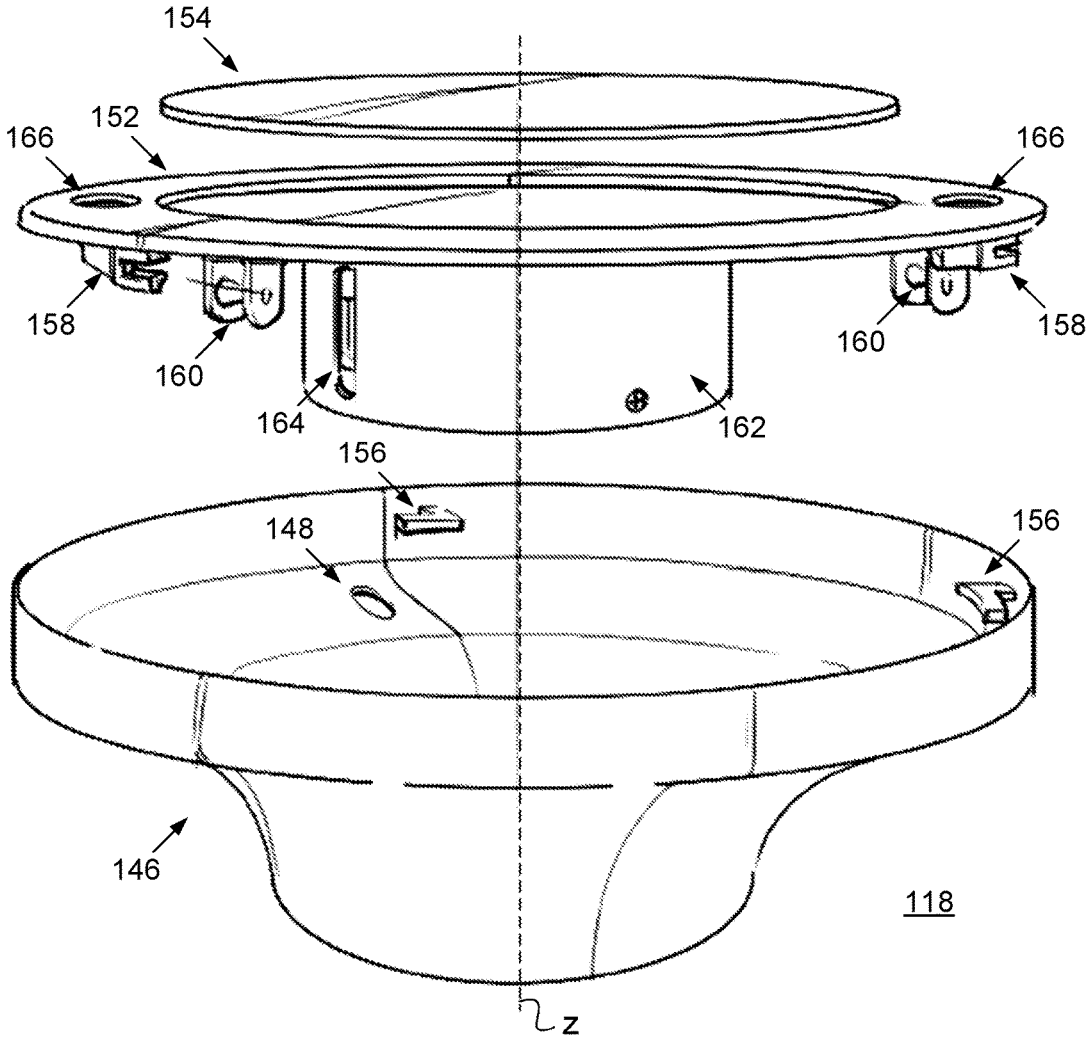
FIG. 9 schematically illustrates a partially exploded side perspective view of the ceiling mounting assembly of FIG. 7.

FIG. 9 schematically illustrates a partially exploded perspective view of the ceiling mounting assembly 118 of FIG. 7. As seen in FIG. 9, the assembly 118 comprises the cover 146; a mounting plate 152; and an adhesive tape 154 here shown in the shape of a circular panel. It will be appreciated that the adhesive tape 154 is double sided and used to securely adhere the mounting plate 152 to a ceiling. The cover 146 preferably includes three locking flanges 156, of which two are seen in FIG. 9, and the mounting plate 152 preferably includes three locking slots 158, of which two are seen in FIG. 9. It will be appreciated that when the cover 146 is placed over the mounting plate 152 and rotated, the flanges 156 are received in the slots 158, whereby the cover 146 is retained to the mounting plate 152 when the mounting plate 152 is secured to a ceiling. FIG. 9 further reveals the mounting plate 152 to have tension line guides in the form of mounted rollers 160. When the cover 146 is locked in place on the mounting plate 152, each mounted roller 160 is located proximate a tension line opening 148 such that a respective tension line 122 extending therethrough is redirected radially toward the axis z.

The mounting plate 152 further includes a motor housing 162 in which a motor is contained. The housing 162 is generally cylindrical and centered about the axis z. The housing 162 defines three slots 164, one of which is seen in FIG. 9, to which slots 164 the tensioning lines are directed by the mounted rollers 160.

The mounting plate 152 further includes openings 166 through which screws or other fasteners may extend for mounting of the plate 152 to a ceiling, either additionally or alternatively to the use of the adhesive tape 154. In this respect, it is believed and preferred that VHB double-sided tape be used to secure the ceiling mounting plate 152 to a ceiling, but mechanical fasteners can be used if desired or needed in a particular installation.

Figure 10:
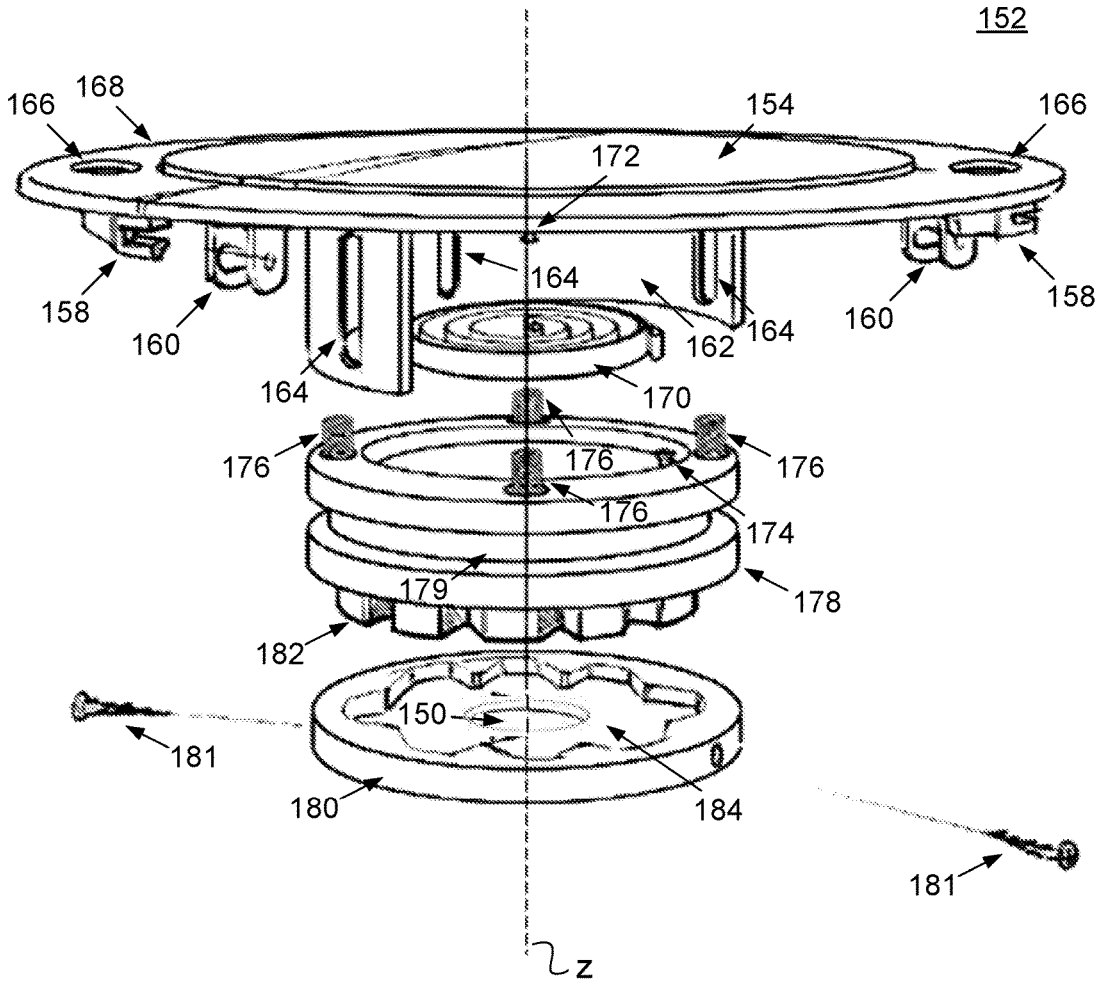
FIG. 10 schematically illustrates a partially exploded perspective view of the ceiling mounting plate of FIG. 9, wherein a portion of the wall of the motor housing thereof is omitted for clarity.

FIG. 10 schematically illustrates a partially exploded perspective view of the mounting plate 152 of FIG. 9, wherein a portion of the wall of the cylindrical motor housing 162 is omitted for clarity. As seen in FIG. 10, the mounting plate 152 comprises a base 168, the housing 162 that is preferably integrally formed with the base 168 in a molding process; a coil spring 170 that is located within the housing 162; a first locking pin 172 that retains a first end of the coil spring 170 and that is generally axially located with respect to the z axis; a second locking pin 174 that retains a second end of the coil spring 170; four compression springs 176; a spool 178; and a locking gear base 180.

The spool 178 receives the tensioning lines 122 within a circumferential recess 179 thereof and is used to spool and unspool the tensioning lines 122 upon clockwise and counterclockwise rotation of the spool 178 about the axis z. The surface of the recess 179 against which the tensioning lines 122 are wound preferably comprises a non-stick surface.

The spool 178 further defines four recesses along a top rim thereof that are equally spaced, within which a bottom portion of the four compression springs 176 are received. When assembled, the other end of each compression spring abuts the base 168 of the mounting plate 152 and serves to bias the spool 178 into abutment with the locking gear base 180. The locking gear base 180 is secured in fixed position to the housing 162 by three screws 181, two of which are shown in FIG. 10. The bottom of the spool 178 defines a gear-shaped downward protuberance 182 that is received within a recess 184 of the locking gear base 180, which recess is configured to correspond to and mate in abutment with the gear-shaped downward protuberance 182, whereby rotation of the spool 178 about the axis z is prevented. This results in locking of the spool 178 from such rotational movement.

The spool 178 is upwardly displaceable along the axis z within the housing 162 toward the base 168 by application of an upward force through an access opening 150 in the locking gear base 180, which upward force serves to further compress the compression springs 176. The upward force is easily provided by a person by extending the spindle 124 through the access opening 150 into engagement with the bottom of the spool 178 and pushing upward against the force of the compression springs 176.

The gear-shaped protuberance 182 preferably defines a geometric recess 183 (perhaps best seen in FIG. 8) which recess 183 is configured to correspond to and mate in abutment with a geometric protuberance on a top of the spindle 124. This mating abutment preferably enables rotation about the axis z of the spindle 124 to result in similar rotation of the spool 178 about the axis z when the spool 178 is axially displaced out of the recess 184 of the locking gear base 180.

Further in this respect, it will be appreciated that the coil spring 170 is used to offset the weight of the suspended components of the shower apparatus 100, whereby less effort is required by a person in rotating the spindle 124 so as to raise the suspended components. In this respect, the coil spring preferably is tensioned when the ceiling mounting assembly 118 is assembled so as to tend to bias rotation of the spool in the direction for spooling of the tensioning lines.

Figure 11:
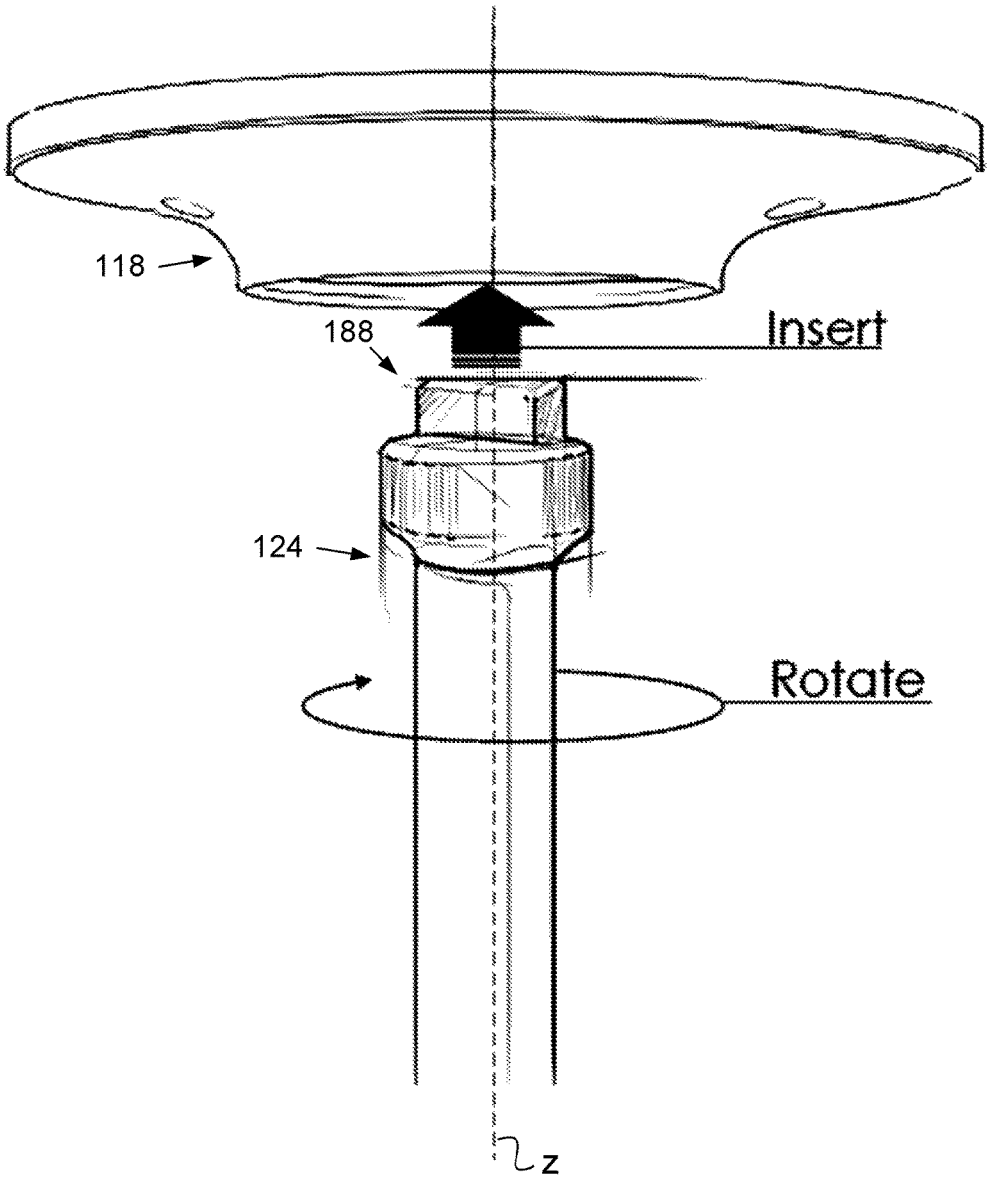
FIG. 11 schematically illustrates a manner of adjusting a height of a shower apparatus in accordance with a preferred embodiment of the present invention.

FIG. 11 schematically illustrates adjusting a height of the shower apparatus 100 in accordance with a preferred embodiment of the present invention by inserting and rotating the spindle 124.

Figure 12:
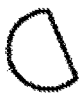
FIG. 12 schematically illustrates an exemplary shape of a geometric protuberance for use with a spindle in adjusting a suspended shower apparatus in accordance with a preferred embodiment of the present invention.
Figure 13:
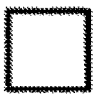
FIG. 13 schematically illustrates another exemplary shape of a geometric protuberance for use with a spindle in adjusting a suspended shower apparatus in accordance with a preferred embodiment of the present invention.
Figure 14:
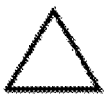
FIG. 14 schematically illustrates another exemplary shape of a geometric protuberance for use with a spindle in adjusting a suspended shower apparatus in accordance with a preferred embodiment of the present invention.
Figure 15:
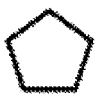
FIG. 15 schematically illustrates another exemplary shape of a geometric protuberance for use with a spindle in adjusting a suspended shower apparatus in accordance with a preferred embodiment of the present invention.
Figure 16:
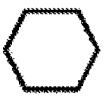
FIG. 16 schematically illustrates another exemplary shape of a geometric protuberance for use with a spindle in adjusting a suspended shower apparatus in accordance with a preferred embodiment of the present invention.

Different possible geometric protuberances for use with a spindle are illustrated in FIGS. 12-16. The geometric protuberance 188 of arm 124 is triangular, which is represented in FIG. 14. In accordance with one or more preferred implementations, the geometric shape preferably is that of a regular polygon, i.e., a polygon that is equiangular (all angles are equal in measure) and equilateral (all sides are equal in length), although in one or more preferred implementations, other shapes are possible, as illustrated in FIG. 12. In contrast to these, a singular circular shape likely would be neither desirable nor effective in imparting rotational movement to the spool by rotation of the arm.

Additionally, it will further be appreciated that an arrangement, pattern, or matrix of shapes is possible, including a plurality of circular shapes. In this regard, any structural configuration of the spindle and a corresponding structural configuration of the spool is contemplated to be within the scope of the invention so long as the engagement therebetween enables the transmission of a drive torque to the spool by rotating the spindle. Such an alternative to the illustrated geometric shapes includes, for example, two prongs that are received in close abutment (close fit) with two-receiving recesses of a corresponding configuration such that the spindle and spool coapt and transmission of a drive torque to the spool is generated by rotation of the spindle.

Figure 18:
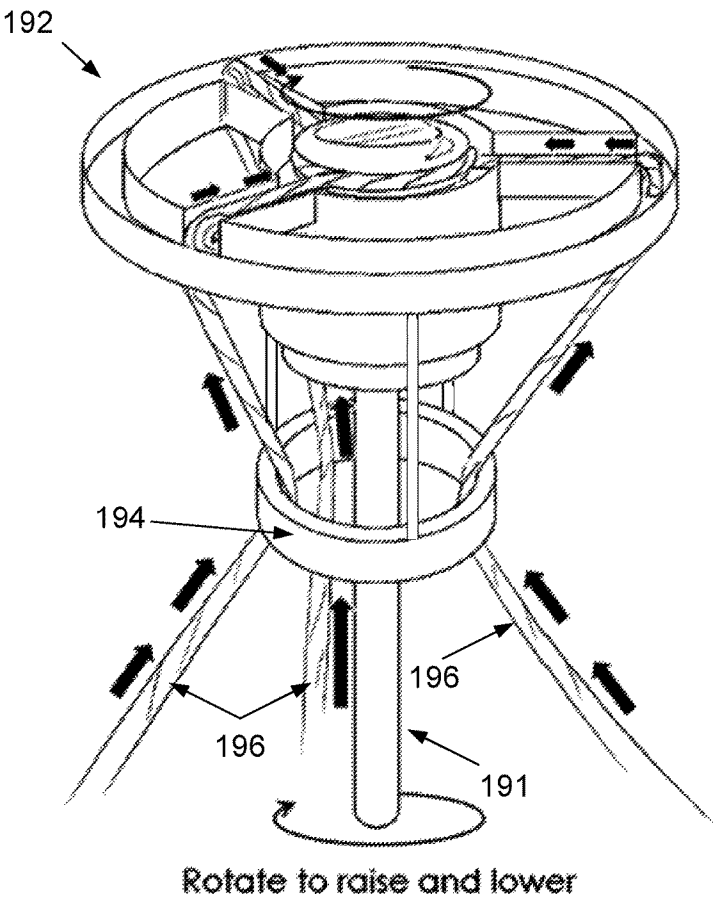
FIG. 18, taken in combination with FIG. 17, schematically illustrate an exemplary shape of a non-polygonal geometric protuberance of an arm for use in raising a shower apparatus, in accordance with another preferred embodiment of the present invention.
Figure 17:
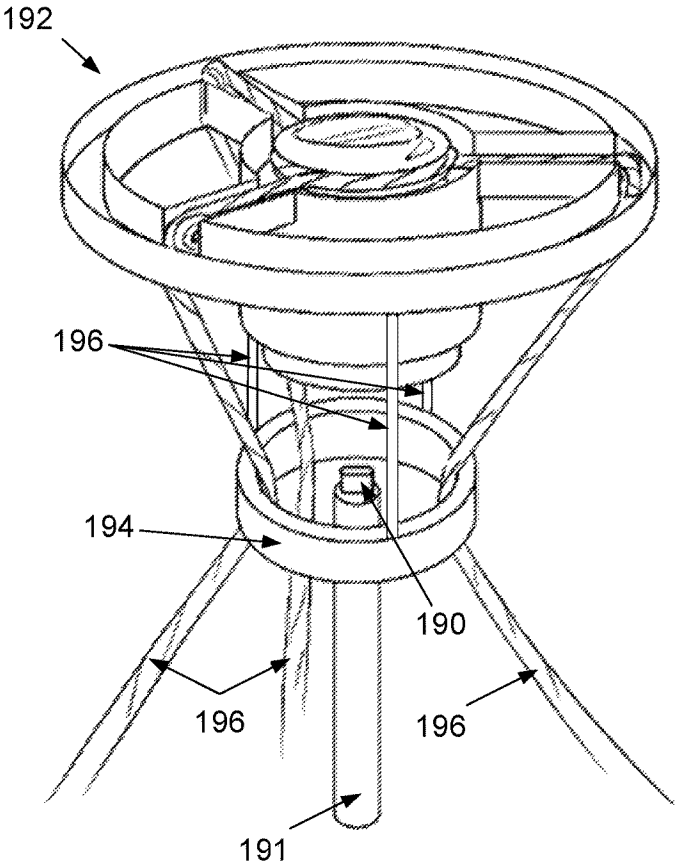
FIG. 17, taken in combination with FIG. 18, schematically illustrate an exemplary shape of a non-polygonal geometric protuberance of an arm for use in raising a shower apparatus, in accordance with another preferred embodiment of the present invention.

FIG. 17, taken in combination with FIG. 18, schematically illustrate an exemplary shape of a non-polygonal geometric protuberance 190 of an arm 191 for use in raising a shower apparatus, in accordance with another preferred embodiment of the present invention. In this respect, a generally elongate rectangle with rounded ends is used as the geometric protuberance 190 of the arm 191. Rotation in the angular direction of the arrow in FIG. 18 results in spooling of the tensioning lines and raising of the suspended components of the shower apparatus.

FIGS. 17 and 18 further illustrate a preferred embodiment of a shower apparatus of the invention including a different ceiling mounting assembly 192. One notable feature includes a consolidation ring 194, which is mounted by brackets 194 below the ceiling mounting assembly 192 and through which the tensioning lines 196 are guided.

Being suspended from the ceiling mounting assembly and adjustable in height, the framework and attached sprayers preferably are not mounted to or otherwise supported by a vertical wall. Moreover, the connection to the shower faucet preferably is by a hose having as sufficient length such that the hose does not impede a normal range of vertical adjustment of the height at which the framework and attached sprayers are suspended.

Figure 19:
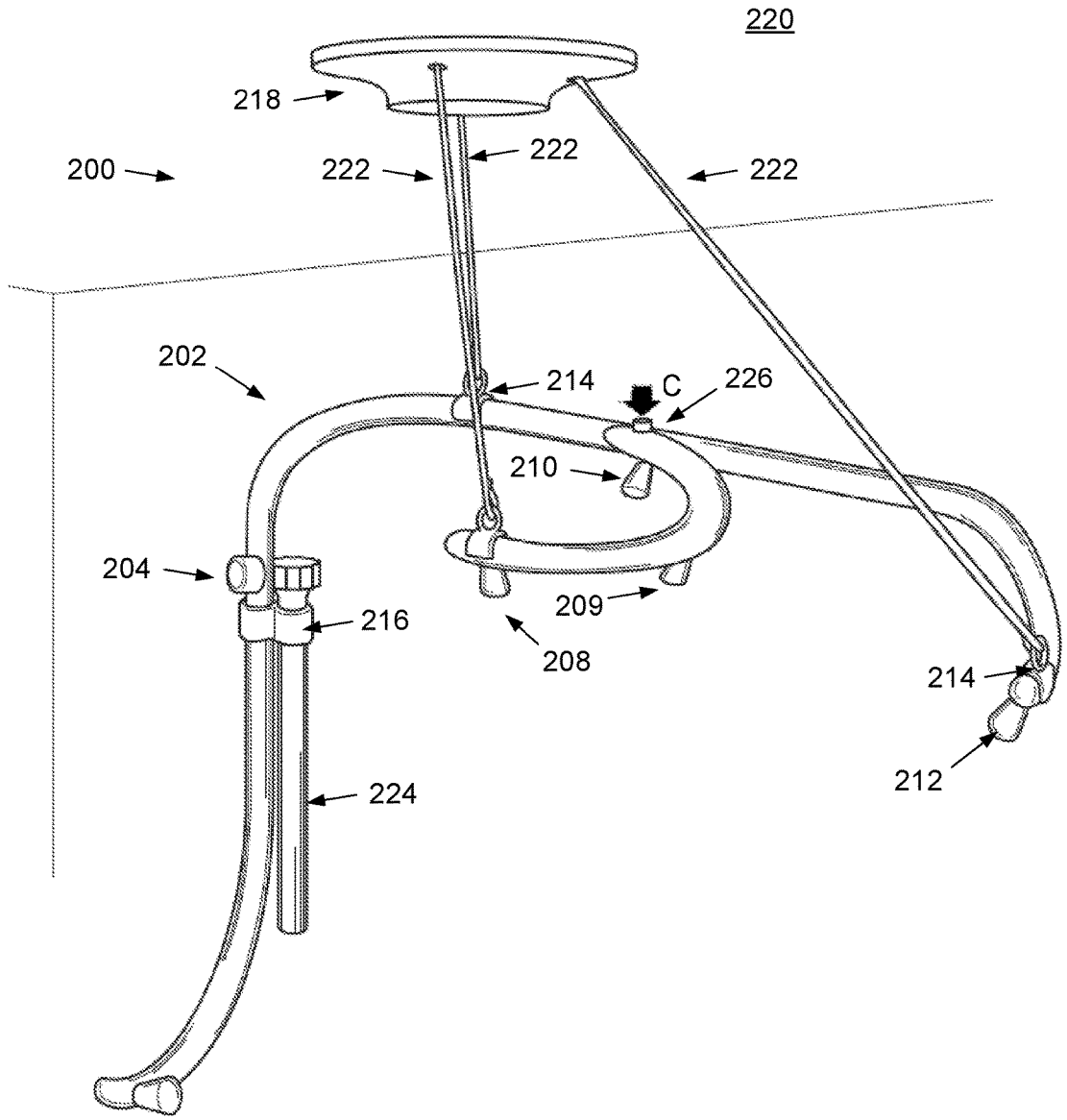
FIG. 19 is an illustration of another adjustable height suspended shower apparatus having multiple shower sprayers in accordance with a preferred embodiment of the present invention.

FIG. 19 is an illustration of another adjustable height suspended shower apparatus 200 having multiple shower sprayers in accordance with a preferred embodiment of the present invention. The adjustable height suspended shower apparatus 200 comprises a framework 202 of conduits that define fluid passageways from a fluid inlet port 204 to each of a plurality of sprayers. The inlet port 204 is threaded for attachment of a hose for connection to plumbing for a shower head or to a diverter of a shower head. The multiple sprayers of the shower apparatus 200 include a front sprayer 206; two side sprayers 208,210; a top sprayer 209; and a back sprayer 212. The front sprayer 206 represents the lowermost sprayer and is configured to act as a drain for the framework 202 when the water is turned off to the shower apparatus 200. When water is turned on: the front sprayer 206 is located so as to spray water onto a front of a person's body; each of the two side sprayers 208,210 is located so as to spray water onto an opposite side of a person's head and adjacent shoulder; the top sprayer 209 is located so as to spray water onto the top of a person's head; and the back sprayer 212 is located so as to spray water onto a person's back.

The shower apparatus 200 further comprises three tension line mounting clamps 214; a spindle clamp 216; a ceiling mounting assembly 218 attached to a ceiling 220; tension lines 222 each extending from the ceiling mounting assembly 218 to a respective tension line mounting clamp 214; a spindle 224 releasably attached to the spindle clamp 216; and a control valve 226.

With respect to the spindle clamp 216 and the tension line mounting clamps 214, each includes a C-shaped portion for frictional fit to tubing of the framework 202 as seen in FIG. 19. Each of the tension line mounting clamps 214 also includes a loop portion for attachment of a respective one of the tensioning lines 222, as seen in FIG. 19. The spindle clamp 116 includes a cylindrical portion for receipt therethrough of the spindle 224, with the head of the spindle 224 abutting and resting on an upper rim of the cylindrical portion of clamp 216, as seen in FIG. 19.

The flow control valve 226, when in an open position, results in water flowing to shower sprayers 208,209,210, 212. The valve 126 is moved from the open to the closed position by pushing the on valve in the direction of arrow C.

The ceiling mounting assembly 218 is similar in structure and function to ceiling mounting assembly 118, described in detail herein. Accordingly, with reference hereby to the above description, such description is not repeated here in the interests of brevity.

Figure 20:
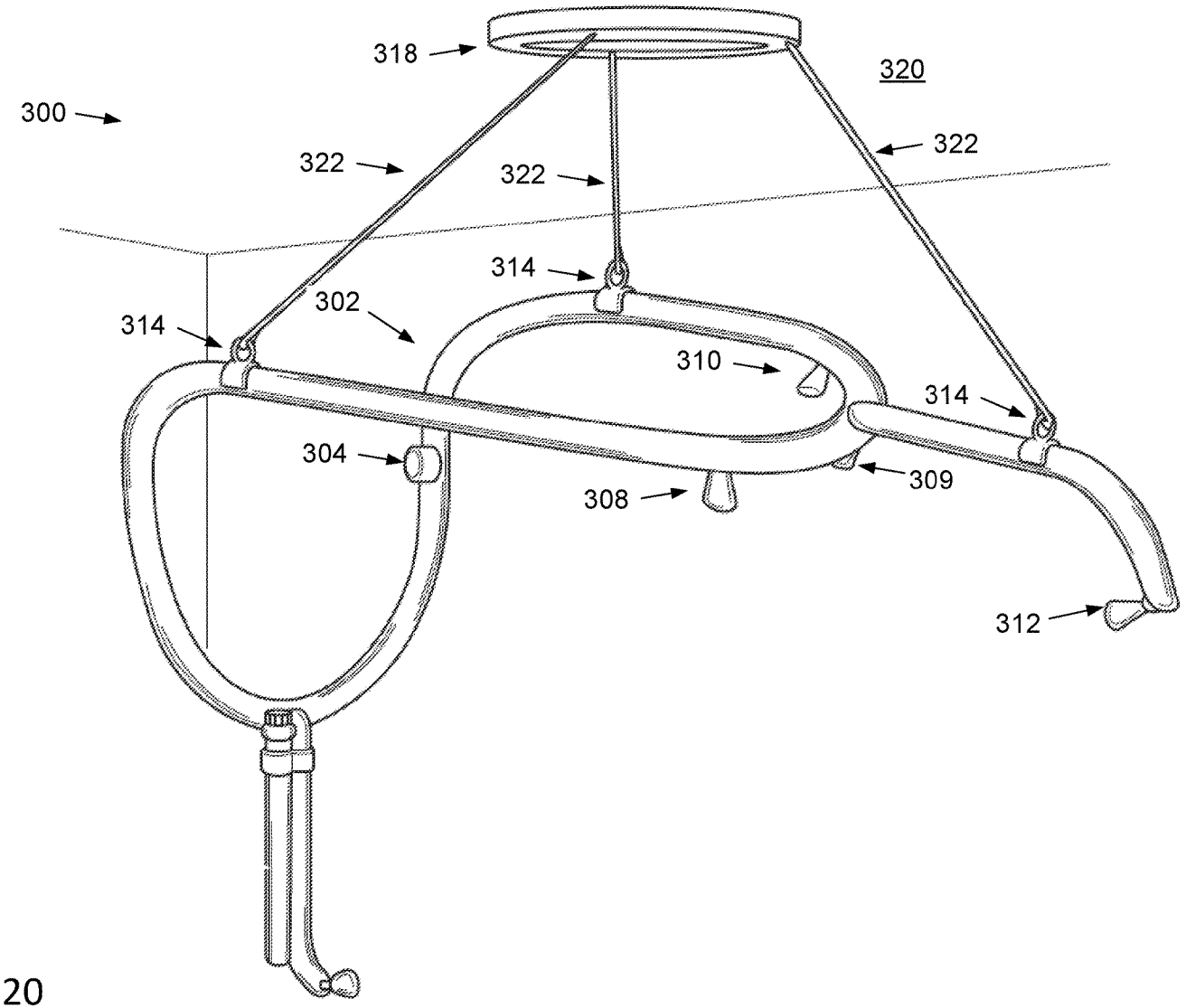
FIG. 20 is an illustration of another adjustable height suspended shower apparatus having multiple shower sprayers in accordance with a preferred embodiment of the present invention.

FIG. 20 is an illustration of another adjustable height suspended shower apparatus 300 having multiple shower sprayers in accordance with a preferred embodiment of the present invention. Furthermore, FIG. 21 is an illustration of components of the shower apparatus 300 of FIG. 20.

The adjustable height suspended shower apparatus 300 comprises a framework 302 of conduits that define fluid passageways from a fluid inlet port 304 to each of a plurality of sprayers. The inlet port 304 is threaded for attachment of a hose for connection to plumbing for a shower head or to a diverter of a shower head. The multiple sprayers of the shower apparatus 300 include a front sprayer 306; two side sprayers 308,310; a top sprayer 309; and a back sprayer 312. The front sprayer 306 represents the lowermost sprayer and is configured to act as a drain for the framework 302 when the water is turned off to the shower apparatus 300. When water is turned on: the front sprayer 306 is positioned so as to spray water onto a front of a person's body; each of the two side sprayers 308,310 is located so as to spray water onto an opposite side of a person's head and adjacent shoulder; the top sprayer 309 is located so as to spray water onto the top of a person's head; and the back sprayer 312 is located so as to spray water onto a person's back.

The shower apparatus 300 further comprises three tension line mounting clamps 314; a spindle clamp 316; a ceiling mounting assembly 318 attached to a ceiling 320; tension lines 322 each extending from the ceiling mounting assembly 318 to a respective tension line mounting clamp 314; and a spindle 324 releasably attached to the spindle clamp 316.

Figure 21:
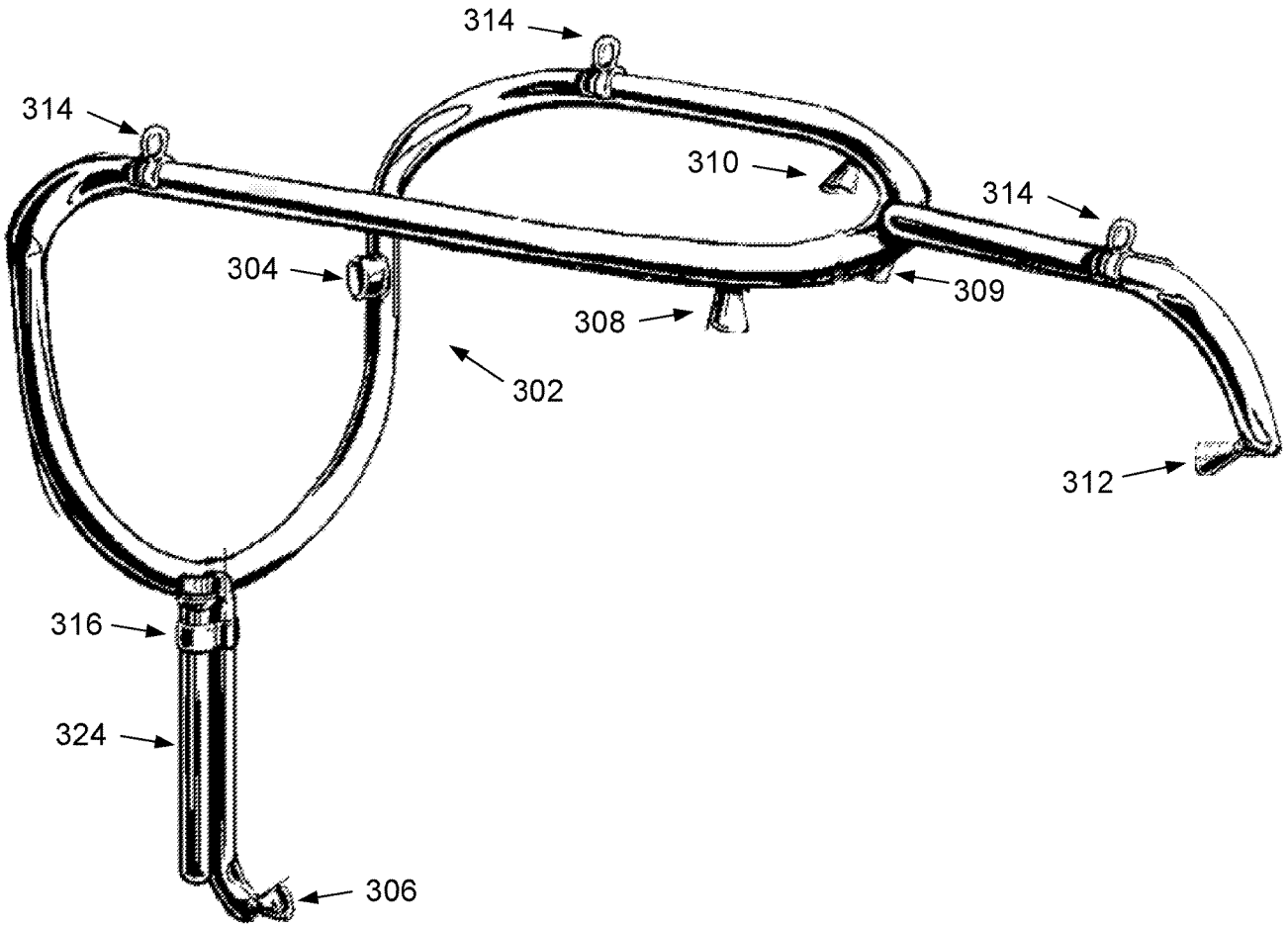
FIG. 21 is an illustration of components of the shower apparatus of FIG. 20.

With respect to the spindle clamp 316 and the tension line mounting clamps 314, each includes a C-shaped portion for frictional fit to tubing of the framework 302 as seen in FIGS. 20 and 21. Each of the tension line mounting clamps 314 also includes a loop portion for attachment of a respective one of the tensioning lines 322, as seen in FIG. 20. The spindle clamp 216 includes a cylindrical portion for receipt therethrough of the spindle 324, with the head of the spindle 324 abutting and resting on an upper rim of the cylindrical portion of clamp 316, also as seen in FIGS. 20 and 21.

Figure 22:
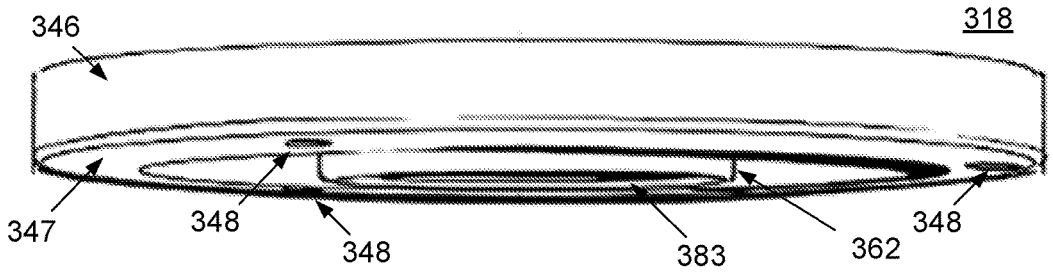
FIG. 22 schematically illustrates a side perspective view of the ceiling mounting assembly of the shower apparatus of FIG. 21.
Figure 23:
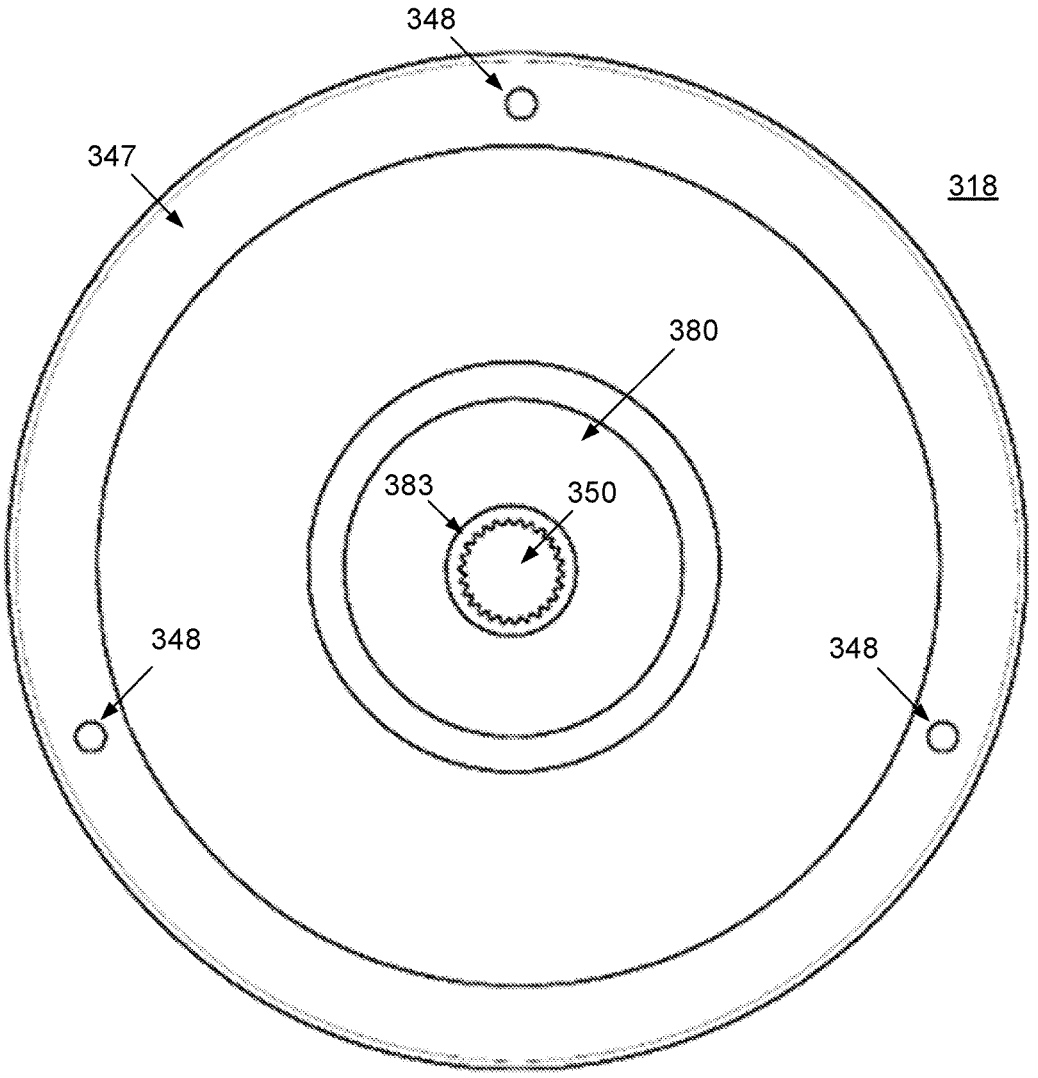
FIG. 23 schematically illustrates a bottom plan view of the ceiling mounting assembly of FIG. 22.
Figure 33:
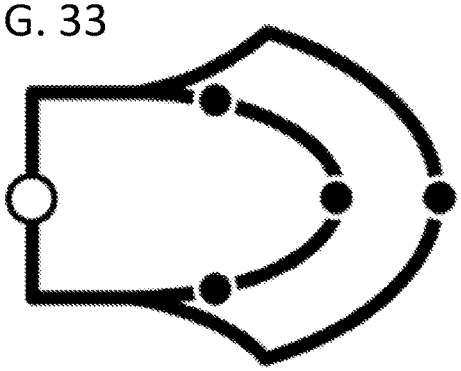
FIG. 33 schematically illustrates another exemplary arrangement of shower sprayers in accordance with a preferred embodiment of the present invention.
Figure 34:
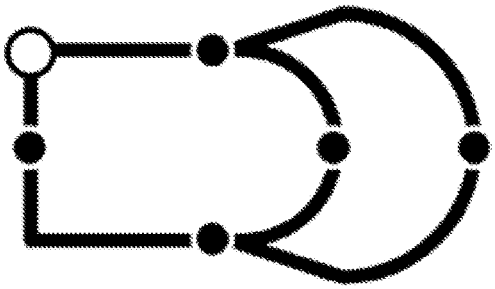
FIG. 34 schematically illustrates another exemplary arrangement of shower sprayers in accordance with a preferred embodiment of the present invention.
Figure 35:
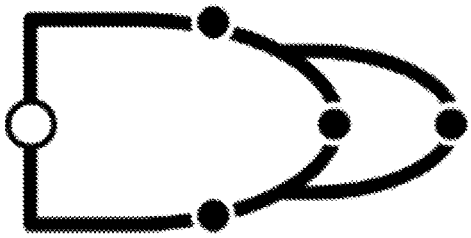
FIG. 35 schematically illustrates another exemplary arrangement of shower sprayers in accordance with a preferred embodiment of the present invention.
Figure 36:
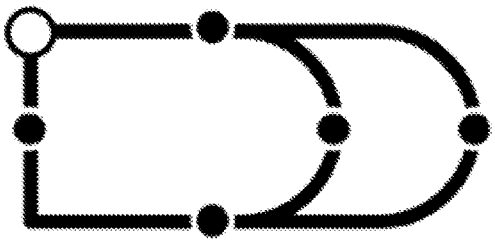
FIG. 36 schematically illustrates another exemplary arrangement of shower sprayers in accordance with a preferred embodiment of the present invention.
Figure 37:
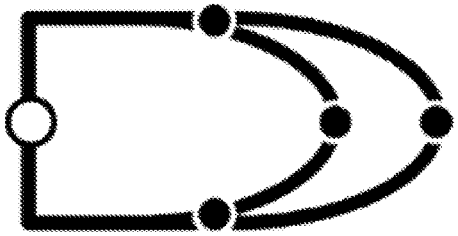
FIG. 37 schematically illustrates another exemplary arrangement of shower sprayers in accordance with a preferred embodiment of the present invention.
Figure 38:
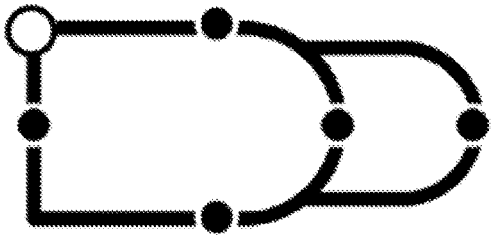
FIG. 38 schematically illustrates another exemplary arrangement of shower sprayers in accordance with a preferred embodiment of the present invention.
Figure 39:
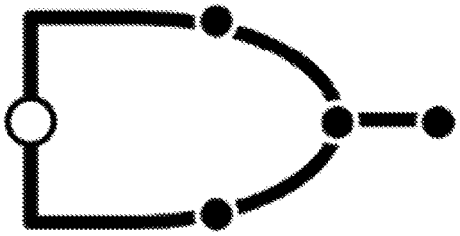
FIG. 39 schematically illustrates another exemplary arrangement of shower sprayers in accordance with a preferred embodiment of the present invention.
Figure 40:
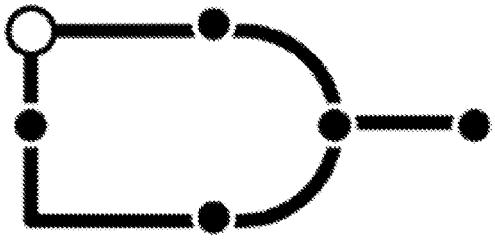
FIG. 40 schematically illustrates another exemplary arrangement of shower sprayers in accordance with a preferred embodiment of the present invention.
Figure 41:
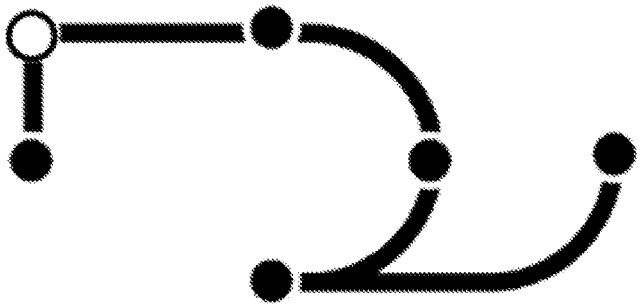
FIG. 41 schematically illustrates another exemplary arrangement of shower sprayers in accordance with a preferred embodiment of the present invention.
Figure 42:
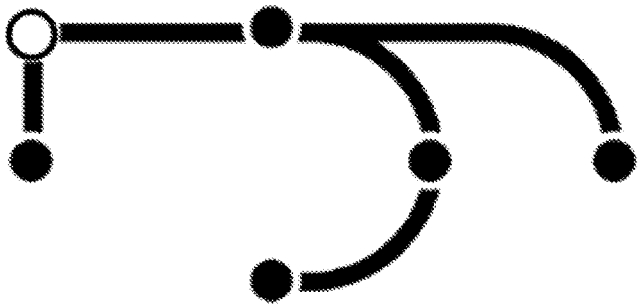
FIG. 42 schematically illustrates another exemplary arrangement of shower sprayers in accordance with a preferred embodiment of the present invention.
Figure 43:
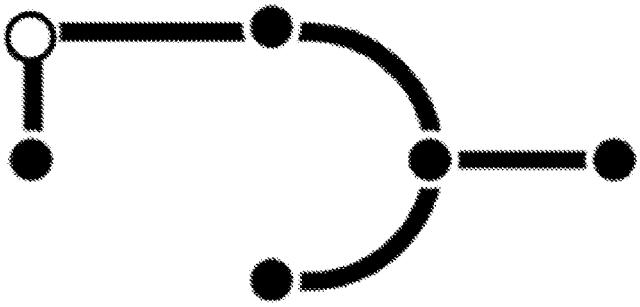
FIG. 43 schematically illustrates another exemplary arrangement of shower sprayers in accordance with a preferred embodiment of the present invention.
Figure 44:
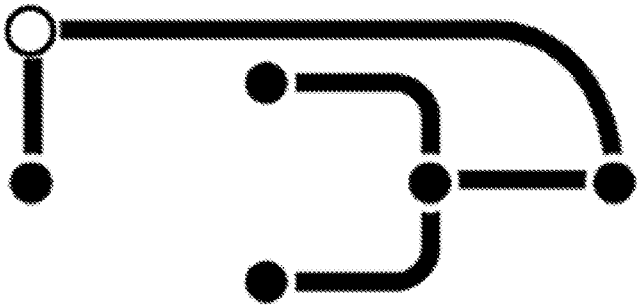
FIG. 44 schematically illustrates another exemplary arrangement of shower sprayers in accordance with a preferred embodiment of the present invention.

The ceiling mounting assembly 318 differs from the aforementioned ceiling assemblies 118 and 218 in structure at least insofar as the ceiling mounting assembly 318 includes a low profile with downwardly facing planar faces. FIG. 22 schematically illustrates a side perspective view of the ceiling mounting assembly 318 of the shower apparatus 300 of FIG. 21; and FIG. 23 schematically illustrates a bottom plan view of the ceiling mounting assembly 318 of the shower apparatus 300 of FIG. 22. As seen in FIGS. 22 and 23, the ceiling mounting assembly 318 comprises a cover 346 defining an outer rim 347 in which three equally spaced tension line openings 348 are defined that are configured for tension lines 322 to extend therethrough. Each tension line opening 348 is spaced a common radial distance from and centered about a center axis. The locking gear base 380 further includes a bottom opening 383 configured to receive therethrough an end of the spindle 324 for engagement of the geometric protuberance of the arm 324 with a corresponding recess 350 in the bottom of the spool.

While three exemplary arrangements of multiple shower sprayers have been disclosed with reference to FIGS. 1-23, there are a multitude of different possible sprayer arrangements. For example, FIGS. 24-44 illustrate twenty-one (21) different sprayer arrangements, any of which could be used in an embodiment of a shower apparatus in accordance with the present invention. In arrangements such as those of FIGS. 24-33, 35, 37, and 39 the shower faucet connection (as represented by the open circle) is centrally located, and in others, such as those of FIGS. 34, 36, 38, and 40-44, the shower faucet connection location is located to a lateral side of the arrangement.

Figure 45:
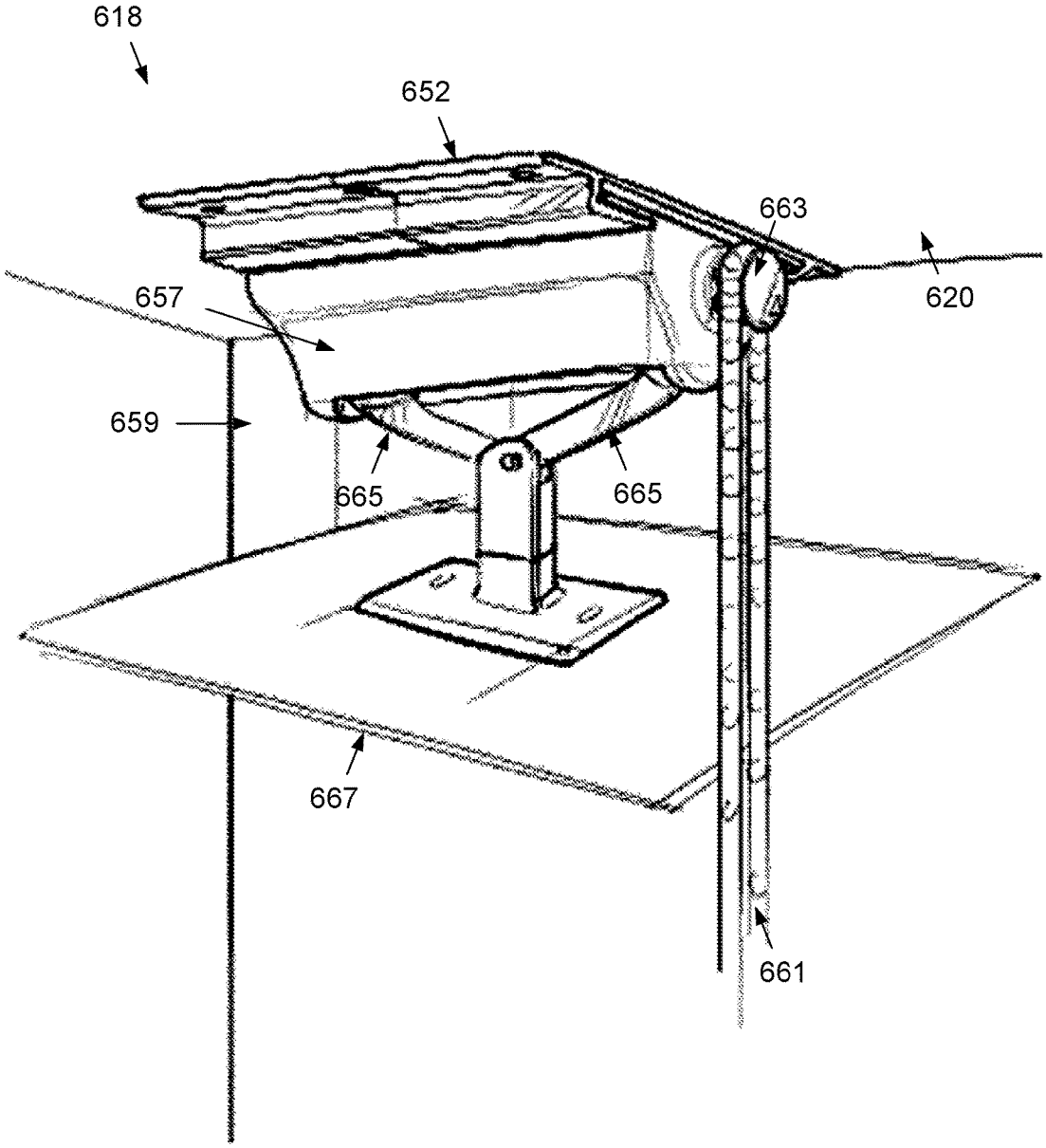
FIG. 45 is a perspective view of an alternative ceiling mounting assembly in accordance with another embodiment of the invention.
Figure 46:
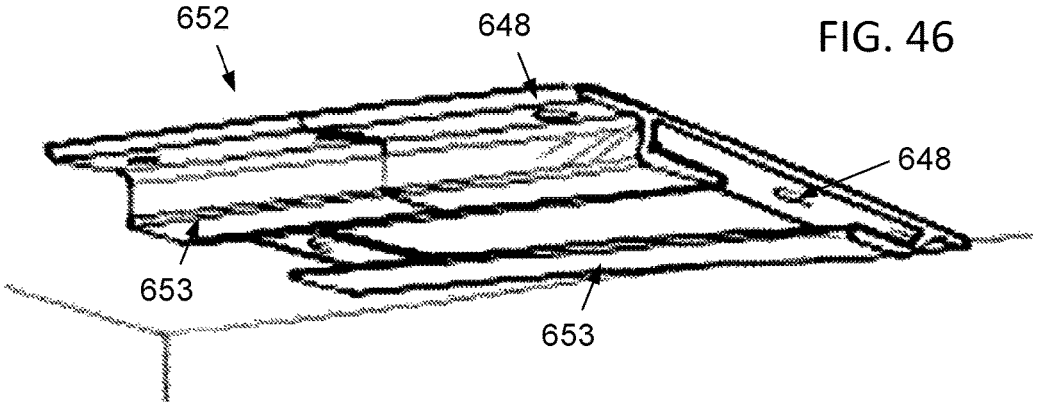
FIG. 46 is a perspective view of a ceiling mounting plate of the ceiling mounting assembly of FIG. 46, wherein the mounting plate is attached to the surface of a ceiling by fasteners.
Figure 47:
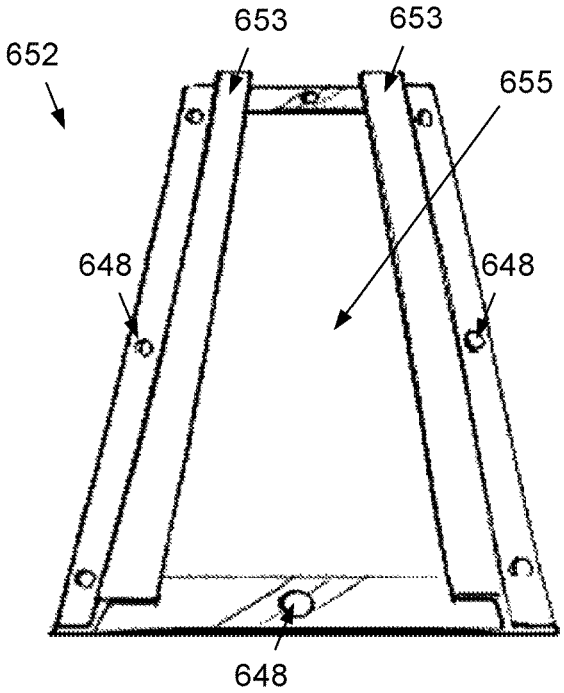
FIG. 47 is another perspective view of the ceiling mounting plate of the ceiling mounting assembly of FIG. 46.
Figure 49:
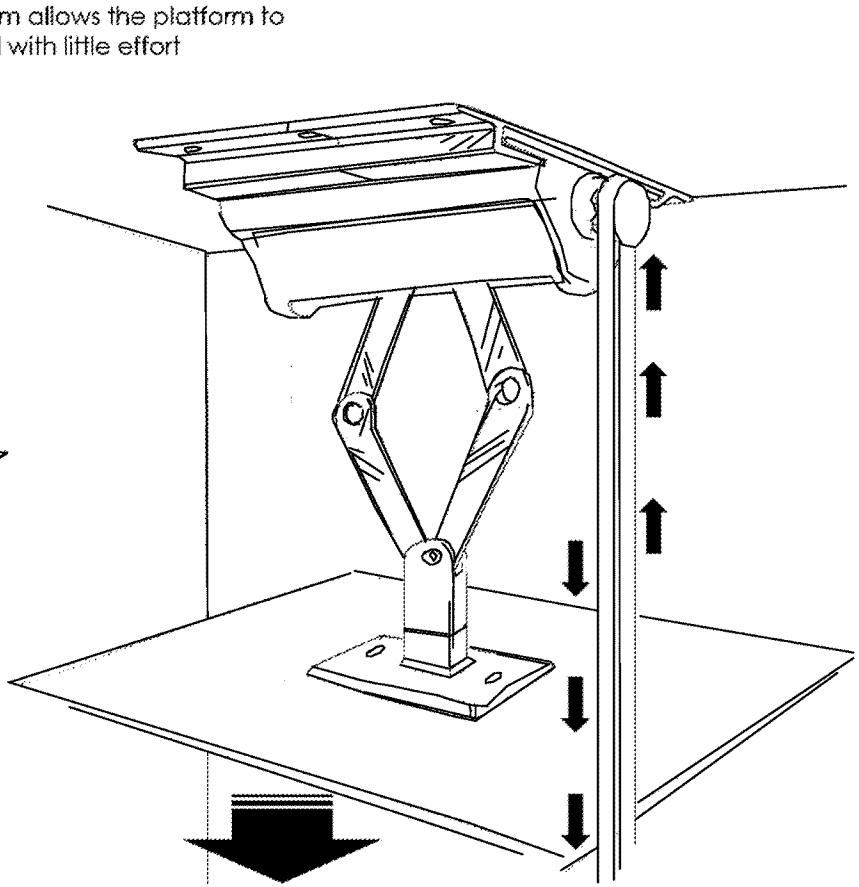
FIG. 49 illustrates decreasing a height of the ceiling mounting assembly of FIG. 45.
Figure 48:
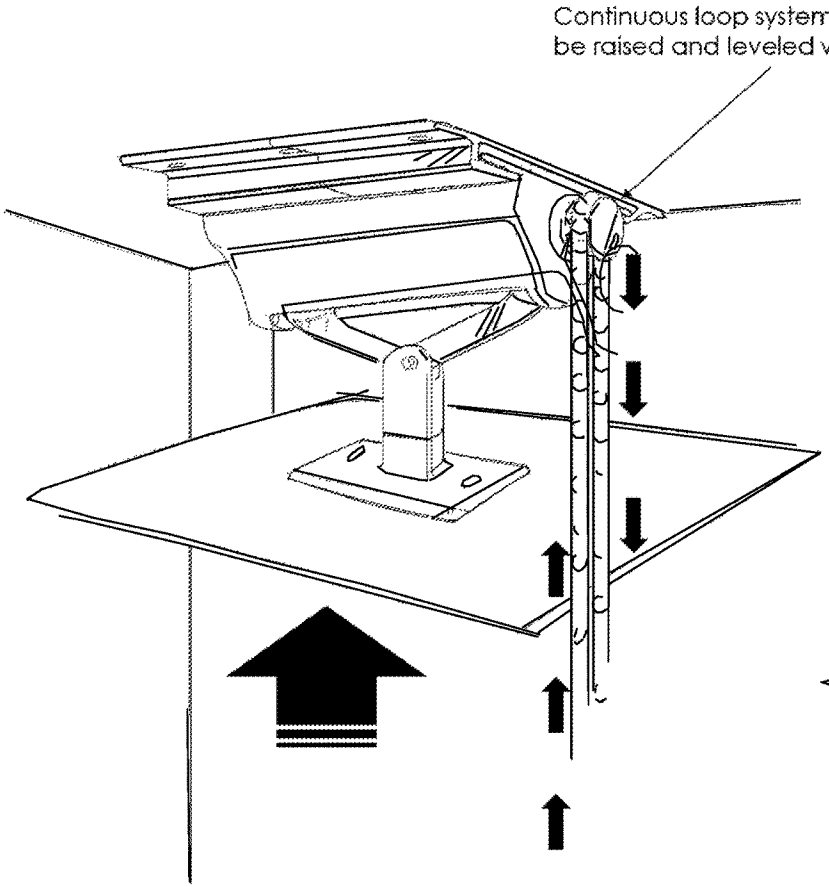
FIG. 48 illustrates increasing a height of the ceiling mounting assembly of FIG. 45.

An alternative ceiling mounting assembly 618 in accordance with another embodiment of the invention is schematically illustrated in perspective view in FIG. 45. Furthermore, FIGS. 46 and 47 each comprises a schematic perspective view of a ceiling mounting plate 652 of the ceiling mounting assembly 618. The mounting plate 652 is attached to the surface of a ceiling 620 by fasteners that extend through openings 648 in the mounting plate 652. The mounting plate 652 includes flanges 653 defining a channel 655 within which a housing 657 of a hoist—or lifting and lowering mechanism 659—is received. The lifting and lowering mechanism 659 is manually driven by an endless loop 661 comprising a chain, belt, chord, or the like, which rotates an axle 663 of the lifting and lowering mechanism 659. Rotation of the axle 663 in turn moves pivotable arms 665 of a linkage either closer together or further apart, depending on the rotational direction of the axle 663, for raising or lowering of a platform 667. Indeed, FIG. 48 illustrates such act of increasing a height of the platform 667, and FIG. 49 illustrates such act of decreasing a height of the platform 667. Moreover, it will further be appreciated that a framework of fluid conduits and arrangement of sprayers (not shown) are attached to the platform 667. It further will be appreciated that installation of a shower apparatus with the ceiling mounting assembly 618 could be used with either a bathtub arrangement or a shower stall.

Figure 50:
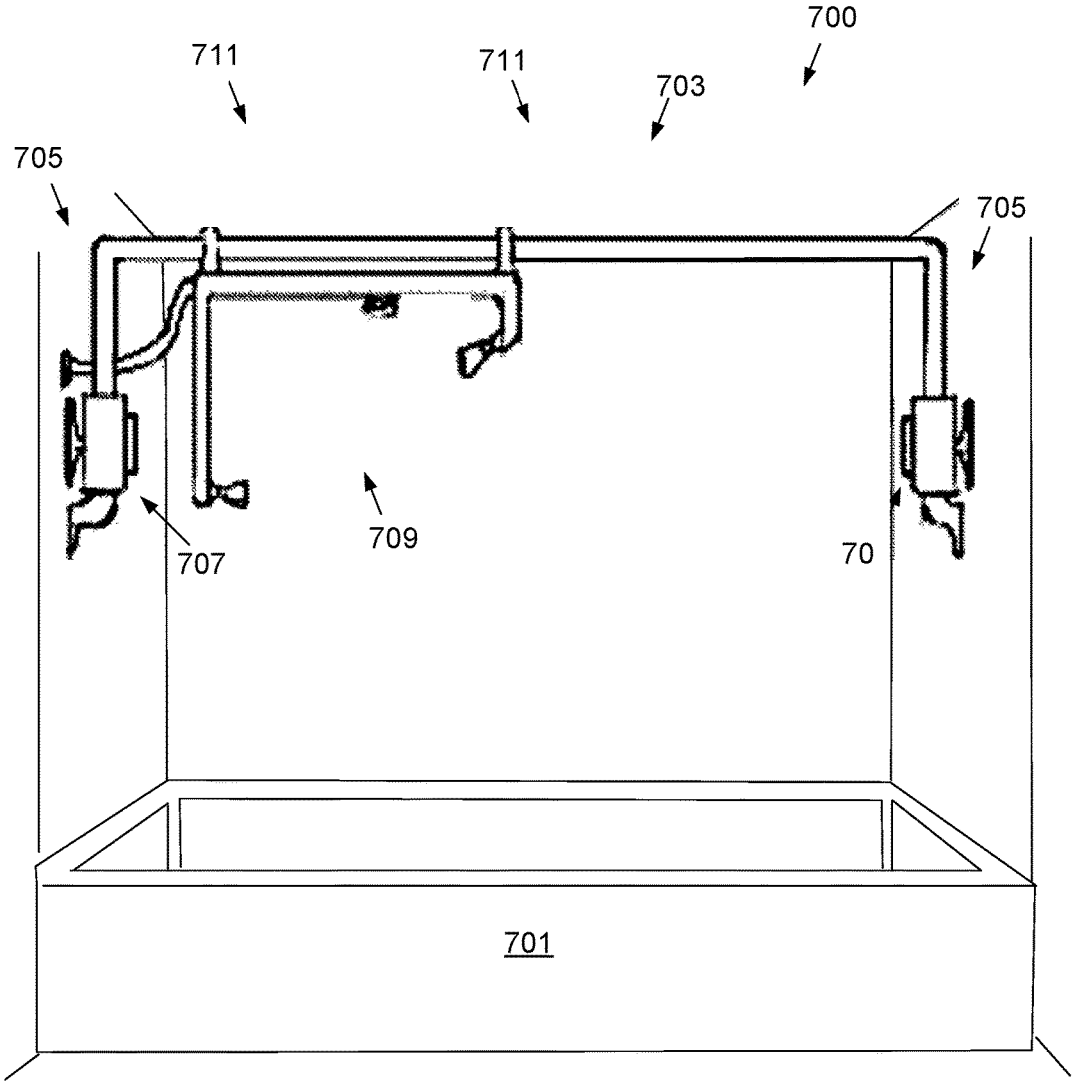
FIG. 50 is a side schematic view of an installation of a shower apparatus in a bathtub arrangement in accordance with another embodiment of the present invention.
Figure 51:
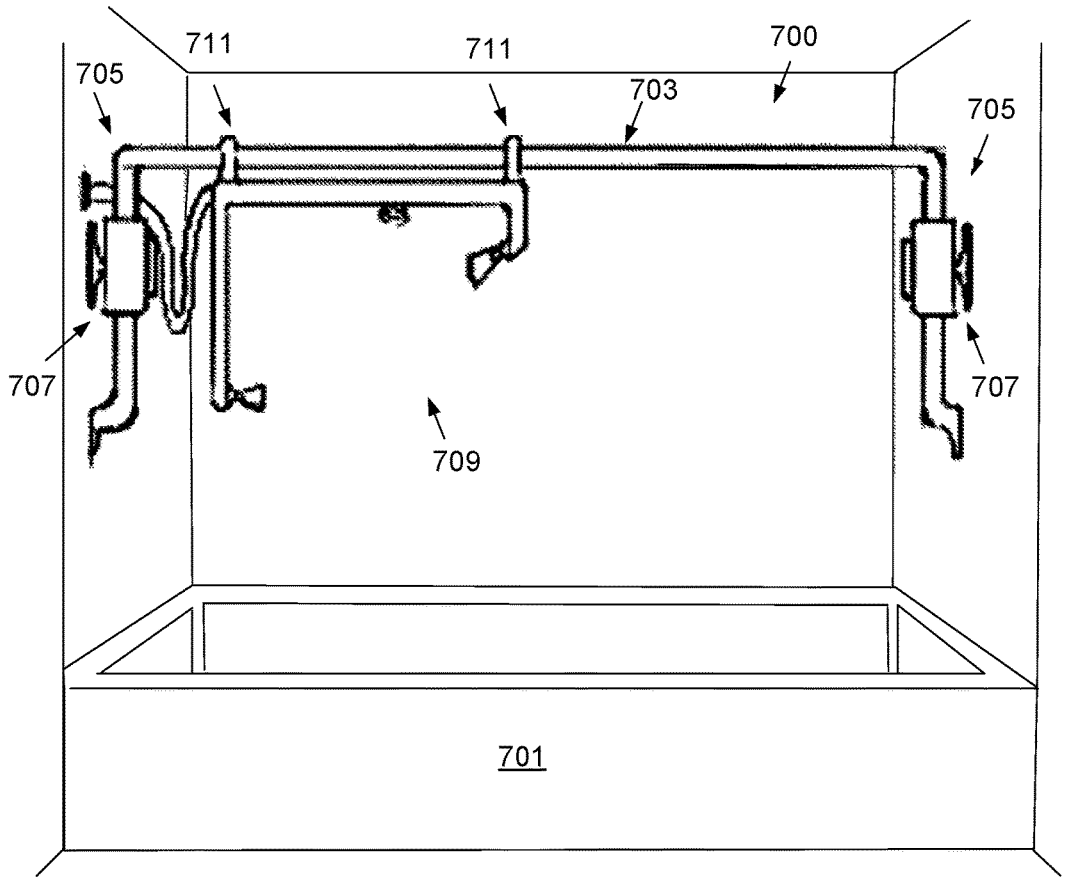
FIG. 51 is another view of the shower apparatus of FIG. 50, wherein the height of the shower apparatus has been adjusted (lowered) by a user.

FIG. 50 is a side schematic view of an installation of a shower apparatus 700 in a bathtub arrangement 701 in accordance with another embodiment of the present invention. FIG. 51 is another view of the shower apparatus 700, wherein the height or elevation of the framework and sprayers (indicated generally by 709) of the shower apparatus 700 have been adjusted lower by a user.

In this respect, the apparatus 700 includes a support bracket 703 that extends the length of the bathtub arrangement 701 and that is mounted at opposite ends 705 on opposed walls of the bathtub arrangement 701. The framework and sprayers are supported by the support bracket 703. Wall anchors 707 are mounted with an adhesive, suction cups, or both, for example, at opposite ends 705 of the support bracket 703 to opposed walls and permit sliding of the ends 705 of the support bracket 703 therethrough, by which the respective heights or elevations of the support bracket 703 and associated framework and sprayers are concurrently adjustable and lockable by a user. Additionally, the framework preferably is adjustable between the opposed walls on the support bracket 703. This may be accomplished by hanging the framework from the support bracket 703 by arms 711 that are slidable over, movable along, or otherwise repositionable on the support bracket 703. The framework and sprayers are thus adjustable not only vertically, but also horizontally relative to the bathtub arrangement 701.

Figure 52:
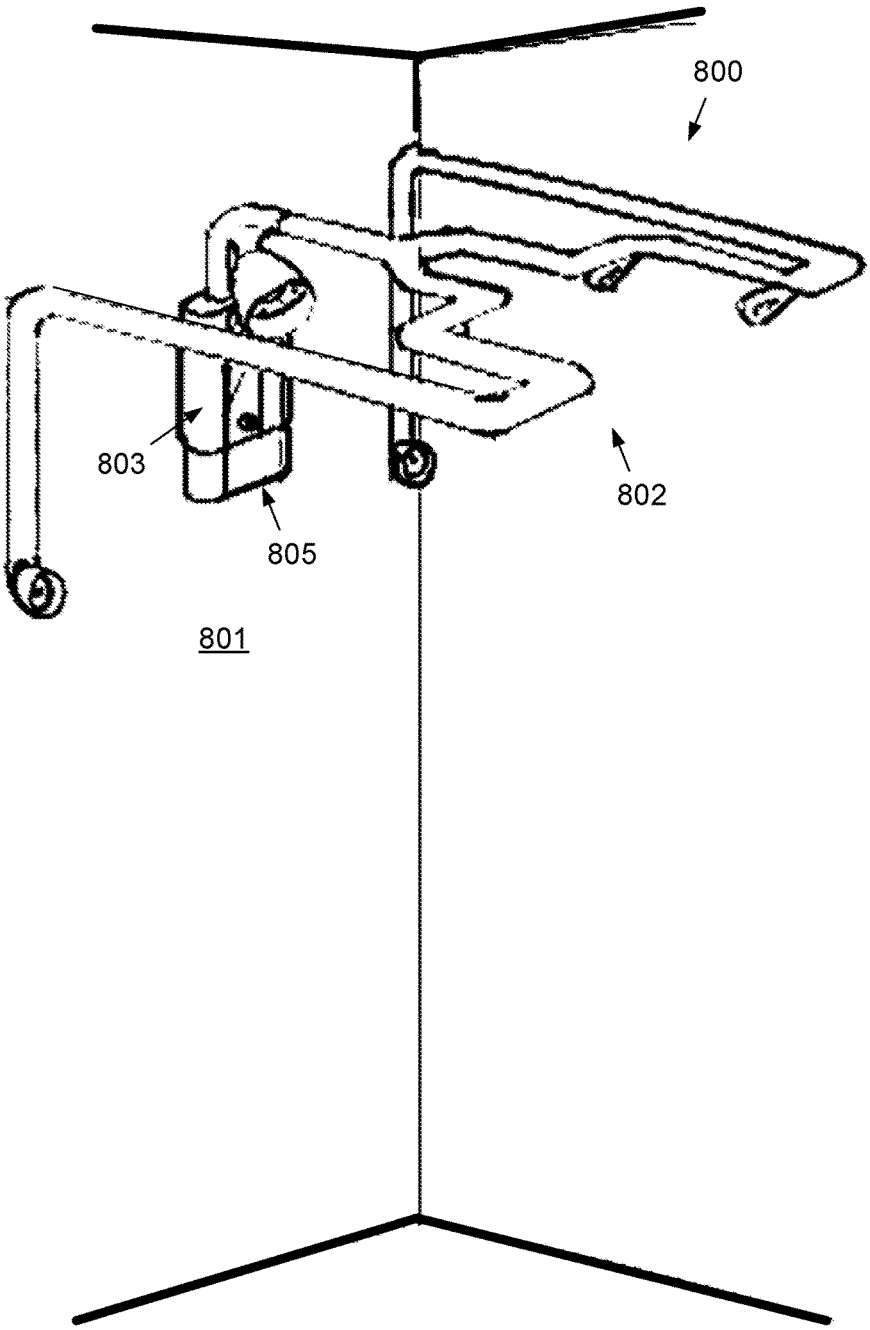
FIG. 52 is a perspective view of an installation of a shower apparatus in a shower stall in accordance with another embodiment of the present invention.
Figure 53:
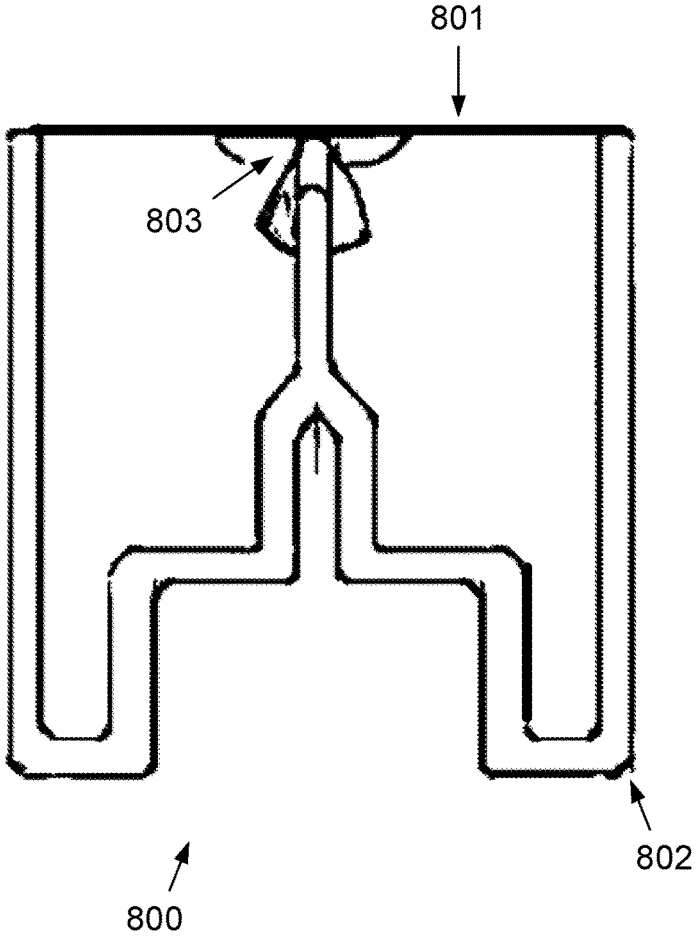
FIG. 53 is a top plan view of the shower apparatus of FIG. 52.
Figure 56:
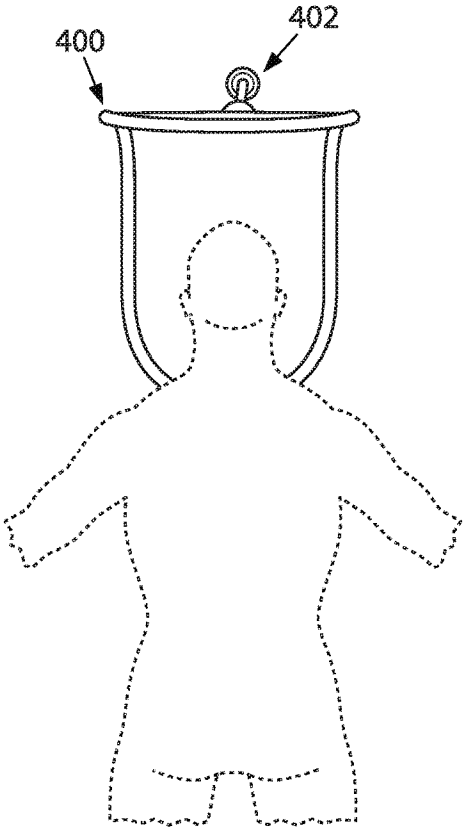
FIG. 56 is a back elevational view of further showing the preferred relative position of the framework of FIG. 54.
Figure 55:
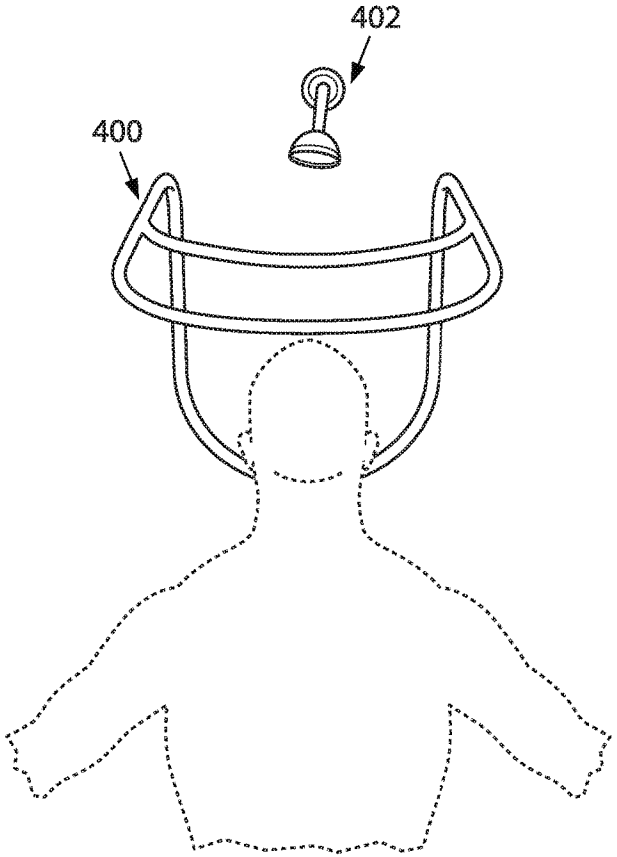
FIG. 55 is a back perspective view further showing the preferred relative position of the framework of FIG. 54.
Figure 54:
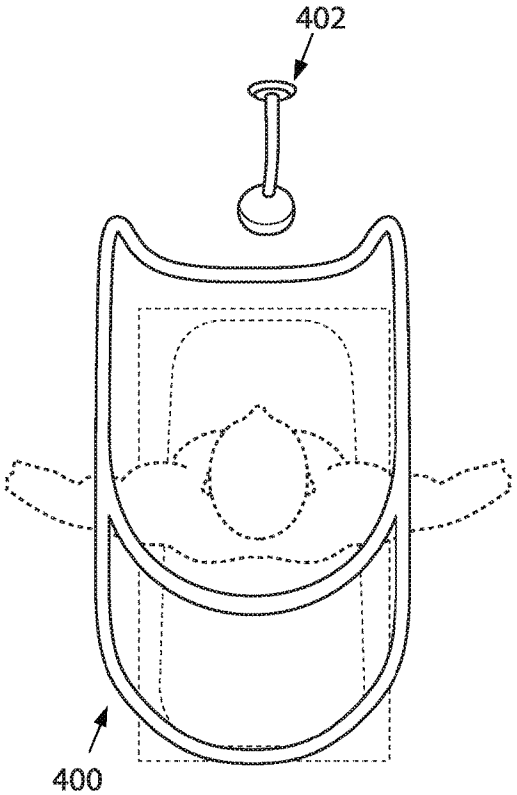
FIG. 54 is a top perspective view of an installation of a shower apparatus in accordance with a preferred embodiment of the present invention, wherein all but the framework of the shower apparatus are omitted for clarity for purpose of showing a preferred relative position of the framework.
Figure 57:
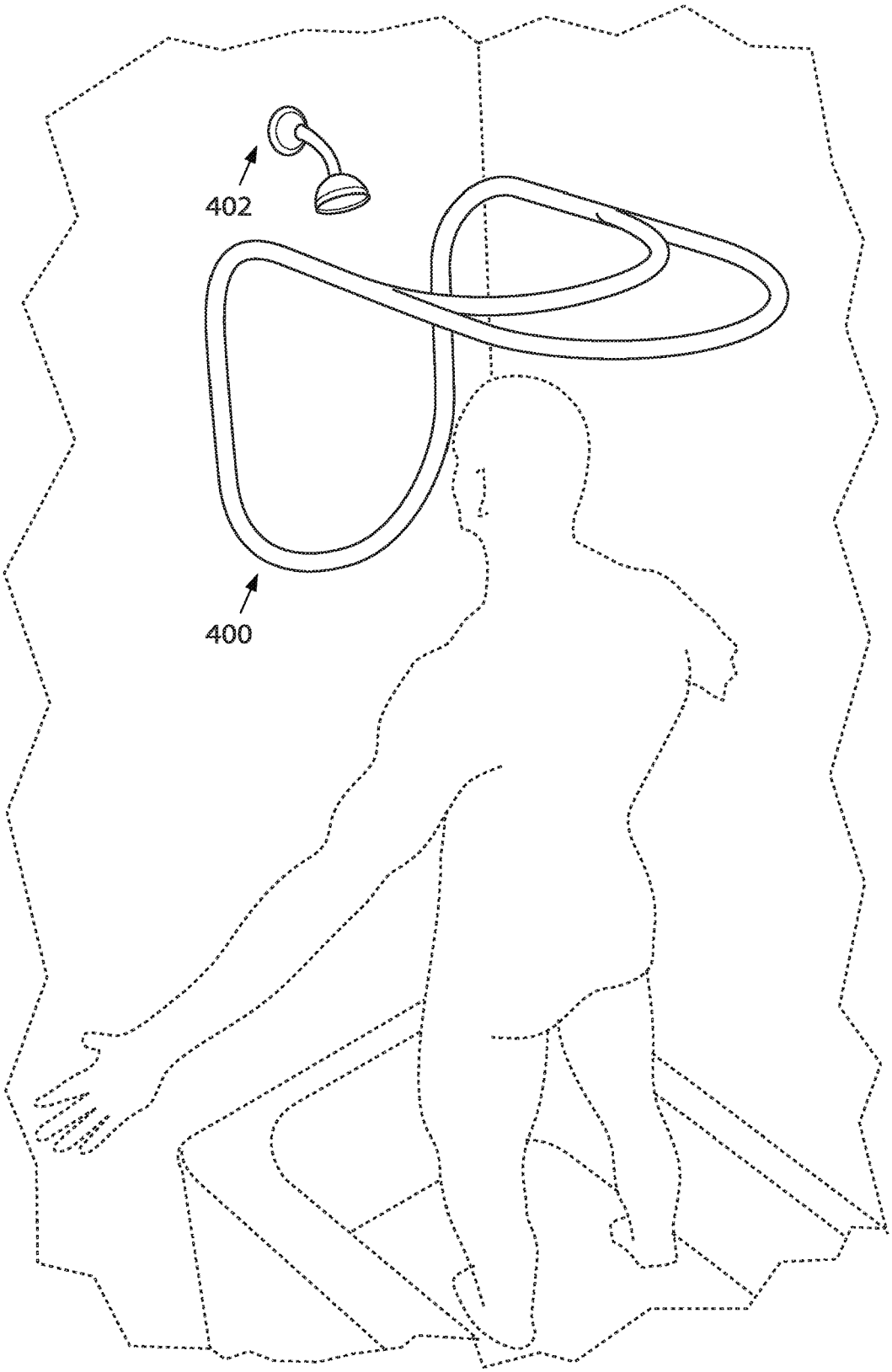
FIG. 57 is a side perspective view further showing the preferred relative position of the framework of FIG. 54.
Figure 60:
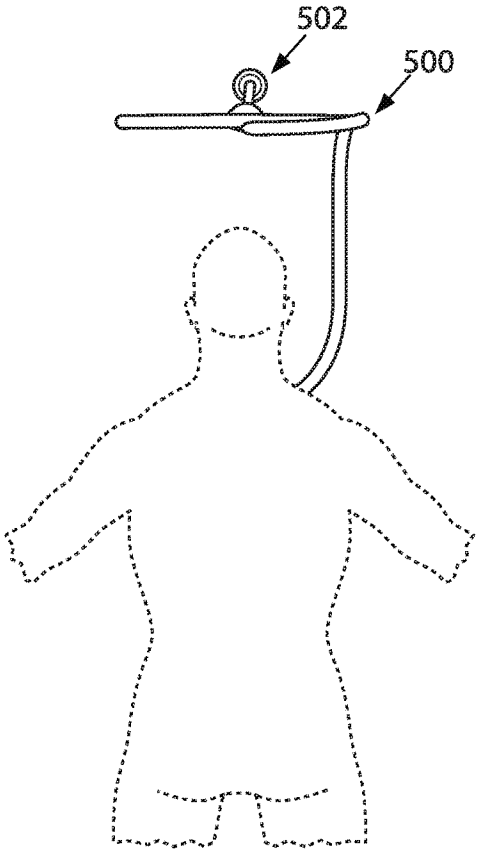
FIG. 60 is a back elevational view further showing the preferred relative position of the framework of FIG. 58.
Figure 59:
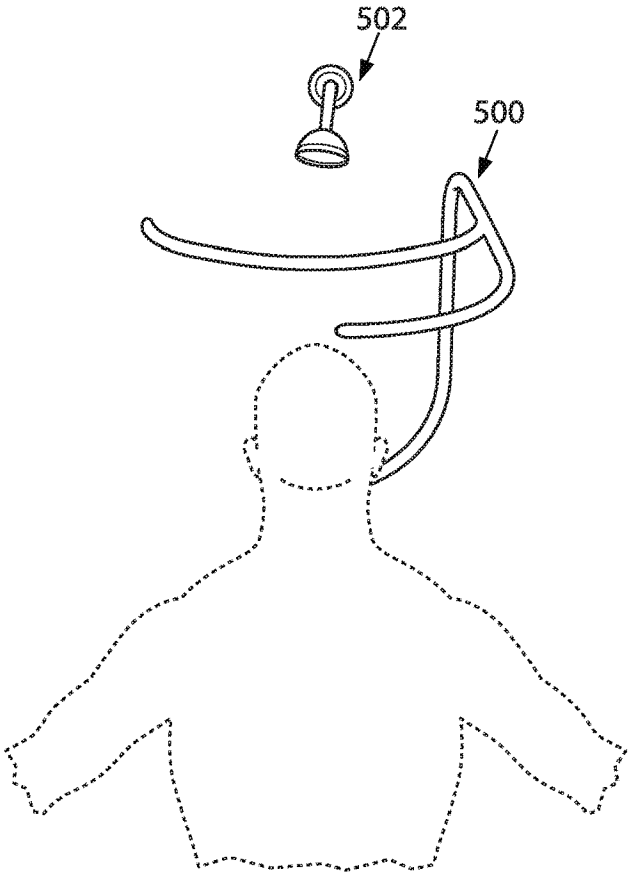
FIG. 59 is a back perspective view further showing the preferred relative position of the framework of FIG. 58.
Figure 58:
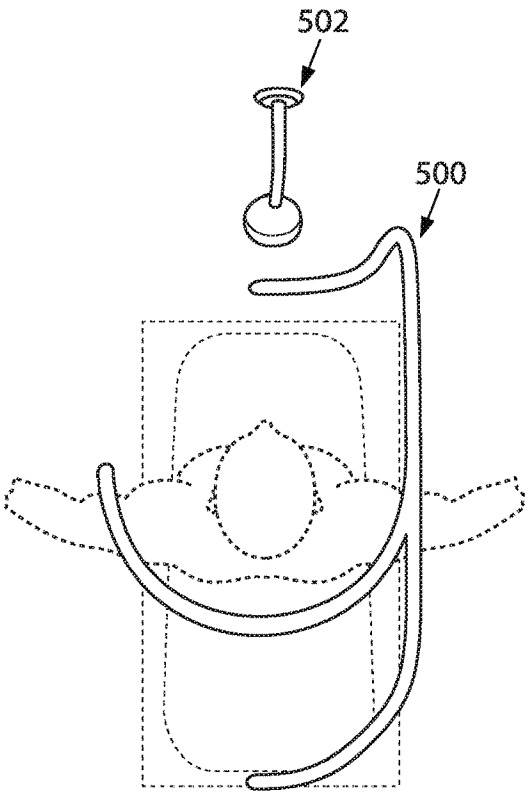
FIG. 58 is a top perspective view of an installation of another shower apparatus in accordance with a preferred embodiment of the present invention, wherein all but the framework of the shower apparatus are omitted for clarity for purpose of showing a preferred relative position of the framework.
Figure 61:
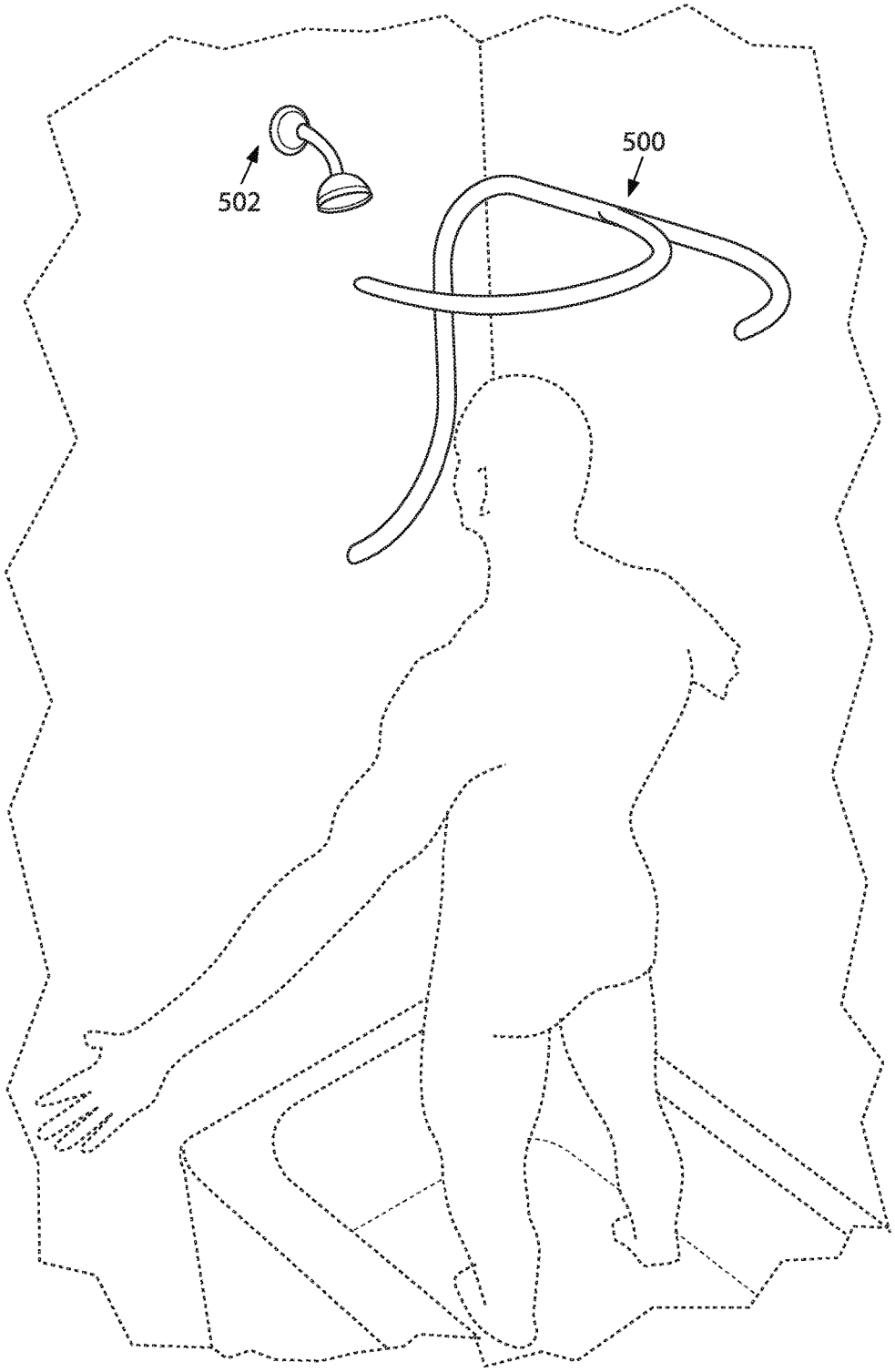
FIG. 61 is a side perspective view further showing the preferred relative position of the framework of FIG. 58.

FIG. 52 is a perspective view of an installation of a shower apparatus 800 in a shower stall in accordance with another embodiment of the present invention, and FIG. 53 is a top plan view of the installation of the shower apparatus 800. Shower apparatus 800 comprises a framework 802 mounted on a single wall 801 of the shower at the location at which a conventional shower head would be located. The mounting preferably includes a sleeve 803 that is vertically slidable on a mounting housing 805 that itself if fixed in position on the wall 801. The framework and associated sprayers are adjustable and lockable at different desired heights by moving and locking the sleeve 803 on the housing 805. The mounting by the sleeve and housing preferably is the only attachment of the shower apparatus to the shower and represents a single point of mounting. It further will be appreciated that the shower apparatus could equally be installed in a bathtub arrangement similar to this installation shown in FIG. 52.

Yet additional aspects, features, and embodiments of shower apparatus are disclosed in the remaining drawings. For example, FIGS. 54-57 serve to illustrate a preferred location of a framework 400 relative to a conventional shower head 402 in accordance with embodiments of the invention. The framework 400 of FIGS. 54-57 is representative of the framework 102 of the shower arrangement 100 of FIG. 1. Similarly, FIGS. 58-61 serve to illustrate a preferred location of a framework 500 relative to a conventional shower head 502 in accordance with other embodiments of the invention. The framework 500 of FIGS. 56-61 is representative of the framework 202 of the shower arrangement 200 of FIG. 19 of this application.

Still additional embodiments of shower apparatus in accordance with one or more aspects and features of the invention are disclosed FIGS. 62-100.

Figure 63:
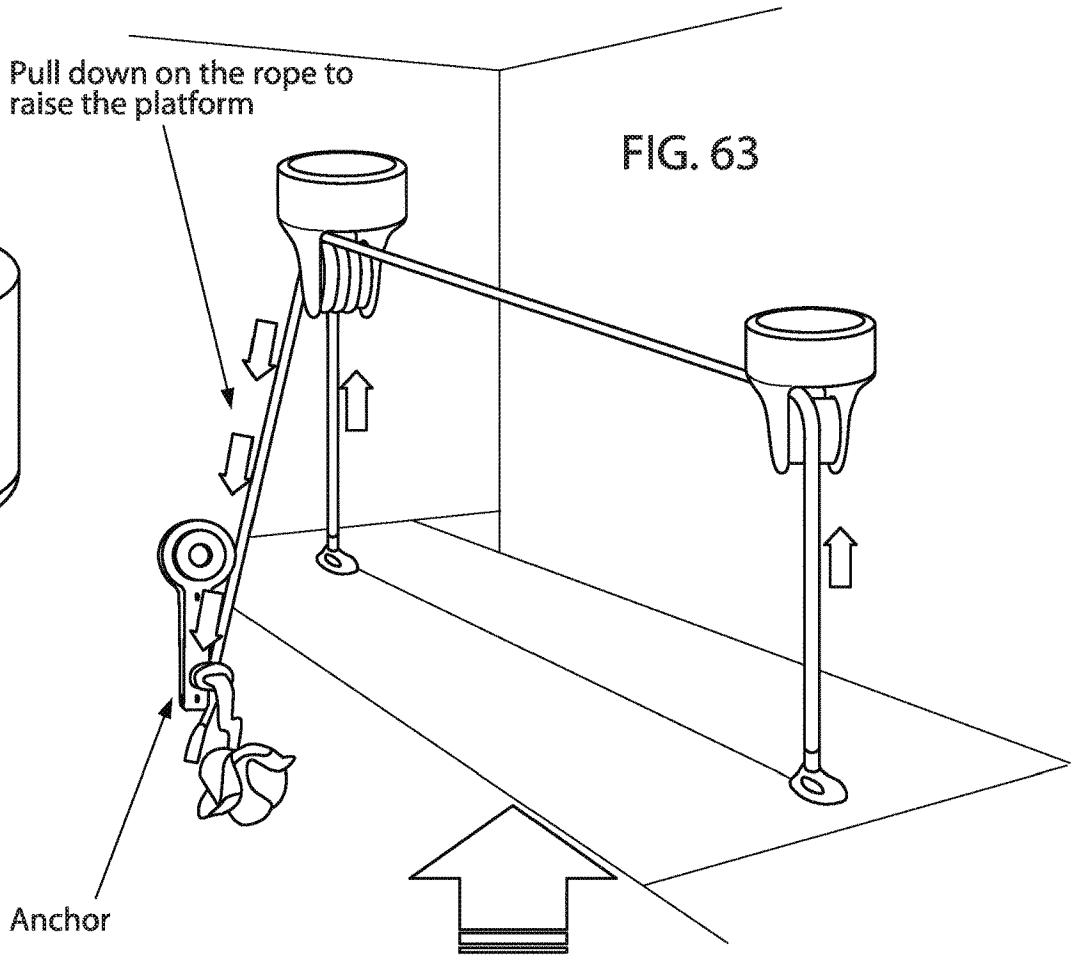
FIG. 63 schematically illustrates use of two hoist brackets of FIG. 62 in accordance with one or more embodiments of the present invention.
Figure 62:
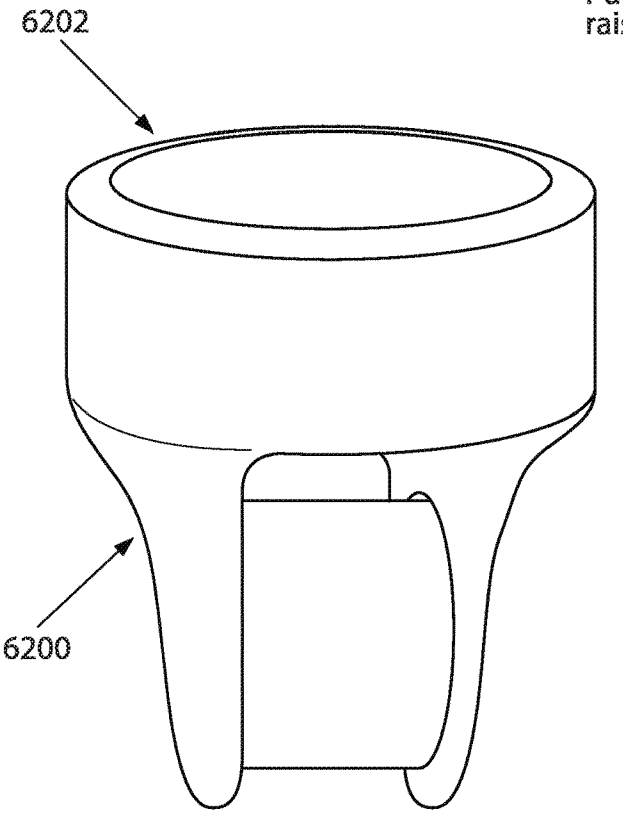
FIG. 62 schematically illustrates a hoist bracket including a preferred adhesive tape sold by 3M, which hoist bracket may be used in shower apparatus installations in accordance with one or more embodiments of the present invention.

FIG. 62 schematically illustrates a hoist bracket 6200 including a preferred adhesive tape 6202 sold by 3M, which hoist bracket may be used in shower apparatus installations in accordance with one or more embodiments of the present invention; and FIG. 63 schematically illustrates use of two hoist brackets of FIG. 62 in accordance with one or more embodiments of the present invention.

Figure 65:
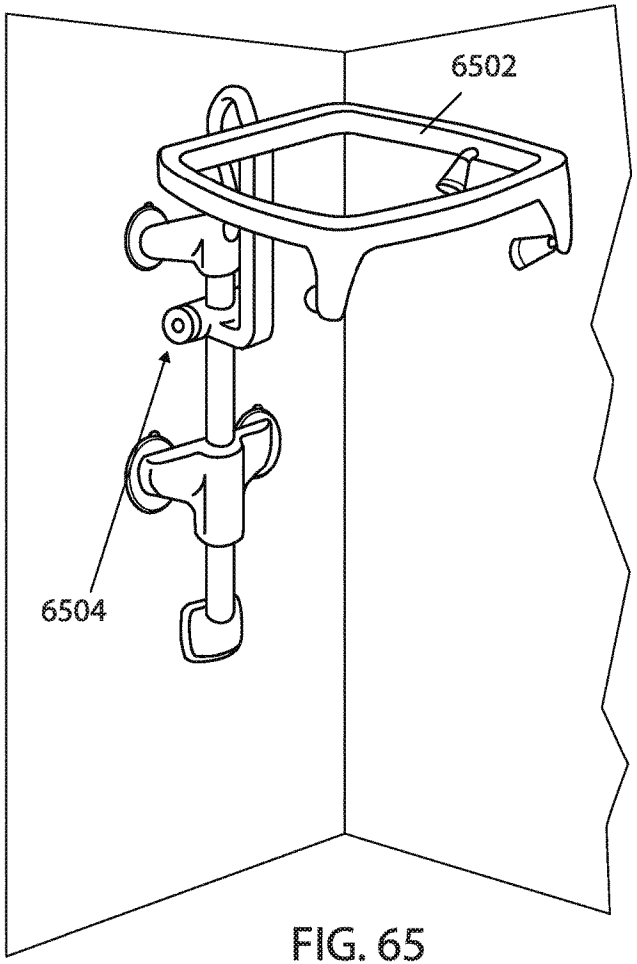
FIG. 65 further schematically illustrates use of the support adjustment pole assembly of FIG. 64.
Figure 64:
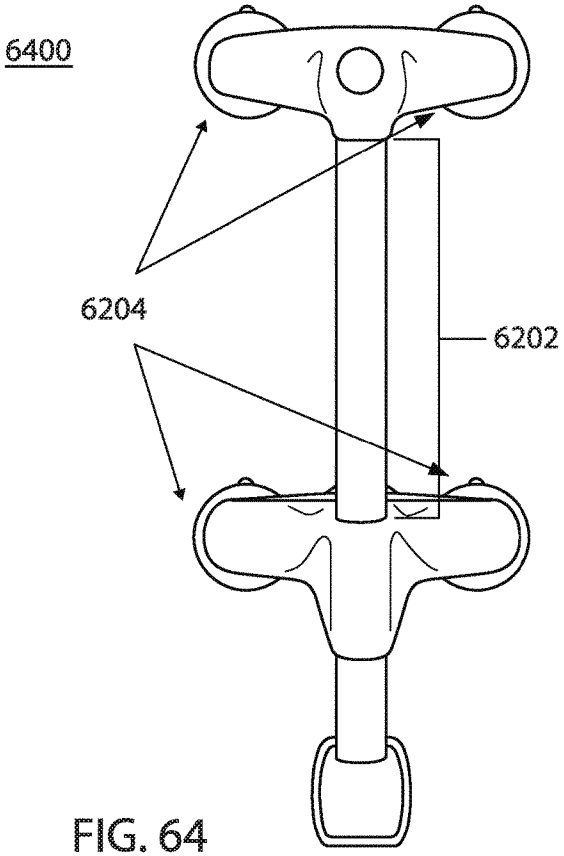
FIG. 64 schematically illustrates a support adjustment pole assembly that may be used in shower apparatus installations in accordance with one or more embodiments of the present invention.
Figure 67:
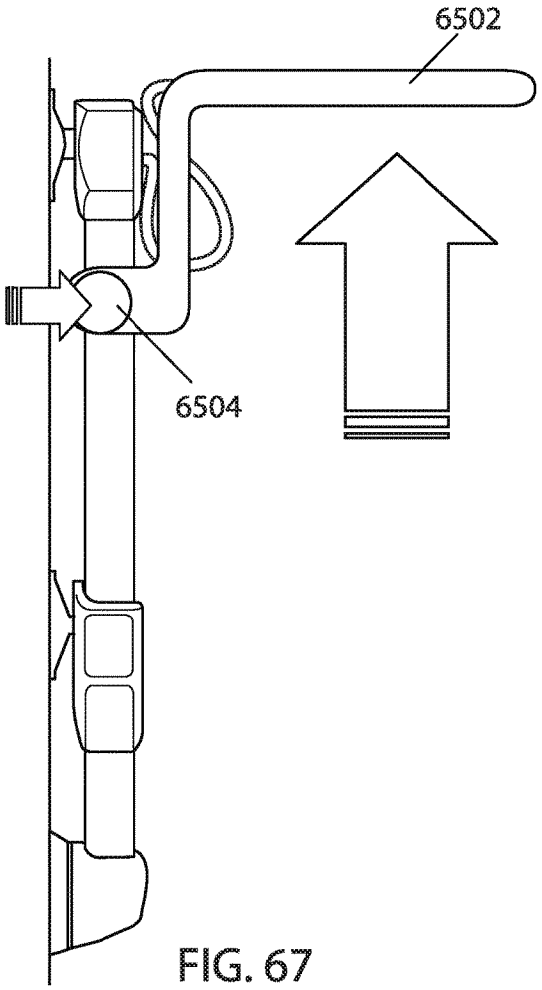
FIG. 67 schematically illustrates an increasing of a height of the shower apparatus in the installation of FIG. 65.
Figure 66:
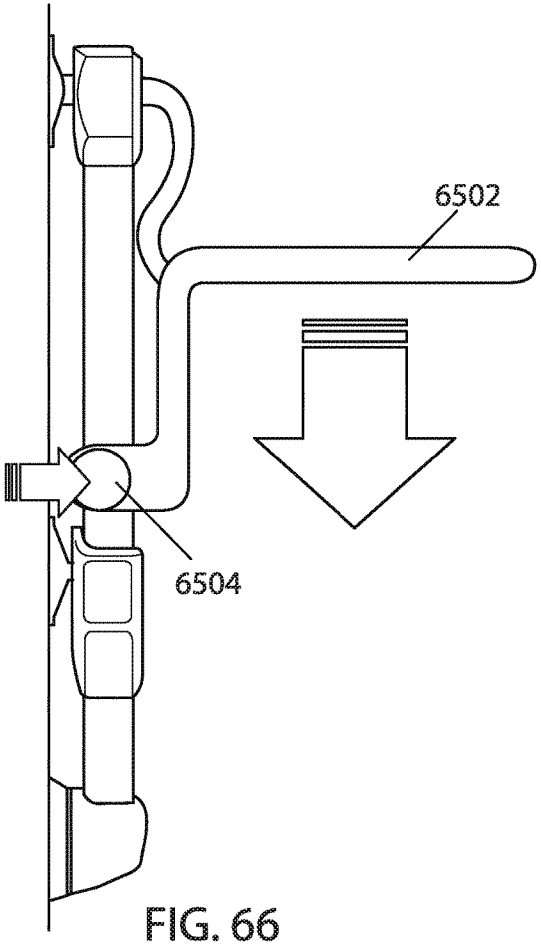
FIG. 66 schematically illustrates a decreasing of a height of the shower apparatus in the installation of FIG. 65.

FIG. 64 schematically illustrates a support adjustment pole assembly 6400 with a support adjust pole 6202 and suction cups 6204 that may be used in shower apparatus installations in accordance with one or more embodiments of the present invention. FIG. 65 further schematically illustrates use of the support adjustment pole assembly 6200 of FIG. 64, wherein a framework 6502 is adjustably attached to the support adjustment pole by a spring-loaded clamp assembly 6504. FIG. 66 schematically illustrates a decreasing of a height of the framework 6502 in the installation of FIG. 65 while depressing a button of the spring-loaded clamp 6504. FIG. 67 schematically illustrates an increasing of a height of the framework 6502 in the installation of FIG. 65 while depressing a button of the spring-loaded clamp 6504.

Figure 69:
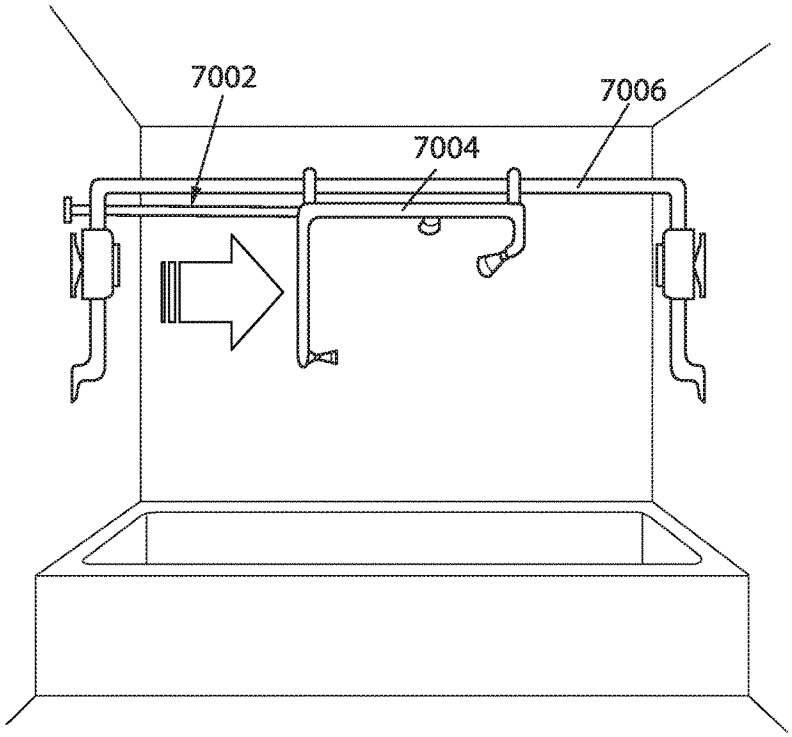
FIG. 69 schematically illustrates horizontal adjustment in the installation of the adjustable shower apparatus of FIG. 68.
Figure 68:
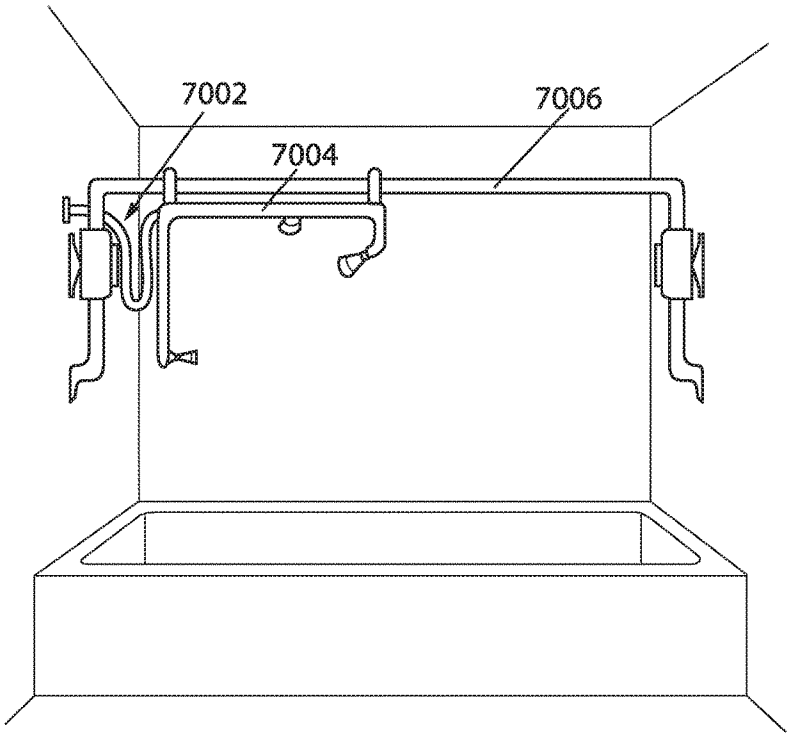
FIG. 68 schematically illustrates another installation of an adjustable shower apparatus in accordance with one or more embodiments of the present invention.
Figure 71:
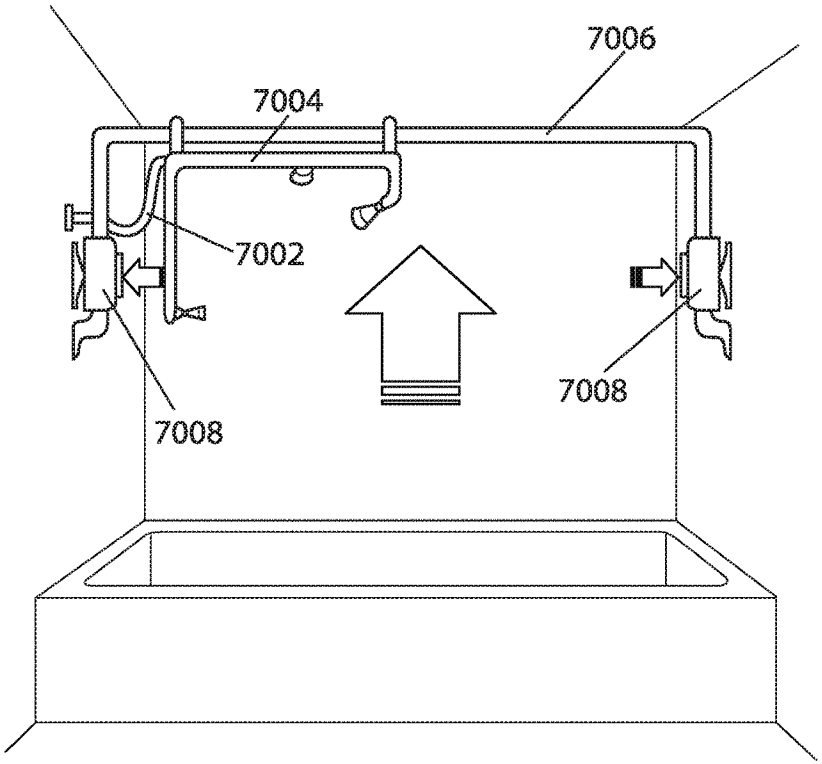
FIG. 71 schematically illustrates the subsequent raising of the shower apparatus of FIG. 70.
Figure 70:
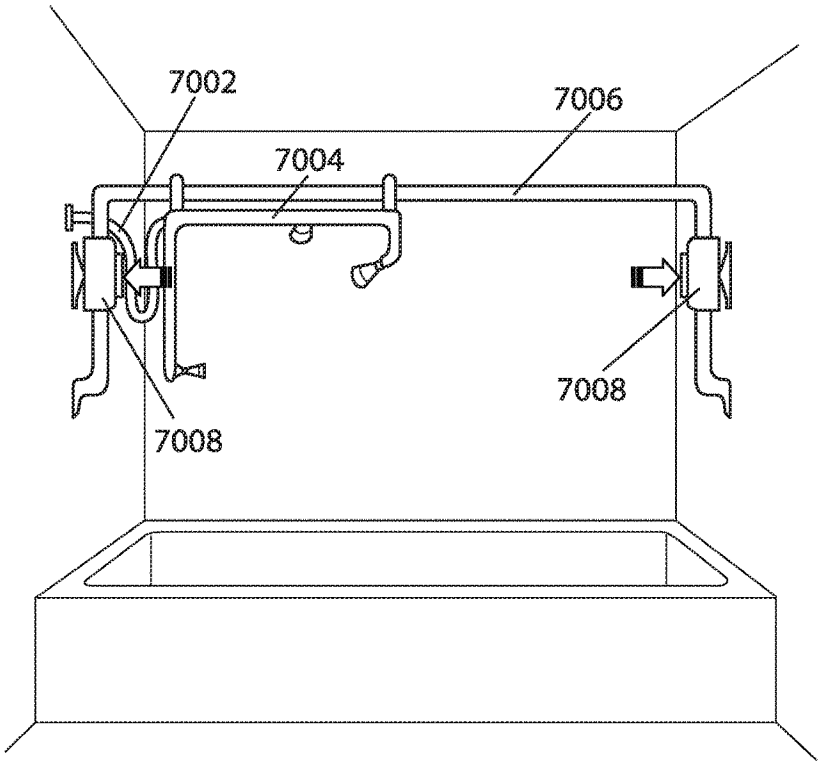
FIG. 70 schematically illustrates depression of a button on each anchor mounting assembly in the installation of the shower apparatus of FIG. 68 for purposes of adjusting the height of the shower apparatus.

FIG. 68 schematically illustrates another installation of an adjustable shower apparatus in accordance with one or more embodiments of the present invention. FIG. 69 schematically illustrates horizontal adjustment in the installation of the adjustable shower apparatus of FIG. 68. In this illustration, a water tether hose 7002 connects between the plumbing in a wall and a water inlet port of the framework 7004 for water flow through the conduits to the sprayers. The framework 7004 slides on a support 7006 that extends between opposite walls. FIG. 70 schematically illustrates depression of a button on each anchor mounting assembly 7008 in the installation of the shower apparatus of FIG. 68 for purposes of adjusting the height of the framework 7004. FIG. 71 schematically illustrates the subsequent raising of the framework 7004 of the shower apparatus of FIG. 70.

Figure 72:
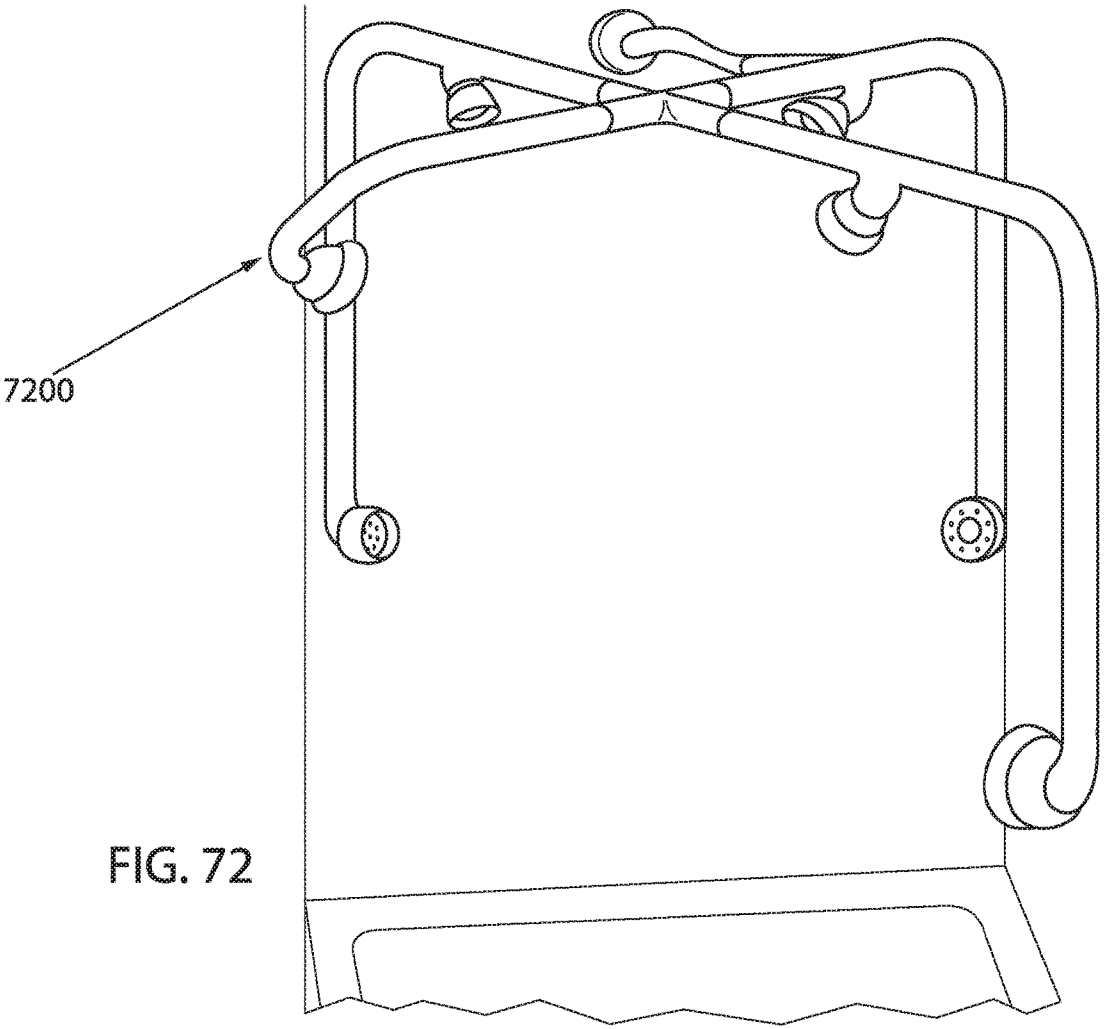
FIG. 72 schematically illustrates a framework and sprayers in another shower apparatus in accordance with one or more embodiments of the present invention.

FIG. 72 schematically illustrates a framework and sprayers in another shower apparatus 7200 in accordance with one or more embodiments of the present invention.

Figure 73:
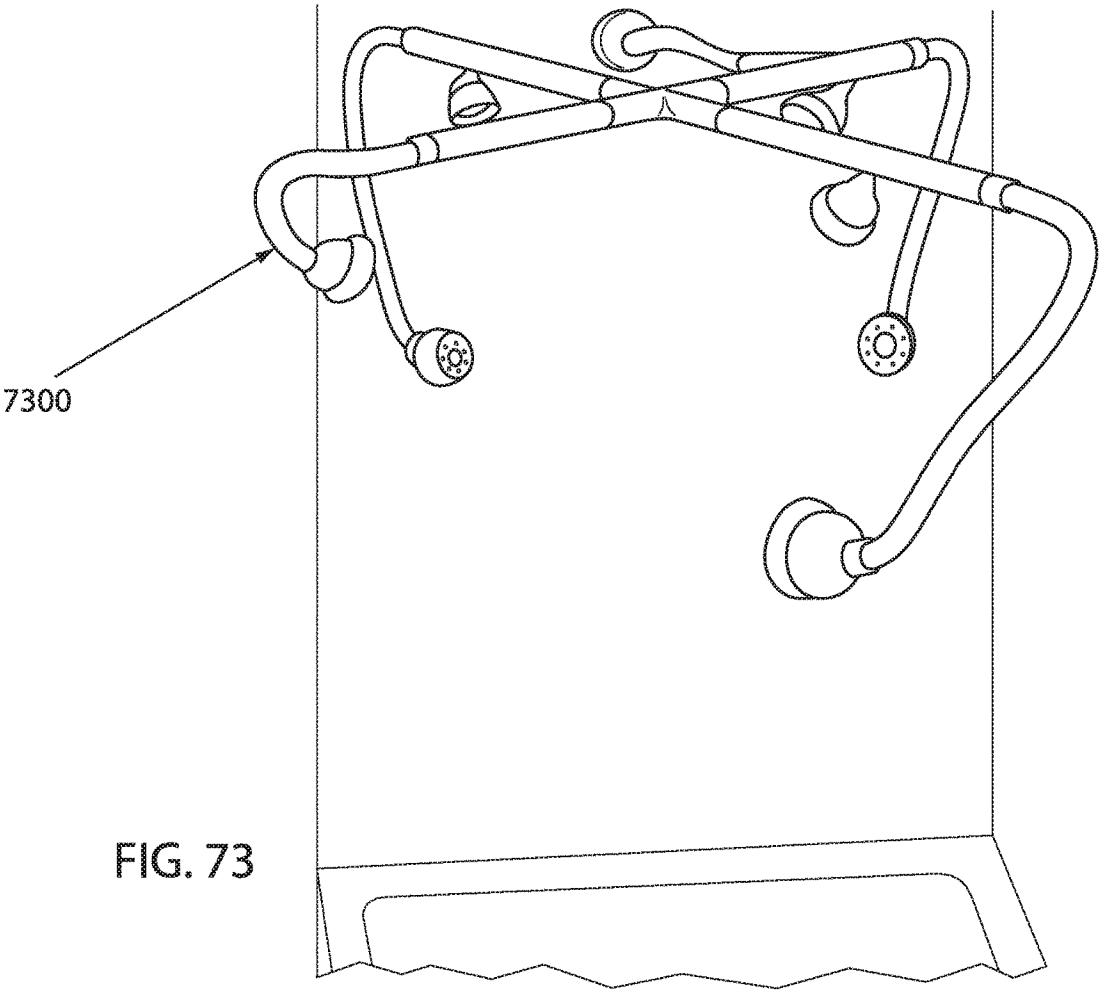
FIG. 73 schematically illustrates a framework and sprayers in another shower apparatus in accordance with one or more embodiments of the present invention.

FIG. 73 schematically illustrates a framework and sprayers in another shower apparatus 7300 in accordance with one or more embodiments of the present invention, which includes flexible hose extensions of the sprayers.

Figure 74:
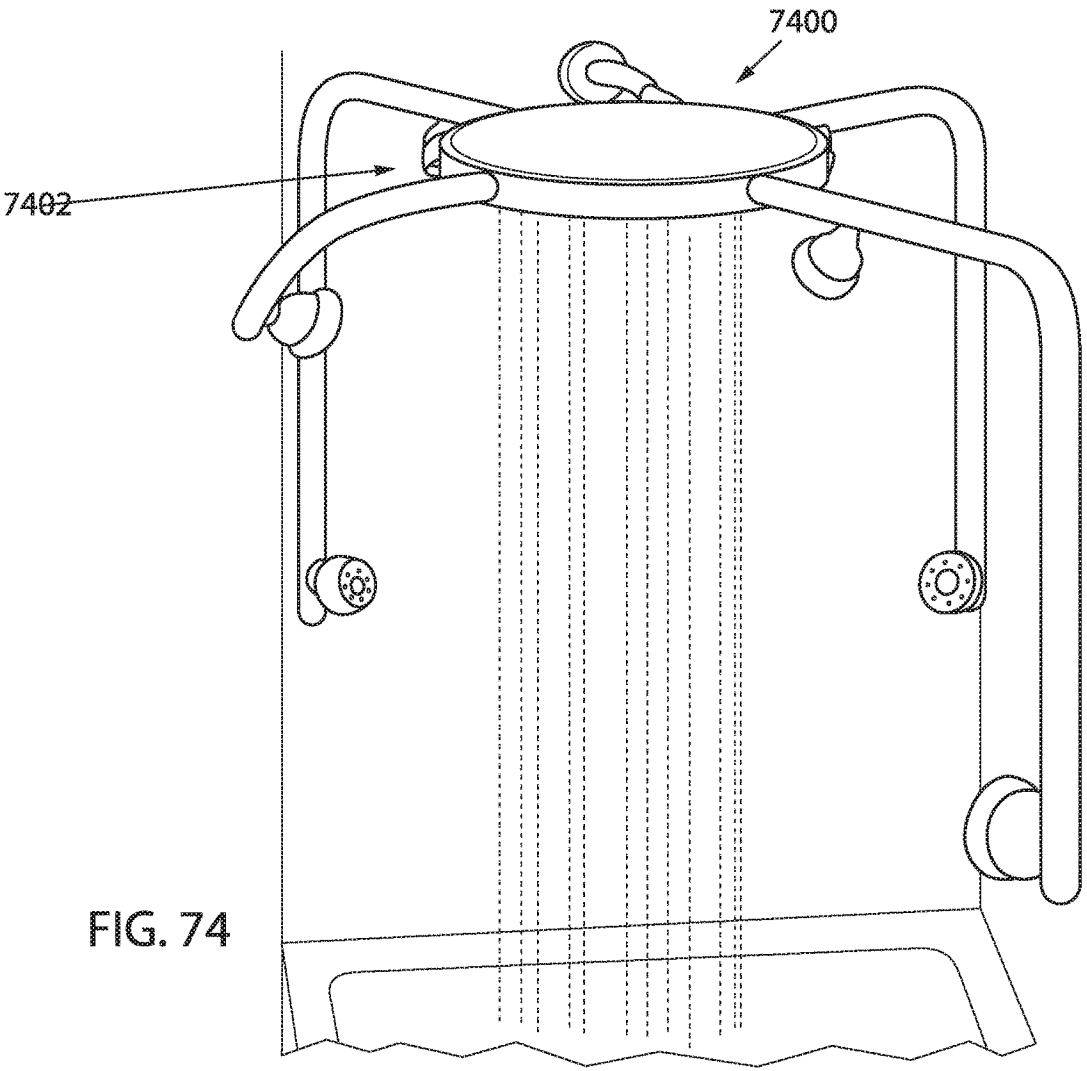
FIG. 74 schematically illustrates a framework and sprayers in another shower apparatus in accordance with one or more embodiments of the present invention.

FIG. 74 schematically illustrates a framework and sprayers in another shower apparatus 7400 in accordance with one or more embodiments of the present invention, which includes a central rain shower head 7402 is included together with a plurality of additional sprayers arranged on the framework.

Figure 75:
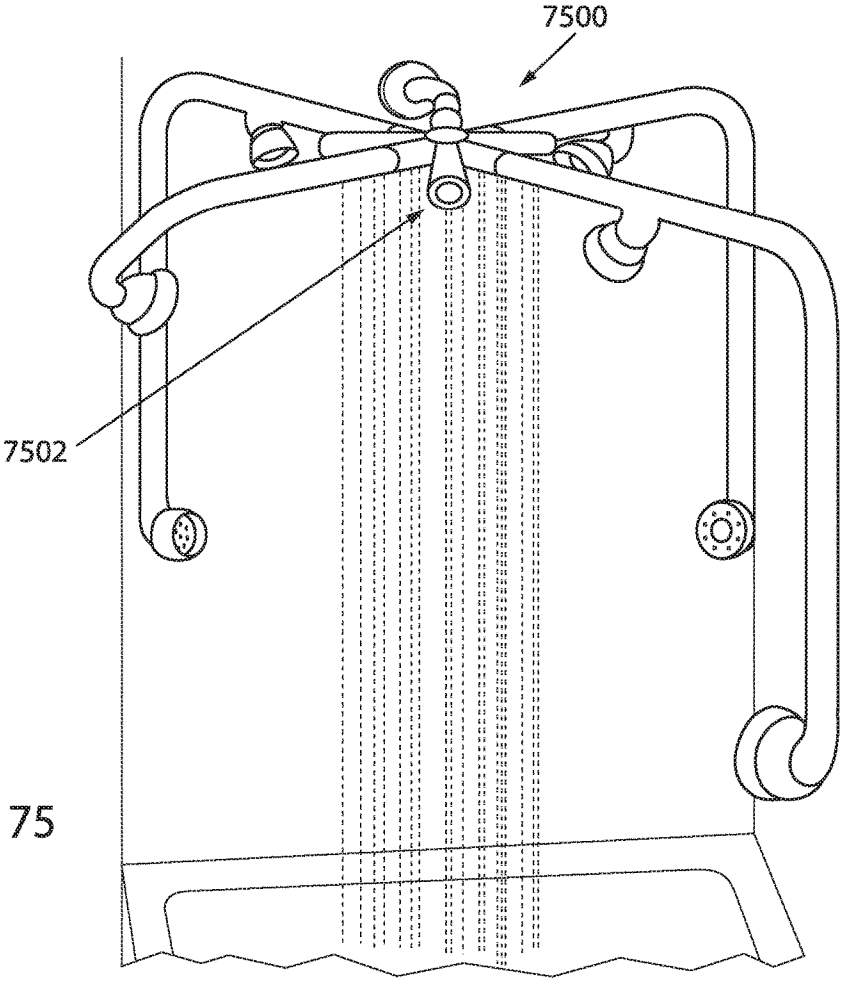
FIG. 75 schematically illustrates a framework and sprayers in another shower apparatus in accordance with one or more embodiments of the present invention.

FIG. 75 schematically illustrates a framework and sprayers in another shower apparatus 7500 in accordance with one or more embodiments of the present invention, which also includes a central rain shower head 7502.

Figure 77:
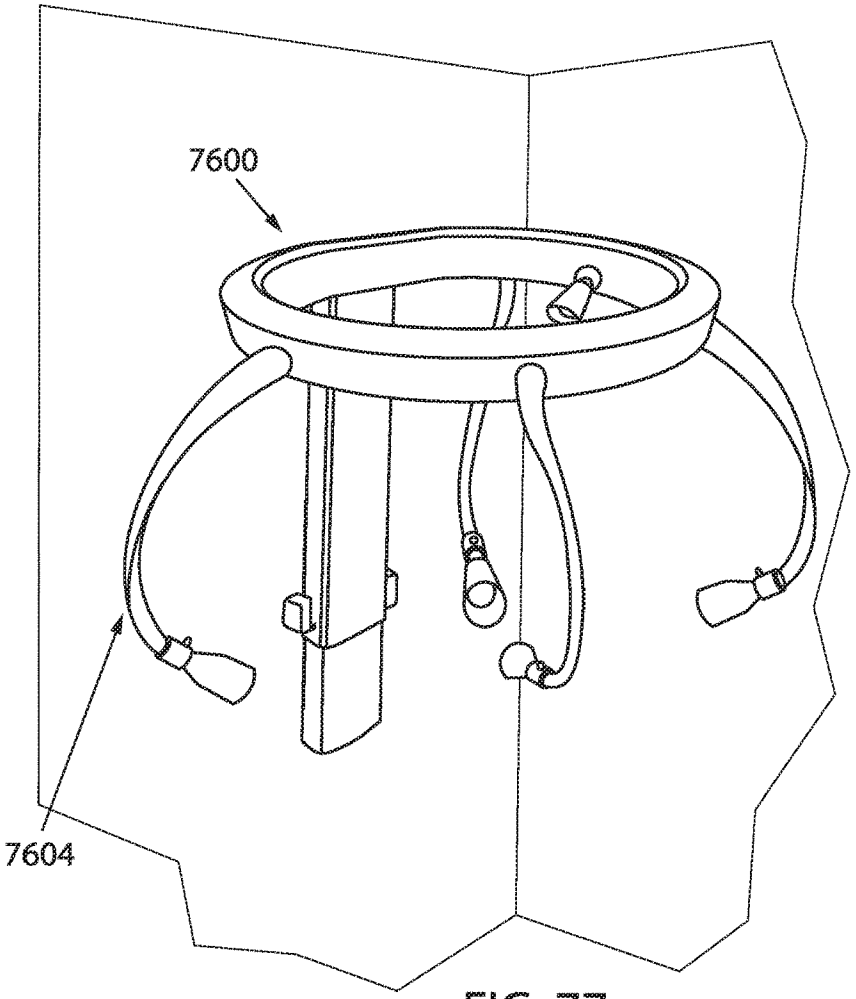
FIG. 77 is a perspective view of the installation of FIG. 76.
Figure 76:
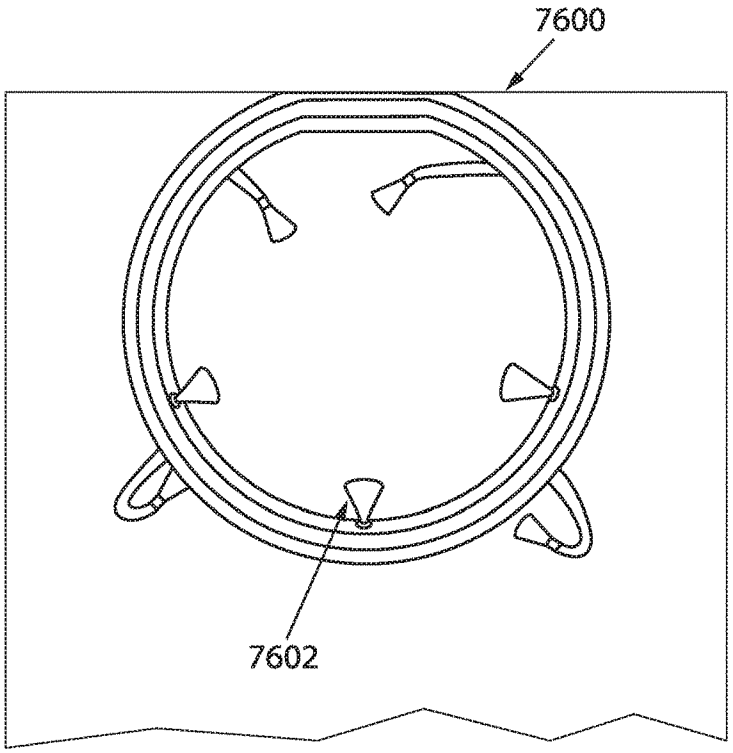
FIG. 76 schematically illustrates a bottom view of a framework and sprayers of an installation of another shower apparatus in accordance with one or more embodiments of the present invention.
Figure 79:
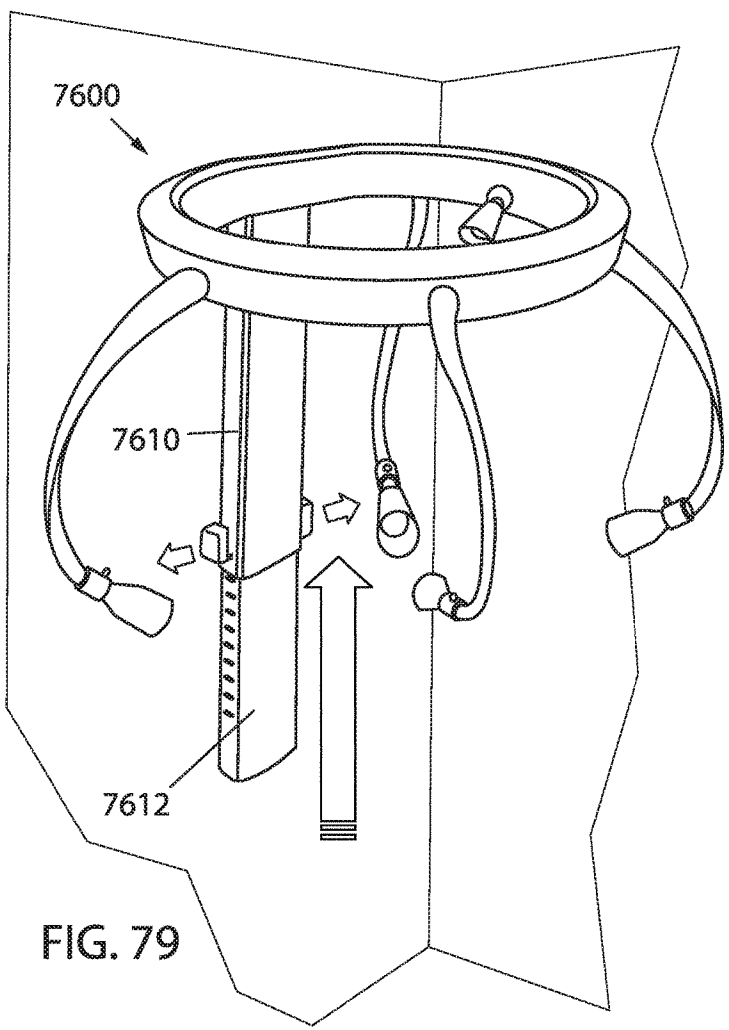
FIG. 79 is another perspective view of adjusting (raising) the height of the shower apparatus in the installation of FIG. 76.
Figure 78:
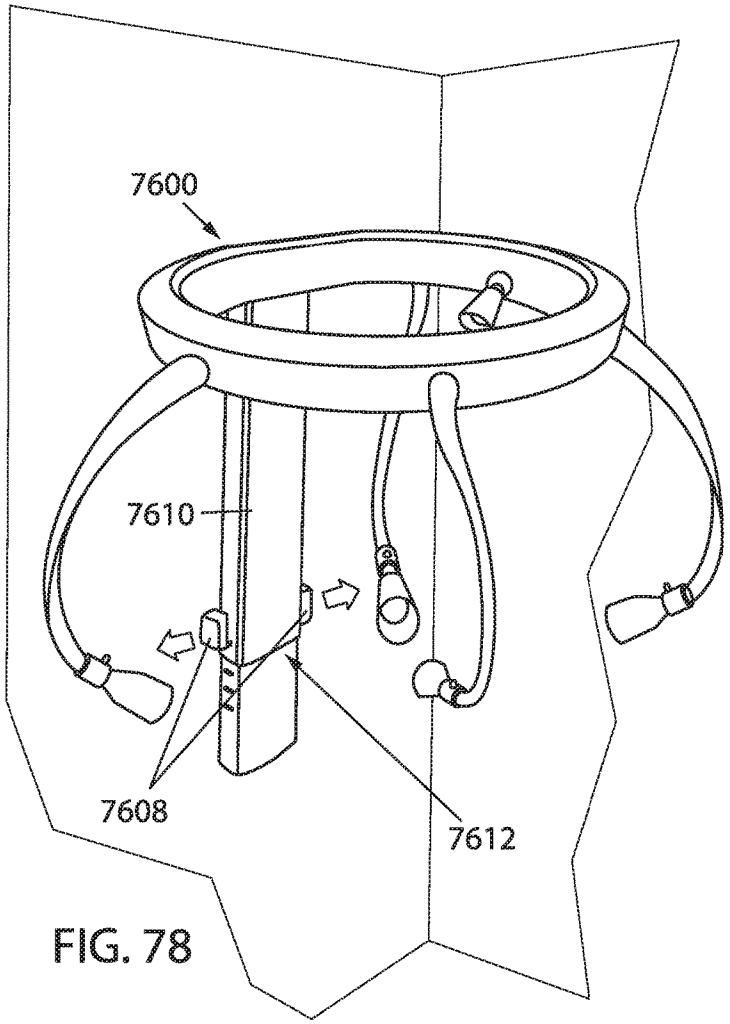
FIG. 78 is another perspective view of the installation of FIG. 76, wherein locking bars are being extended for unlocking and adjustment of the height of the shower apparatus.

FIG. 76 schematically illustrates a bottom view of a framework and sprayers of an installation of another shower apparatus 7600 in accordance with one or more embodiments of the present invention, which includes interior head sprayers 7602 on the inside of the oval portion of the framework; and FIG. 77 is a perspective view of the installation of the apparatus 7600 of FIG. 76, which further shows additional outside sprayers including flexible hose extensions 7604. FIG. 78 is another perspective view of the installation of the apparatus 7600 of FIG. 76, wherein locking bars 7608 are being extended for unlocking and adjustment of the height of the framework of the shower apparatus by sliding movement of component 7610 on mounting component 7612. Component 7610 is fixedly connected to the oval framework; however, it will be appreciated that the component 7610 could be formed integrally with and as part of the framework with the same shape and profile as component 7610. Additionally, FIG. 79 is another perspective view of adjusting (raising) the height of the framework of the shower apparatus in the installation of apparatus 7600 of FIG. 76.

Figure 81:
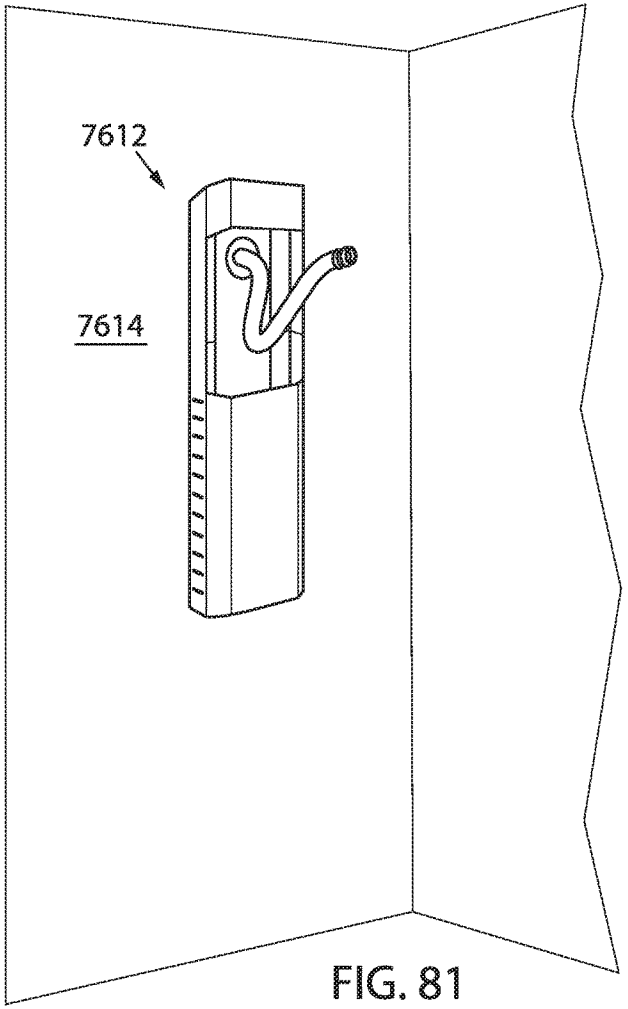
FIG. 81 is a perspective view of the part of the mounting assembly of FIG. 79 when attached to a wall of the shower or bathtub arrangement.
Figure 80:
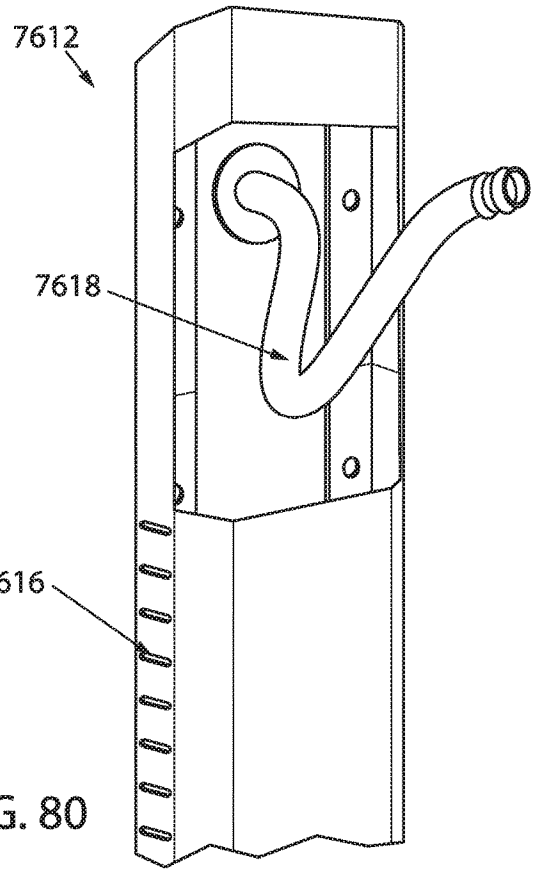
FIG. 80 is view of part of the mounting assembly of the installation of FIG. 76.

FIG. 80 is view of part of the mounting component 7612 of the installation of the apparatus 7600 of FIG. 76; and FIG. 81 is a perspective view of the part of the mounting component 7612 of FIG. 80 when attached to a wall 7614 of the shower or bathtub arrangement. As seen therein, the mounting component 7612 includes adjustment level slots 7616 defining positions for fixing the height of the framework, as desired. A flexible hose connection 7618 for providing water to the conduits of the framework also is seen, which flexible hose connection 7618 allows for sliding of the component on the mounting component 7612.

Figure 83:
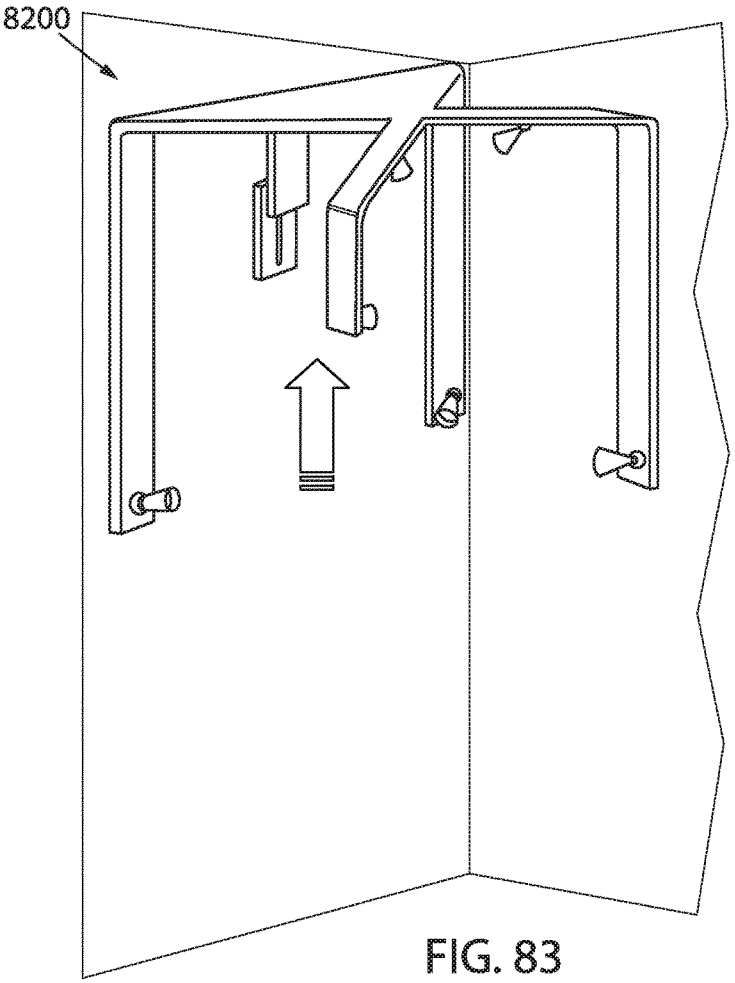
FIG. 83 schematically illustrates the raising of the framework and sprayers of the shower apparatus of FIG. 82.
Figure 82:
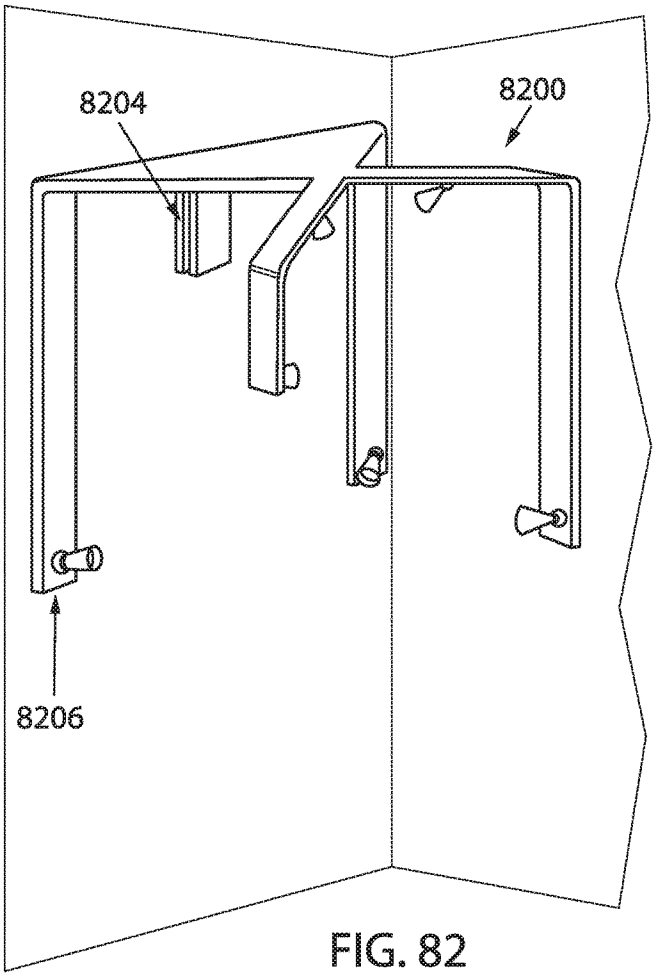
FIG. 82 schematically illustrates a framework and sprayers in another shower apparatus in accordance with one or more embodiments of the present invention.

FIG. 82 schematically illustrates a framework and sprayers in another shower apparatus 8200 in accordance with one or more embodiments of the present invention, which includes a mounting adjustment bracket 8204. It will be appreciated that the rectangular profile of the framework permits the framework to lay cleanly against the wall. FIG. 83 schematically illustrates the raising of the framework and sprayers of the shower apparatus 8200 of FIG. 82.

Figure 85:
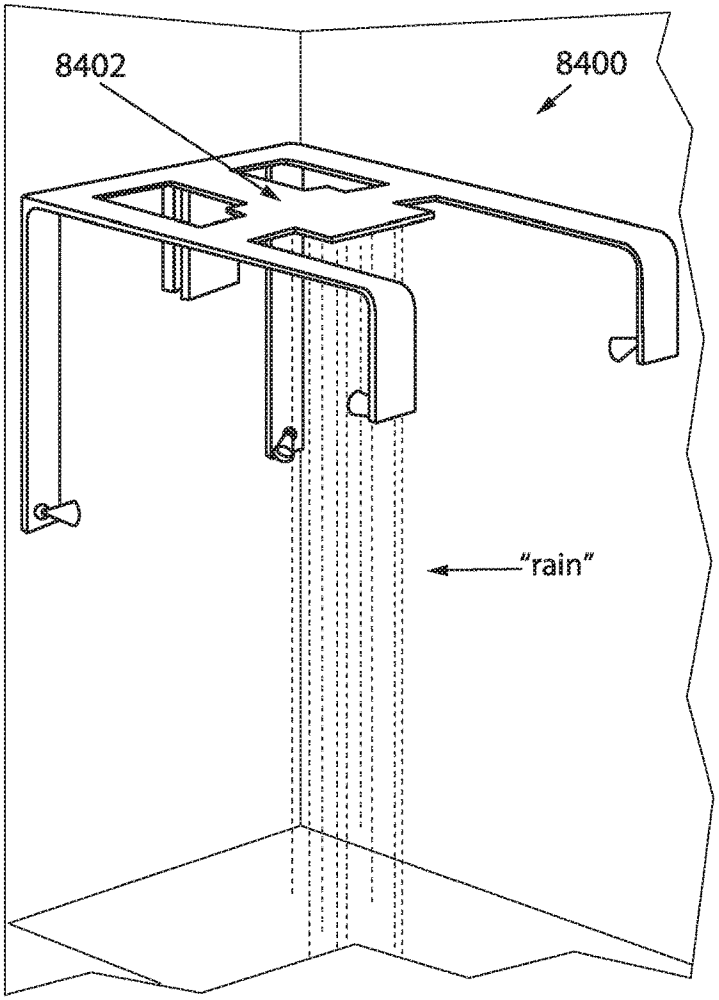
FIG. 85 schematically illustrates a central rain shower that is additionally provided to sprayers in the shower apparatus of FIG. 84.
Figure 84:
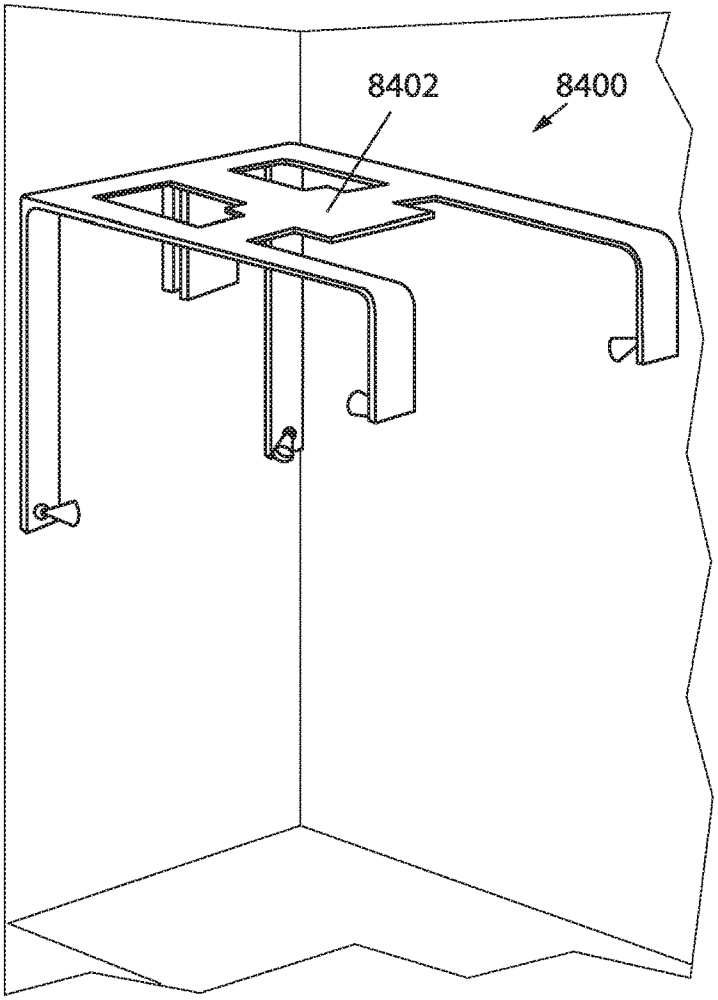
FIG. 84 schematically illustrates a framework and sprayers in another shower apparatus in accordance with one or more embodiments of the present invention.

FIG. 84 schematically illustrates a framework and sprayers in another shower apparatus 8400 in accordance with one or more embodiments of the present invention; and FIG. 85 schematically illustrates a "central rain shower" arrangement of sprayers at 8402 that is provided in the shower apparatus 8400 of FIG. 84.

Figure 87:
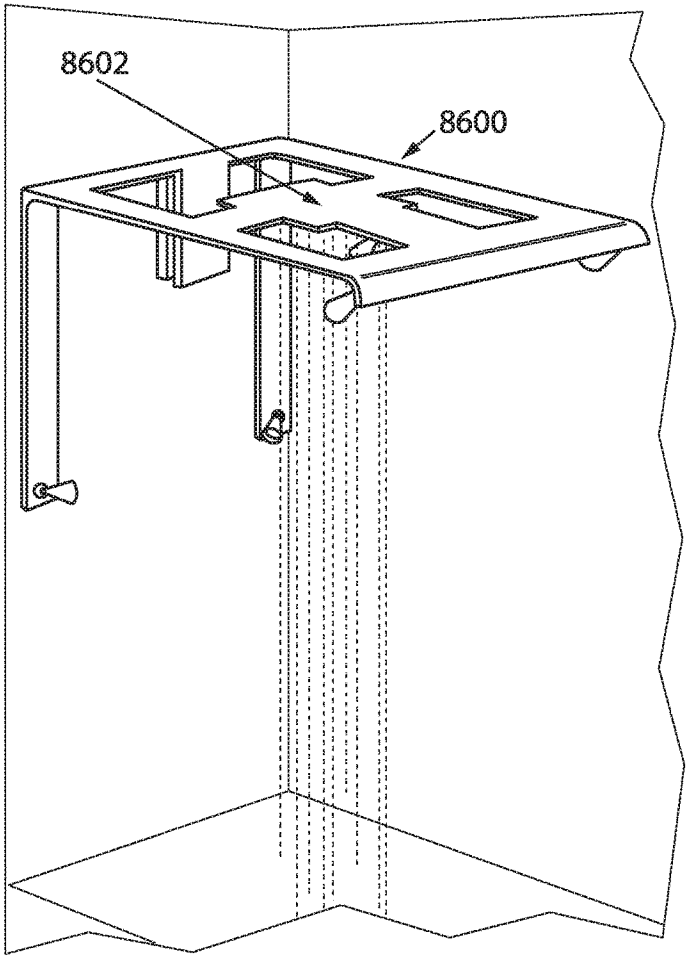
FIG. 87 schematically illustrates a central rain shower that is additionally provided in the shower apparatus of FIG. 86.
Figure 86:
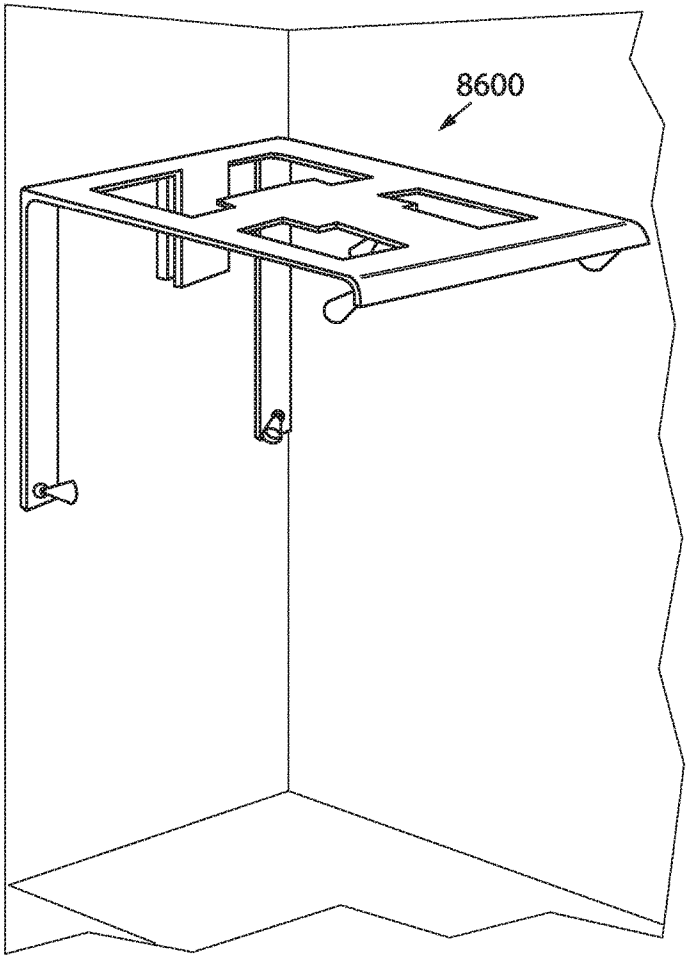
FIG. 86 schematically illustrates a framework and sprayers in another shower apparatus in accordance with one or more embodiments of the present invention.

FIG. 86 schematically illustrates a framework and sprayers in another shower apparatus 8600 in accordance with one or more embodiments of the present invention; and FIG. 87 schematically illustrates "a central rain shower" arrangement of sprayers at 8602 that is provided in the shower apparatus of FIG. 86.

Figure 89:
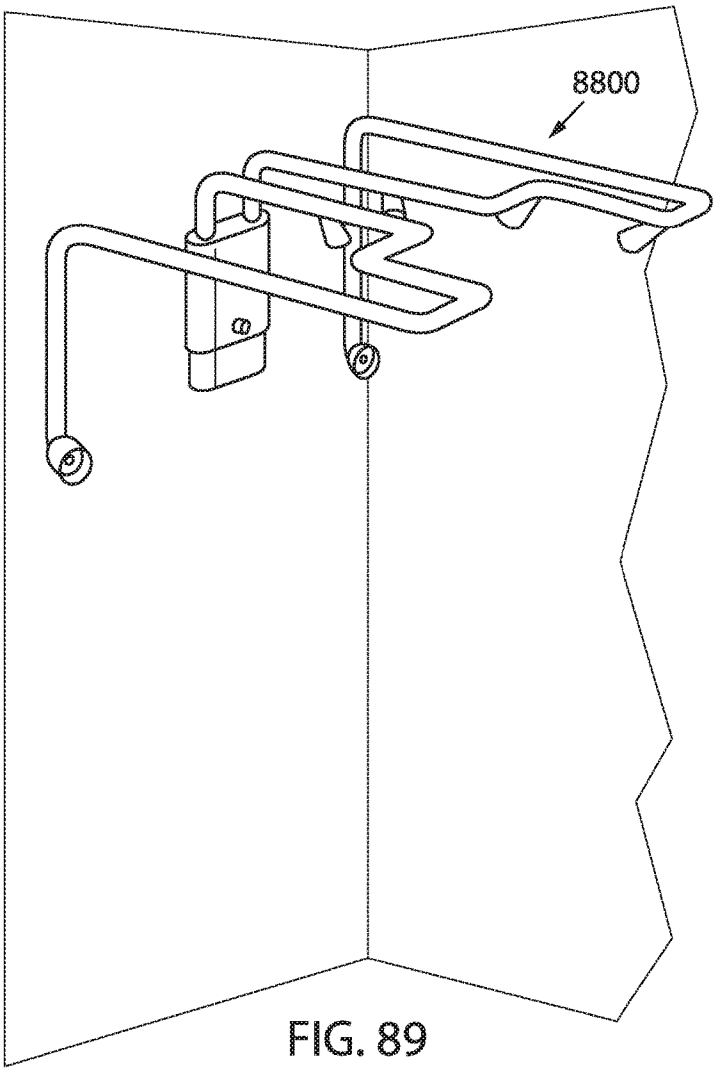
FIG. 89 is a perspective view of the installation of FIG. 88.
Figure 88:
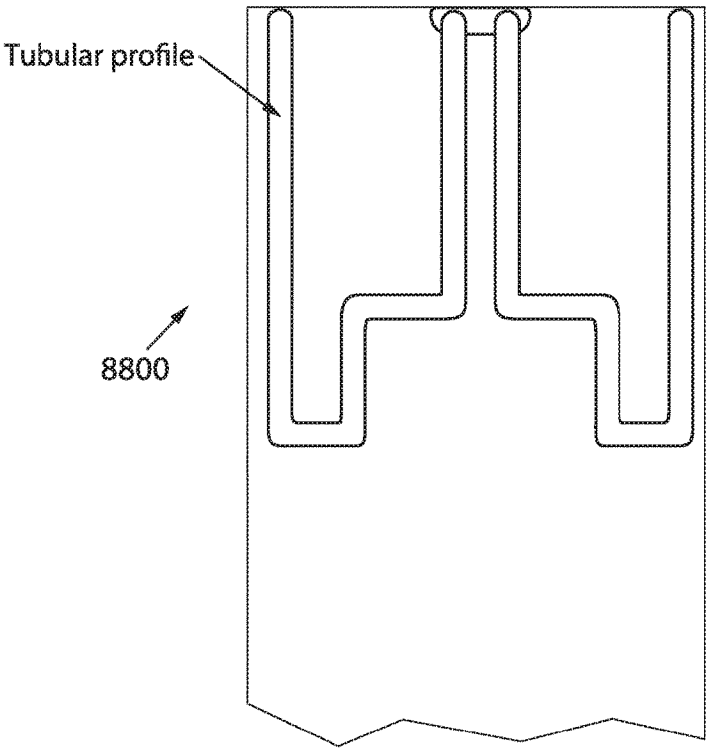
FIG. 88 schematically illustrates a top view of a framework and sprayers of an installation of another shower apparatus in accordance with one or more embodiments of the present invention.

FIG. 88 schematically illustrates a top view of a framework and sprayers of an installation of another shower apparatus 8800 in accordance with one or more embodiments of the present invention, and FIG. 89 is a perspective view of the installation of the apparatus 8800 of FIG. 88. As seen in these drawings, the framework has a tubular profile.

Figure 91:
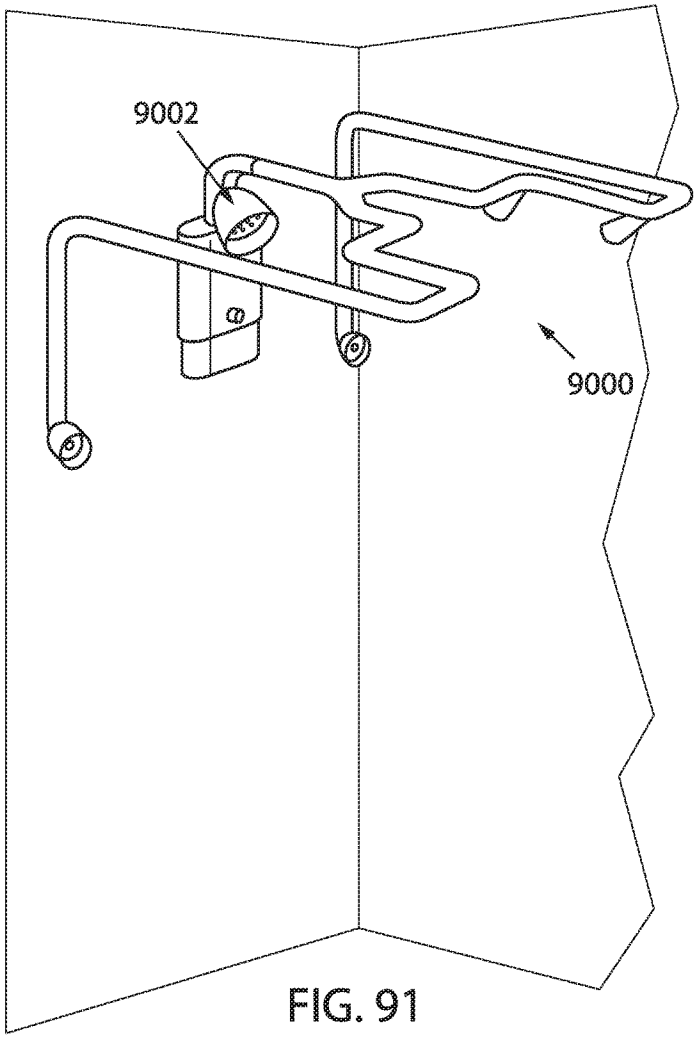
FIG. 91 is a perspective view of the installation of FIG. 90.
Figure 90:
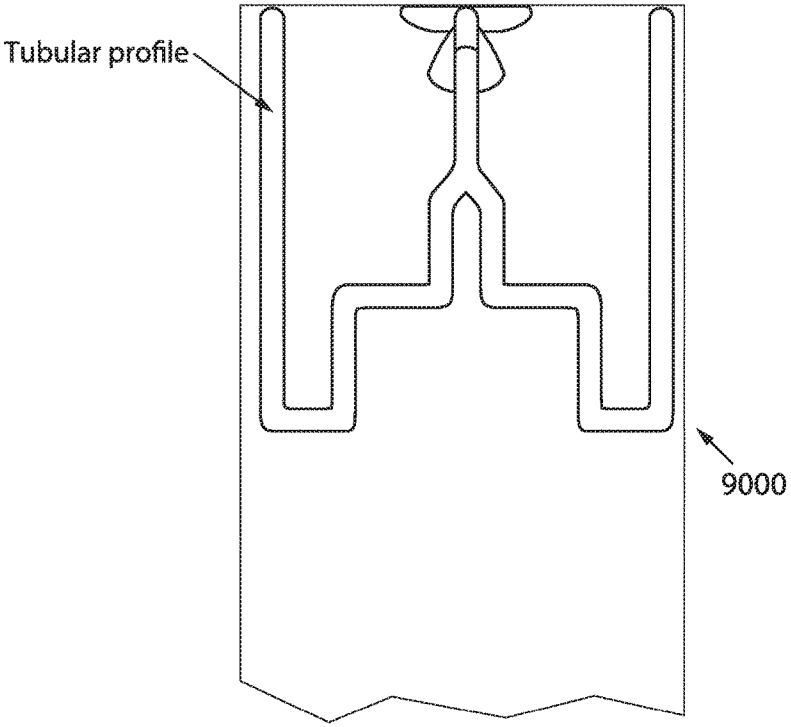
FIG. 90 schematically illustrates a top view of a framework and sprayers of an installation of another shower apparatus in accordance with one or more embodiments of the present invention.

FIG. 90 schematically illustrates a top view of a framework and sprayers of an installation of another shower apparatus 9000 in accordance with one or more embodiments of the present invention, and FIG. 91 is a perspective view of the installation of the apparatus 9000 of FIG. 90. As seen therein, the apparatus includes a shower head 9002 incorporated therein.

Figure 93:
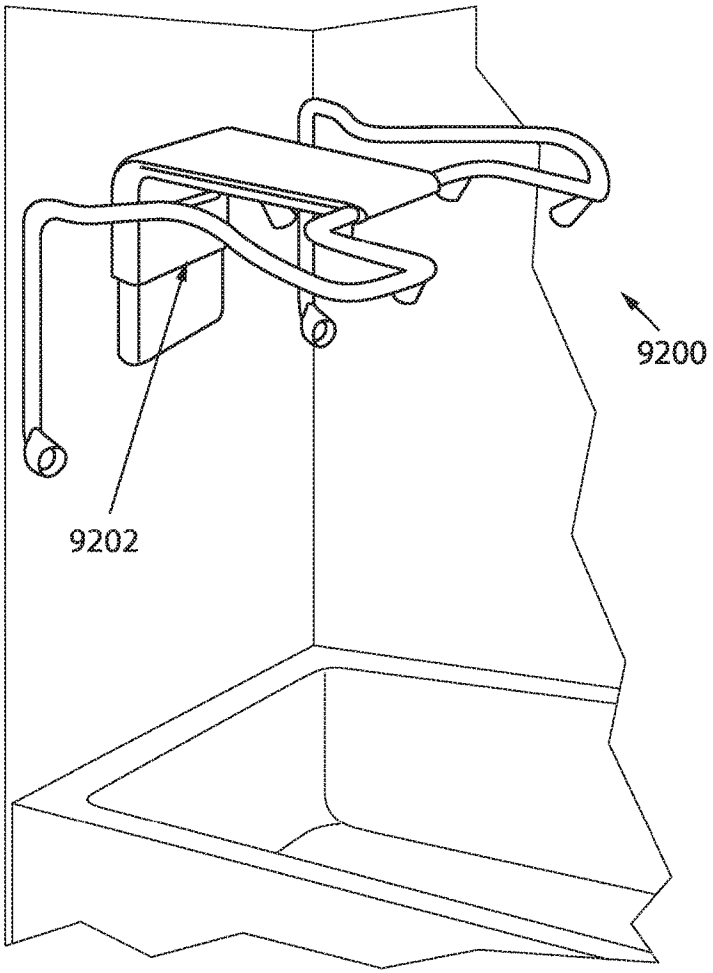
FIG. 93 is a perspective view of the installation of FIG. 92.
Figure 92:
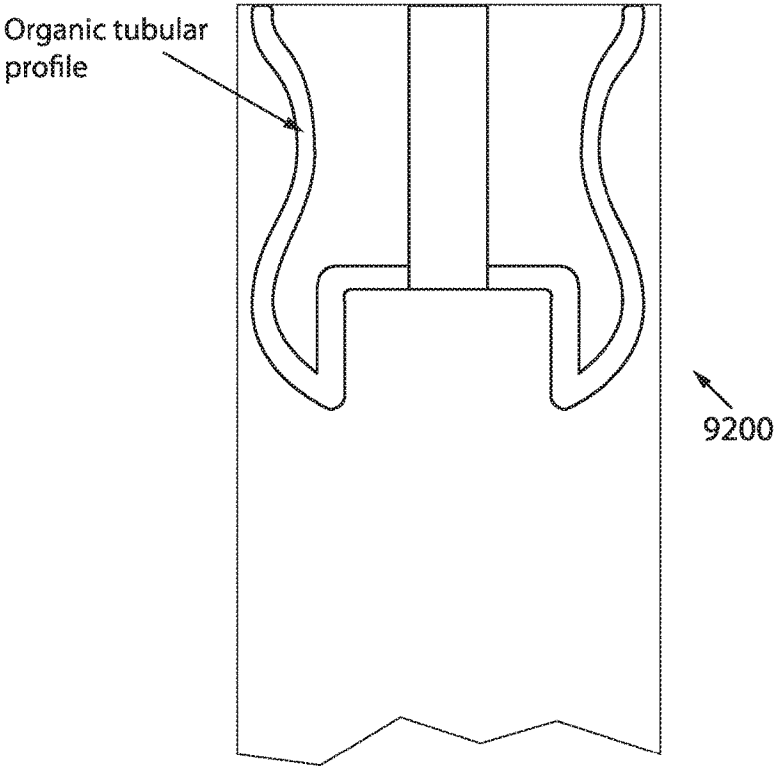
FIG. 92 schematically illustrates a top view of a framework and sprayers of an installation of another shower apparatus in accordance with one or more embodiments of the present invention.

FIG. 92 schematically illustrates a top view of a framework and sprayers of an installation of another shower apparatus 9200 in accordance with one or more embodiments of the present invention, and FIG. 93 is a perspective view of the installation of FIG. 92. As seen therein, the apparatus includes a waterfall shower slot 9202. The framework further has an organic tubular profile.

Figure 95:
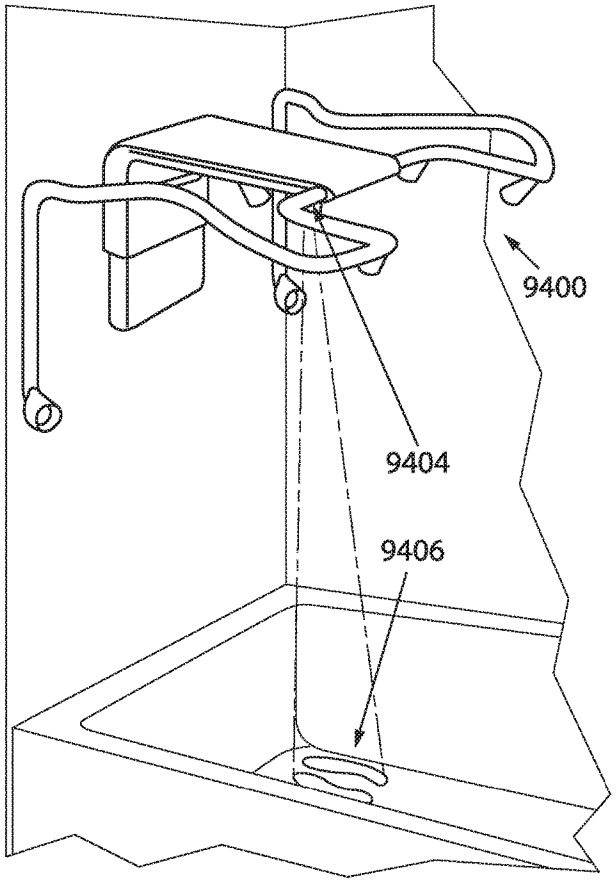
FIG. 95 is another perspective view of the installation of FIG. 94.
Figure 94:
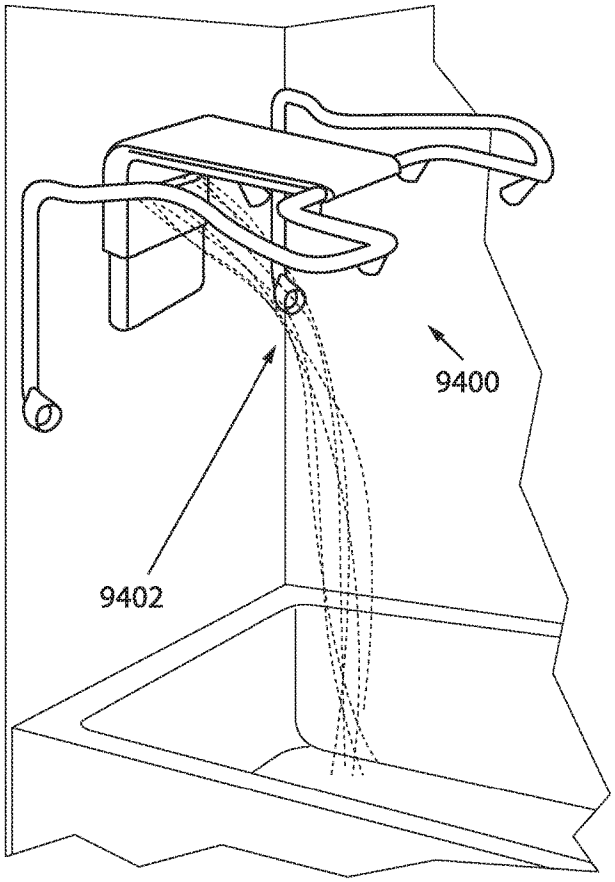
FIG. 94 schematically illustrates a perspective view of a framework and sprayers of an installation of another shower apparatus in accordance with one or more embodiments of the present invention.

FIG. 94 schematically illustrates a perspective view of a framework and sprayers of an installation of another shower apparatus 9400 in accordance with one or more embodiments of the present invention, and FIG. 95 is another perspective view of the installation of the apparatus 9400 of FIG. 94. As seen therein, the apparatus includes a waterfall shower slot with an illustrated waterfall at 9402. The apparatus 9400 further has a lighting component 9404, e.g., a laser, for illuminating the proper location for standing by a person, as seen at 9406.

Figure 96:
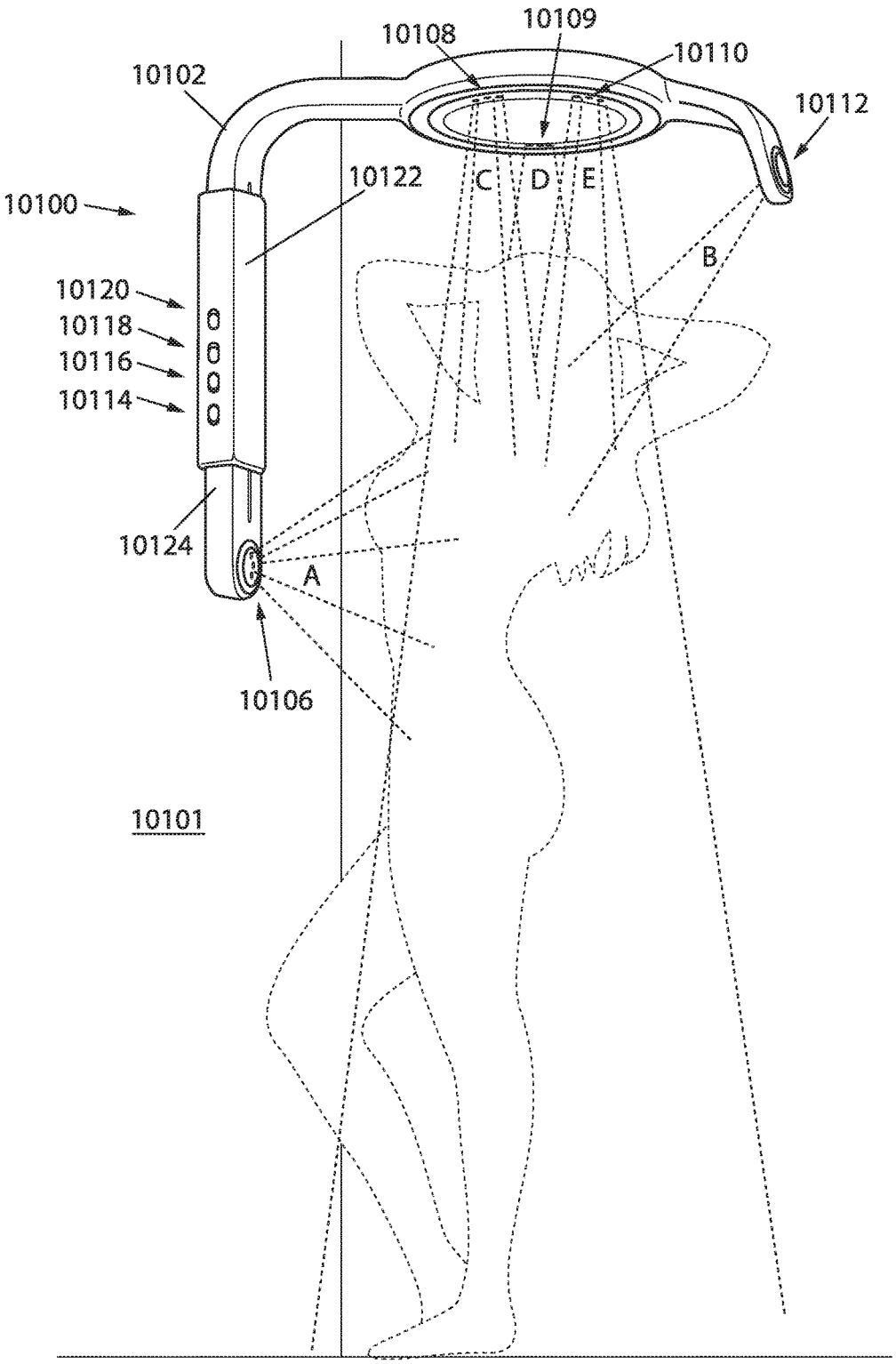
FIG. 96 is perspective view of a framework and sprayers of an installation of another shower apparatus in accordance with one or more embodiments of the present invention.

FIG. 96 is a perspective view of another adjustable height shower apparatus 10100 having multiple shower sprayers in accordance with one or more embodiments of the present invention. The apparatus 10100 includes framework 10102. The framework 10102 includes conduits that define fluid passageways from a fluid inlet port (hidden from view in FIG. 96) to each of a plurality of the sprayers. The framework 10102 preferably is made of a plastic/PVC/CPVC material, but could be manufactured from metals including brass, copper, stainless steel, and the like. The inlet port is threaded for attachment of a hose for connection to plumbing of a wall 10101 of the shower installation. The multiple sprayers of the shower apparatus 10100 include a front sprayer 10106; a back sprayer 10112; and three side sprayers 10108,10109,10110, which are arranged in a circumferential manner along an oval portion of the frame 10102. Each of the sprayers comprises a plurality of small openings that collective define a spray. The spray of each of the sprayers is illustrated at A,B,C,D,E in FIG. 96.

The front sprayer 10106 represents the lowermost sprayer and is configured to act as a drain at least some of the conduits of the framework 10102 when the water is turned off to the shower apparatus 10100. When water is turned on: the front sprayer 106 is located so as to spray water onto a front of a person's body via spray A as seen in FIG. 96; each of the side sprayers 10108,10109,10110 is located so as to spray water onto a side of a person's head and shoulders via sprays C,D,E as seen in FIG. 96; and the back sprayer 10112 is located so as to spray water onto a person's back via spray B as seen in FIG. 96.

The control of flow of water to the sprayers is controlled by user controls 10114,10116,10118, each of which is configured to operate a respective flow control value. For example, user control 10114 operates a flow control valve (hidden from view in FIG. 96) for controlling flow of water to sprayer 10106; user control 10116 operates a flow control valve (hidden from view in FIG. 96) for controlling flow of water to sprayers 10108,10109,10110; and, user control 10118 operates a flow control valve (hidden from view in FIG. 96) for controlling flow of water to sprayer 10112. In one or more embodiments, a flow control valve comprises a solenoid valve for electronic operation by battery, and in other embodiments the flow control valve is manually operated.

Additionally, the height of the sprayers 10106,10108, 10110,10112 is adjustable by adjusting the height of the framework 10102 relative to the wall 10101. In this respect, a mounting assembly attaches the framework onto a wall in a shower stall or bathtub installation and includes a first component 10124 and a mounting component 10122. The mounting component 10122 is mounted onto the wall 10101 in a fixed position relative thereto, and may be mounted by screw type fasteners, adhesives, or other conventional means. The first component 10124 is received within a channel that is defined by the mounting component 10122, and the first component 10124 is slidable therein. The first component 10124 comprises a portion of the framework 10102 as seen in FIG. 96, but could be a separate component that is attached to the framework 10102.

In one or more embodiments, a spring-biased button 10120 is provided that is manually operable for adjusting the height of the framework 10102. Preferably, depressing the button 10120 unlocks the first component 10124 in its mounting on the mounting component 10122 such that the first component 10124 is able to slide on the mounting component 10122 relative to the wall 10101 and relative to the floor of the shower installation. Release of the spring-biased button 10120 permits return of the button 10120 such that the first component 10124 again is locked in position on the mounting component 10122, thereby fixing the framework 10102 in a fixed position relative to the wall 10101 until the button 10120 is depressed again for adjustment of the height of the framework 10102.

Other means of adjusting the height of the framework relative to the wall and floor can be used in variations within the scope of the present invention. For example, a tight friction fit may be provided between the mounting component and the first component within the channel such that the first component is selectively adjustable to different positions relative to the mounting component by manually exerting a sufficient force to overcome the friction therebetween locking the components together.

Preferred embodiments of the invention are designed to assemble quickly and easily and attach to existing fixtures without requiring plumbing skills and without requiring assistance by a professional plumber. Once assembled and installed, the preferred embodiments are easily adjustable to various heights for multi-user households. The preferred embodiments are non-intrusive and highly adjustable, and are designed to allocate water to the entire body for enabling enhanced relaxation while showering.

Furthermore, the preferred embodiments may work as an "either/or" system in conjunction with an existing shower head, via a splitter/diverter/alternator. In such scenarios, a user has the option to utilize an existing showerhead or switch to a preferred embodiment via a switch, dial, lever, knob, or the like.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An adjustable height shower apparatus, comprising, (a) a mounting component configured for attachment on a wall; and (b) a rigid framework comprising (i) a fixed, spatial arrangement of sprayers for delivering water to a person for showering, and (ii) fluid passageways from a fluid inlet port to each sprayer whereby pressurized water is able to flow from the fluid inlet port to each sprayer;

(c) wherein the rigid framework is movable relative to the mounting component to, and lockable at, different heights from a floor such that the fixed, spatial arrangement of sprayers of the rigid framework is raised and lowered to different heights from the floor; and (d) wherein, when the framework is moved to and locked at a particular height, (i) a front sprayer extends below a lowermost elevation of the mounting component and is configured to spray water onto a front of a person's body, (ii) an intermediate sprayer extends above an uppermost elevation of the mounting component and is configured to spray water onto a person's head, and (iii) a back sprayer extends above the uppermost elevation of the mounting component and is configured to spray water onto a person's back, (iv) wherein the front sprayer represents a lowermost sprayer of the spatial arrangement of sprayers.

2. The adjustable height shower apparatus of claim 1, further comprising a flow control valve by which flow within the framework to multiple sprayers is turned on and off.

3. The adjustable height shower apparatus of claim 1, wherein the front sprayer is configured to act as a drain for the framework when water is turned off to the shower apparatus.

4. The adjustable height shower apparatus of claim 1, wherein the fixed, spatial arrangement of sprayers further comprises one or more additional front sprayers each extending below the lowermost elevation of the mounting component and configured to spray water onto a person's front.

5. The adjustable height shower apparatus of claim 1, wherein the arrangement of sprayers further comprises one or more additional intermediate sprayers each extending above the uppermost elevation of the mounting component and configured to spray water onto a person's head.

6. The adjustable height shower apparatus of claim 1, wherein the arrangement of sprayers further comprises one or more additional back sprayers each extending above the uppermost elevation of the mounting component and configured to spray water onto a person's back.

7. The adjustable height shower apparatus of claim 1, wherein the mounting assembly represents a single point of mounting of the adjustable height shower apparatus.

8. The adjustable height shower apparatus of claim 1, wherein the framework acts as a cantilever in support of the intermediate and back sprayers.

9. The adjustable height shower apparatus of claim 1, wherein a sprayer of the arrangement comprises a small opening.

10. The adjustable height shower apparatus of claim 1, wherein a sprayer of the arrangement comprises an array of small openings that collectively define a spray.

11. A bathtub arrangement or shower stall, comprising:

(a) a mounting assembly attached on a wall;

(b) a plurality of sprayers; and (c) a rigid framework comprising a fixed, spatial arrangement of sprayers, and fluid conduits defining fluid passageways from a fluid inlet port to each sprayer of the arrangement, whereby pressurized water is able to flow from the fluid inlet port to each sprayer of the arrangement, the fluid inlet of the rigid framework being connected to plumbing for the flow of water;

(d) wherein the rigid framework is vertically positionable and lockable relative to a mounting component that is attached in fixed position on the wall;

(e) wherein the fixed, spatial arrangement of sprayers is adjustable to different heights by moving and locking the rigid framework relative to the mounting component; and (f) wherein, when moved to and locked in one such position, the arrangement of sprayers comprises (i) a front sprayer extending below a lowermost elevation of the mounting component and configured to spray water onto a front of a person's body, (ii) an intermediate sprayer extending above an uppermost elevation of the mounting component and configured to spray water onto a person's head, and (iii) a back sprayer extending above the uppermost elevation of the mounting component and configured to spray water onto a person's back, (iv) wherein the front sprayer represents a lowermost sprayer of the arrangement.

12. The bathtub arrangement or shower stall of claim 11, wherein the back sprayer extends below an elevation of the intermediate sprayer.

13. The bathtub arrangement or shower stall of claim 11, wherein the front sprayer of the arrangement of sprayers is configured to act as a drain for the rigid framework when water is turned off to the rigid framework.

14. The bathtub arrangement or shower stall of claim 11, further comprising a flow control valve by which flow within the rigid framework to multiple sprayers of the sprayer arrangement is turned on and off.

15. The bathtub arrangement or shower stall of claim 11, wherein the arrangement of sprayers further comprises one or more additional intermediate sprayers each extending above the elevation of the mounting component and configured to spray water onto a person's head.

16. The bathtub arrangement or shower stall of claim 11, wherein the arrangement of sprayers further comprises one or more additional back sprayers each extending above the elevation of the mounting component and configured to spray water onto a person's back.

17. The bathtub arrangement or shower stall of claim 11, wherein the mounting assembly represents a single point of mounting of the framework to the wall.

18. A method of installing a shower apparatus in an existing bathtub arrangement or shower stall, comprising the steps of:

(a) mounting, onto a wall of an existing bathtub arrangement or shower stall, a rigid framework such that the rigid framework is vertically positionable to, and lockable at, different heights, the framework comprising sprayers in a fixed, spatial arrangement for showering, and fluid passageways from a fluid inlet port to each sprayer whereby pressurized water is able to flow from the fluid inlet port to each sprayer;

(b) connecting the fluid inlet of the rigid framework to plumbing for the flow of water thereto; and (c) adjusting the height of the rigid framework by positioning and locking the rigid framework relative to the mounting component, with the fixed, spatial arrangement of sprayers moving concurrently with the rigid framework during such adjusting;

(d) wherein, when the framework is adjusted to a particular height, the arrangement of sprayers comprises (i) a front sprayer that extends below a lowermost elevation of the mounting component and that is configured to spray water onto a front of a person's body, (ii) an intermediate sprayer that extends above an uppermost elevation of the mounting component and that is configured to spray water onto a person's head, and (iii) a back sprayer that extends above the uppermost elevation of the mounting component and that is configured to spray water onto a person's back, (iv) wherein the front sprayer represents a lowermost sprayer of the fixed, spatial arrangement of sprayers.

19. The method of claim 18, wherein the front sprayer of the arrangement of sprayers is configured to act as a drain for the rigid framework when water is turned off to the rigid framework.

20. The method of claim 18, further comprising a flow control valve by which flow within the rigid framework to multiple sprayers of the arrangement of sprayers is turned on and off.

* * * * *